US006508700B2

(12) United States Patent
Mori et al.

(10) Patent No.: US 6,508,700 B2
(45) Date of Patent: Jan. 21, 2003

(54) COIN PROCESSING DEVICE

(75) Inventors: Yoshikazu Mori, Saitama (JP); Mitsugu Mikami, Kawagoe (JP); Yukio Ito, Saitama (JP); Kenji Nakajima, Saitama (JP); Takahiro Hayashi, Kitamoto (JP); Masato Yagi, Urawa (JP)

(73) Assignee: Kabushiki Kaisha Nippon Conlux (JP)

( * ) Notice: Subject to any disclaimer, the term of this patent is extended or adjusted under 35 U.S.C. 154(b) by 193 days.

(21) Appl. No.: 09/757,958

(22) Filed: Jan. 10, 2001

(65) Prior Publication Data

US 2001/0008831 A1 Jul. 19, 2001

(30) Foreign Application Priority Data

Jan. 14, 2000 (JP) ..... 2000/006946
Mar. 22, 2000 (JP) ..... 2000/080793

(51) Int. Cl.[7] ..... G07D 3/14
(52) U.S. Cl. ..... 453/3; 194/302
(58) Field of Search ..... 453/3, 4; 194/302, 194/303, 304

(56) References Cited

U.S. PATENT DOCUMENTS 3,948,377 A 4/1976 Hayashi et al. ..... 194/1
4,558,712 A * 12/1985 Sentoku et al. ..... 453/3
5,052,538 A * 10/1991 Satoh ..... 453/3 X
5,380,242 A * 1/1995 Matsumoto et al. ..... 453/3
5,433,309 A * 7/1995 Yellop et al. ..... 453/3 X
5,538,469 A * 7/1996 Kwon et al. ..... 453/3
5,564,549 A * 10/1996 Menke et al. ..... 453/3 X
6,076,649 A * 6/2000 Waldorff, Jr. ..... 453/3 X
6,346,039 B2 * 2/2002 Orton et al. ..... 453/3

FOREIGN PATENT DOCUMENTS

| | | |
|---|---|---|
| JP | 52-61397 | 5/1977 |
| JP | 04-172592 | 6/1992 |
| JP | 07-114660 | 5/1995 |
| JP | 07-141540 | 6/1995 |
| JP | 11-288480 | 10/1999 |

* cited by examiner

*Primary Examiner*—James R. Bidwell
(74) *Attorney, Agent, or Firm*—Greer, Burns & Crain, Ltd.

(57) ABSTRACT

A coin processing device (1) comprises a first sorting component (35) disposed downstream from a coin detaining component (30), for sorting into a return passage (70) and a coin storage component (91) any coins A that have been temporarily detained by the coin detaining component (30), and a second sorting component (51) disposed downstream from the first sorting component (35), for sorting into the coin storage component (91) and a cashbox any coins A that have been sorted into the coin storage component (91) by the first sorting component (35).

10 Claims, 42 Drawing Sheets

COIN PROCESSING DEVICE

BACKGROUND OF THE INVENTION

1. Field of the Invention

The present invention relates to a coin processing device used in vending machines, money exchangers, service devices, etc., and designed to sort and store inserted coins by denomination and dispense as change the coins so sorted and stored.

2. Description of the Related Art

Vending machines, money exchangers, service devices, and so forth are equipped with coin processing devices for sorting and storing inserted coins by denomination and dispensing these sorted and stored coins as change.

Broadly classified, such coin processing devices consist of the following four sections.

(1) A device main body constituting the cabinet of the coin processing device.

(2) A coin sorting component, located in the uppermost portion of the device main body, for determining whether inserted coins are genuine and sorting genuine coins by denomination.

(3) A coin storage component, located within the device main body below the coin sorting component and comprising a plurality of coin tubes for stacking and storing by denomination genuine coins that have been sorted by denomination by the coin sorting component.

(4) A coin dispensing component, located within the device main body below the coin storage component, for dispensing as change those coins stored in the coin storage component.

Vending machines equipped with coin processing devices of this construction are designed such that when a product purchaser, having inserted coins in order to purchase a product, subsequently decides for some reason to cancel the product purchase and wants the coins to be returned, a coin return lever provided to the vending machine may be operated.

At this point, the coin processing device returns coins of the same value as the inserted coins through a coin return slot, so that the product purchaser desiring return of the inserted coins may recover the returned coins from the coin return slot.

With a typical coin processing device as described above, this coin return is accomplished by operation of the coin return lever, which causes the coin dispensing component to dispense coins of the same value as the inserted coins from the coin storage component to the coin return slot.

Specifically, when inserted coins are returned by a conventional coin processing device, the coins inserted by the product purchaser are not themselves dispensed at the coin return slot, but rather coins equal in value to the inserted value are dispensed at the coin return slot from among genuine coins already stored in the coin storage component.

Accordingly, when inserted coins are returned with a conventional coin processing device, the coins actually inserted are not dispensed, but rather coins of the same value as the inserted coins are dispensed from among coins already stored in the coin storage component, so if a skillfully-made counterfeit coin good enough to pass as genuine in the coin sorting component is inserted into the coin processing device, and if the coin return lever is then operated without a product being purchased, then even though the inserted coin is counterfeit, a genuine coin equal in value to the inserted amount will be dispensed to the coin return slot. This is known as "coin switching."

In order to prevent this coin switching, there has been proposed in the past, as disclosed in Japanese Laid-Open Patent Application H11-288480, a coin processing device in which a coin detaining lever is provided at the downstream end of a coin sorting passage having a plurality of denomination sorting levers for sorting by denomination coins considered to be genuine, that is, at the downstream end of the coin passage in which coins are ultimately sorted and guided by denomination, and an inserted coin is temporarily detained by this coin detaining lever, so that if the coin return lever is operated without a product being purchased, the inserted coin temporarily detained by the coin detaining lever will be released and the inserted coin dispensed from the coin return slot. This is known as an "actual coin return type of coin processing device."

With the actual coin return type coin processing device disclosed in Japanese Laid-Open Patent Application H11-288480, when the coin return lever is operated and a coin returned, the coin actually inserted is itself dispensed, so even if a skillfully-made counterfeit coin good enough to pass as genuine in the coin sorting component is inserted, the inserted (counterfeit) coin will itself be dispensed at the coin return slot, so coin switching is effectively thwarted.

Furthermore, in addition to the above-mentioned device disclosed in Japanese Laid-Open Patent Application H11-288480, in the past there was a device with which, in the event that a plurality of high-denomination coins were temporarily detained in the coin passage (according the length thereof) and the return lever was operated without a product being purchased, the plurality of temporarily detained coins were returned to the coin return slot.

Conventional coin processing devices therefore do effectively prevent coin switching, as with the actual coin return type coin processing device disclosed in Japanese Laid-Open Patent Application H11-288480.

However, the use of counterfeit coins per se cannot be prevented, and therefore a new-type 500-yen coin was issued that is more difficult to counterfeit.

Consequently, both the old 500-yen coin and the new-type 500-yen coin are being in circulation together, but since the old 500-yen coin is easier to counterfeit, all of the old 500-yen coins have to be recovered in order to end their use and prevent the counterfeiting of these old 500-yen coins.

However, old 500-yen coins cannot be recovered with conventional coin processing devices, such as the coin processing device disclosed in Japanese Laid-Open Patent Application H11-288480, which is a problem in that the use of old 500-yen coins cannot be prevented.

Of conventional coin processing devices, some employed a so-called "tube-remaining system". In this system, the number of coins that can be stored in each coin tube of the coin storage component could be set as desired. With this tube-remaining type of coin processing device, the number of coins kept on hand as change in the coin tubes can be reduced, and in particular, the number of high-denomination coins that are stored can be kept to a minimum as dictated by the set prices for the vending machine unit, which minimizes losses in the event that the coin processing device should malfunction due to vandals using a stun-gun or a radio transmitter, for example.

With these conventional tube-remaining type coin processing devices, full-detecting sensors for the coin tubes in which the various coins are stored are usually disposed according to the intended storage numbers set for each coin tube, and when the number of coins stored in a coin tube reaches this set storage number, the coin tube is considered to be full and any further inserted coins are stored in a cashbox.

Meanwhile, another conventional coin processing device is equipped with a lever that ordinarily guides coins to coin tubes that make up the coin storage component when these coin tubes are not full, but engages the stored coins and guides them to a cashbox when the coin tubes are full. This lever is known as a block-out lever. With a conventional coin processing device equipped with such a block-out lever, the block-out lever is designed to engage the stored coins when a coin tube is full, so a problem is that the above-mentioned tube-remaining system cannot be employed.

As discussed above, it is desirable with a coin processing device to prevent coin switching and also to set the number of high-denomination coins stored as change in the coin tubes as low as possible in order to minimize losses in the event of vandalism with a stun-gun or the like, but the actual coin return type of coin processing device disclosed in Japanese Laid-Open Patent Application H11-288480 is constructed such that a temporarily detained high-denomination coin is merely stored in a coin tube after a product has been purchased, so more high-denomination coins than necessary are stored in the coin tubes, and consequently, if the coin processing device should malfunction due to vandals using a stun-gun or the like, these high-denomination coins will be dispensed and a tremendous loss incurred.

SUMMARY OF THE INVENTION

A first object of the invention is to provide a coin processing device that prevents the use of old-type coins as much as possible for the sake of recovering these old-type coins.

A second object of the invention is to provide a coin processing device that employs a so-called tube-remaining system.

A third object of the invention is to provide a coin processing device designed such that coin switching is prevented as much as possible when a plurality of coins are being temporarily detained, and the number of coins stored in the coin storage component after temporary detention can be set as desired.

To achieve the first object above, the first invention is a coin processing device comprising coin identification means for identifying whether inserted coins are genuine and for identifying the denominations of the genuine coins, a plurality of denomination sorting means for sorting inserted coins identified as genuine into different coin passages on the basis of their denomination, coin detaining means disposed downstream from the different coin passages, for temporarily detaining the coins guided to the different coin passages, and coin storage means consisting of a plurality of coin tubes disposed downstream from the coin detaining means, for stacking and storing the coins that drop out of the coin detaining means, further comprising first sorting means disposed downstream from the coin detaining means, for sorting the coins temporarily detained by the coin detaining means into a return passage and the coin storage means, and second sorting means disposed downstream from the first sorting means, for further the coins sorted by the first sorting means into the coin storage means into the coin storage means and a cashbox.

To achieve the first and second objects above, the second invention is a coin processing device comprising coin identification means for identifying whether inserted coins are genuine and for identifying the denominations of the genuine coins, a plurality of denomination sorting means for sorting coins identified as genuine into different coin passages on the basis of their denomination, coin detaining means disposed downstream from the different coin passages, for temporarily detaining the coins guided to the different coin passages, and coin storage means consisting of a plurality of coin tubes disposed downstream from the coin detaining means, for stacking and storing the coins that drop out of the coin detaining means, further comprising first sorting means disposed downstream from the coin detaining means, for sorting the coins temporarily detained by the coin detaining means into a return passage and the coin storage means, and second sorting means disposed downstream from the first sorting means, for further sorting the coins sorted by the first sorting means into the coin storage means into the coin storage means and a cashbox, said second sorting means comprising a block-out lever with which coins that have been sorted into the coin storage means by the first sorting means are guided to the cashbox if the coin storage means overflows, and said block-out lever being operated by a solenoid.

To achieve the third object above, the third invention is a coin processing device comprising coin identification means for identifying whether inserted coins are genuine and for identifying the denominations of the genuine coins, a plurality of denomination sorting means for sorting inserted coins identified as genuine into different coin passages on the basis of their denomination, coin detaining means disposed downstream from the different coin passages, for temporarily detaining a plurality of coins guided to the different coin passages, and coin storage means consisting of a plurality of coin tubes disposed downstream from the coin detaining means, for stacking and storing the coins that drop out of the coin detaining means, the coin detaining means consisting of a coin detaining lever that intermittently drops the plurality of coins it detains one at a time, a first coin sorting lever with which the coins dropped one at a time by the coin detaining lever are sorted into a return passage and the coin storage means being provided downstream from the coin detaining means, and a second coin sorting lever with which the coins sorted into the coin storage means by the first coin sorting lever are sorted into the coin storage means and a cashbox being provided downstream from the first coin sorting lever.

Other objects and effects of the present invention can be easily confirmed from the following detailed description and the appended figures.

DESCRIPTION OF THE PREFERRED EMBODIMENTS

The coin processing devices according to the first and second inventions will now be described in detail through a first embodiment, and the coin processing device according to the third invention through a second embodiment.

Figure 1:
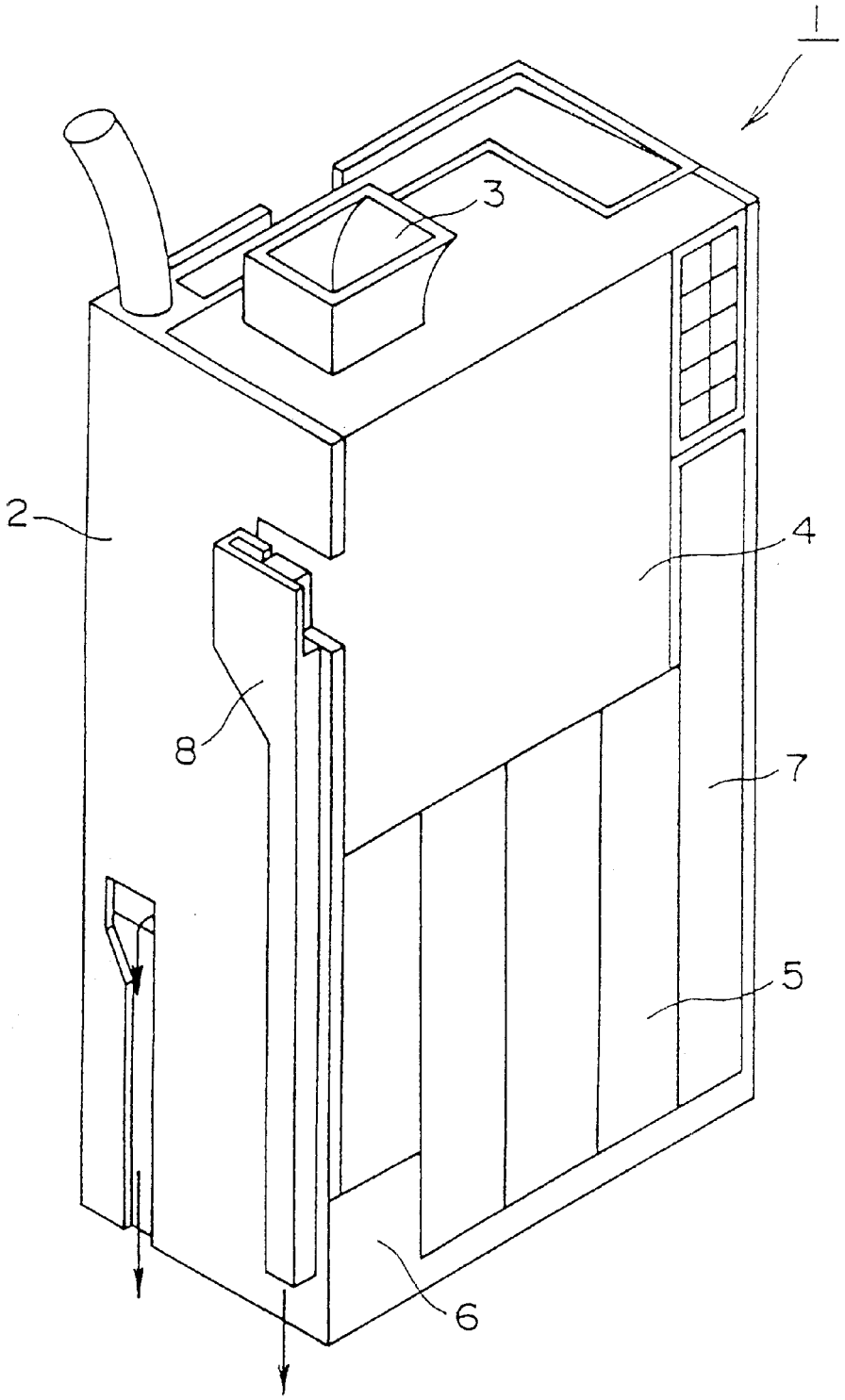
FIG. 1 is a schematic perspective view of a coin processing device according to the first and second inventions.

FIG. 1 is a schematic perspective view of the coin processing device 1 in a first embodiment according to the first and second inventions.

This coin processing device 1 of the first embodiment broadly consists of the following four sections, just as in the prior art.

Specifically, it likewise consists of a device main body 2 constituting a cabinet; a coin sorting component 4 located in the uppermost portion of the device main body 2, for determining whether an inserted coin inserted into a coin insertion slot 3 is genuine and sorting genuine coins by denomination; a coin storage component 5 located below the coin sorting component 4, comprising a plurality of coin tubes for storing by denomination genuine coins that have been sorted by the coin sorting component 4; and a coin dispensing component 6 located below the coin storing component 5, for dispensing the required change from genuine coins stored in the coin storing component 5.

7 in FIG. 1 is an auxiliary tube for storing coins used especially frequently, and 8 is a liquid discharge tube for discharging from the coin processing device 1 any liquid that has penetrated therein (a liquid such as a cleanser).

The coin sorting component 4 of the coin processing device 1 will now be described.

Figure 2:
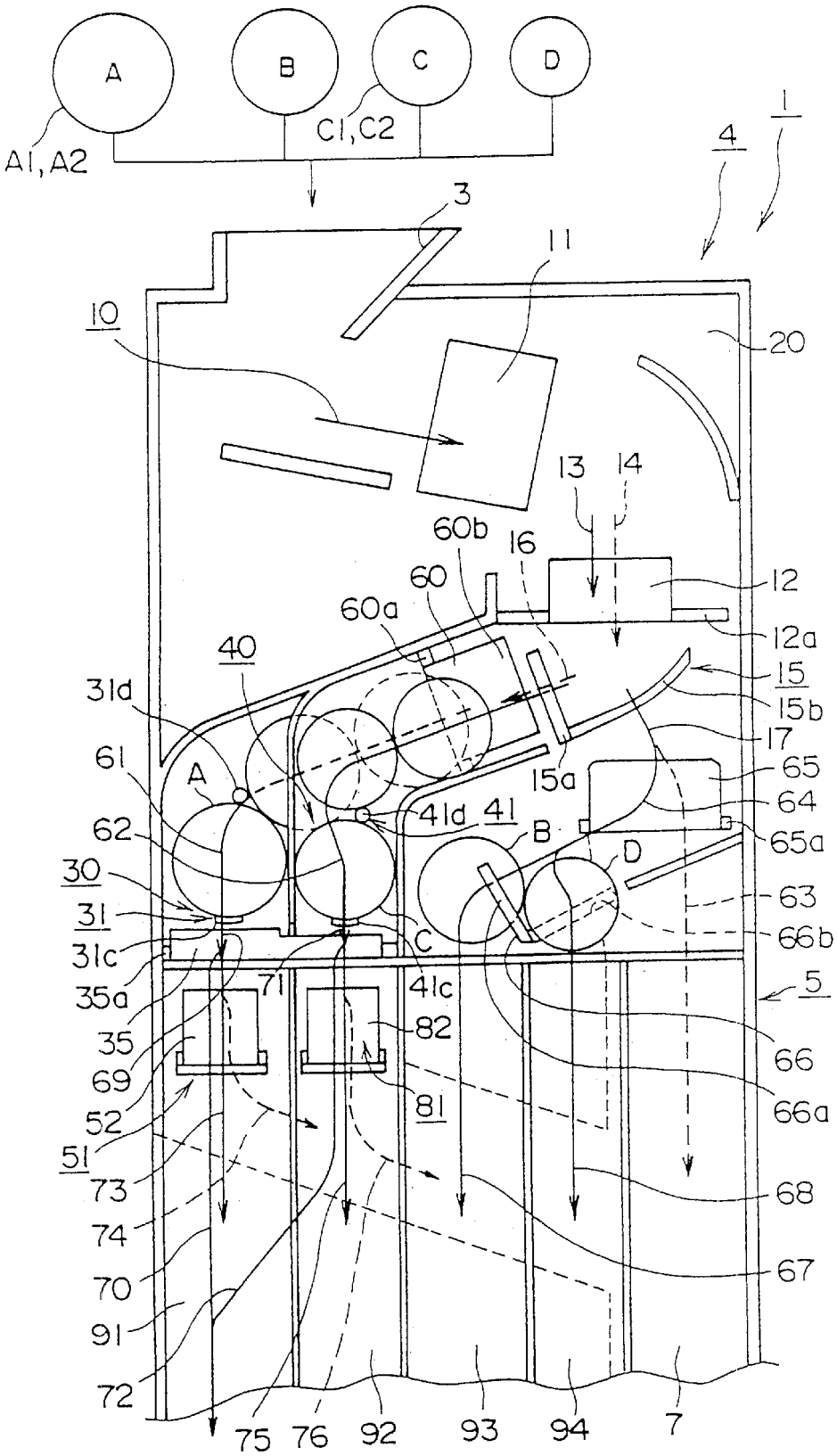
FIG. 2 is a schematic front view of the main components of the coin processing device according to the first and second inventions.

FIG. 2 is a schematic perspective view of the main components of the coin processing device 1.

This coin sorting component 4 basically performs sorting of four genuine coins A, B, C, and D, whose diameters are different from one another, and counterfeit coins. It also determines whether coin A is a new-type coin A1 or an old-type coin A2, and whether coin C is a new-type coin C1 or an old-type coin C2.

A coin identification passage 10, which slopes to the right in the figure, is formed directly beneath the coin insertion slot 3 of the coin sorting component 4. A coin identification sensor 11 for identifying whether a coin is genuine or counterfeit, the denomination of genuine coins, whether coin A is of old-type or new-type, and whether coin C is of old-type or new-type is disposed at some point along this passage.

At the end of this coin identification passage 10 is situated a genuine/counterfeit coin sorting lever 12 (genuine/counterfeit coin sorting component) for sorting coins transferred from the coin identification passage 10 into genuine coins and counterfeit coins, and guiding genuine coins and counterfeit coins into different coin passages.

This genuine/counterfeit coin sorting lever 12 is a sorting lever of a type in which the upper end opens and closes in a direction perpendicular to the plane of the figure, rotating around a shaft 12*a* at lower end thereof.

The end of the coin identification passage 10 is divided by this genuine/counterfeit coin sorting lever 12 into a counterfeit coin ejection passage 13 for guiding the inserted coins that are counterfeit, and a first coin sorting passage 14 for guiding the coins determined to be genuine.

Figure 3:
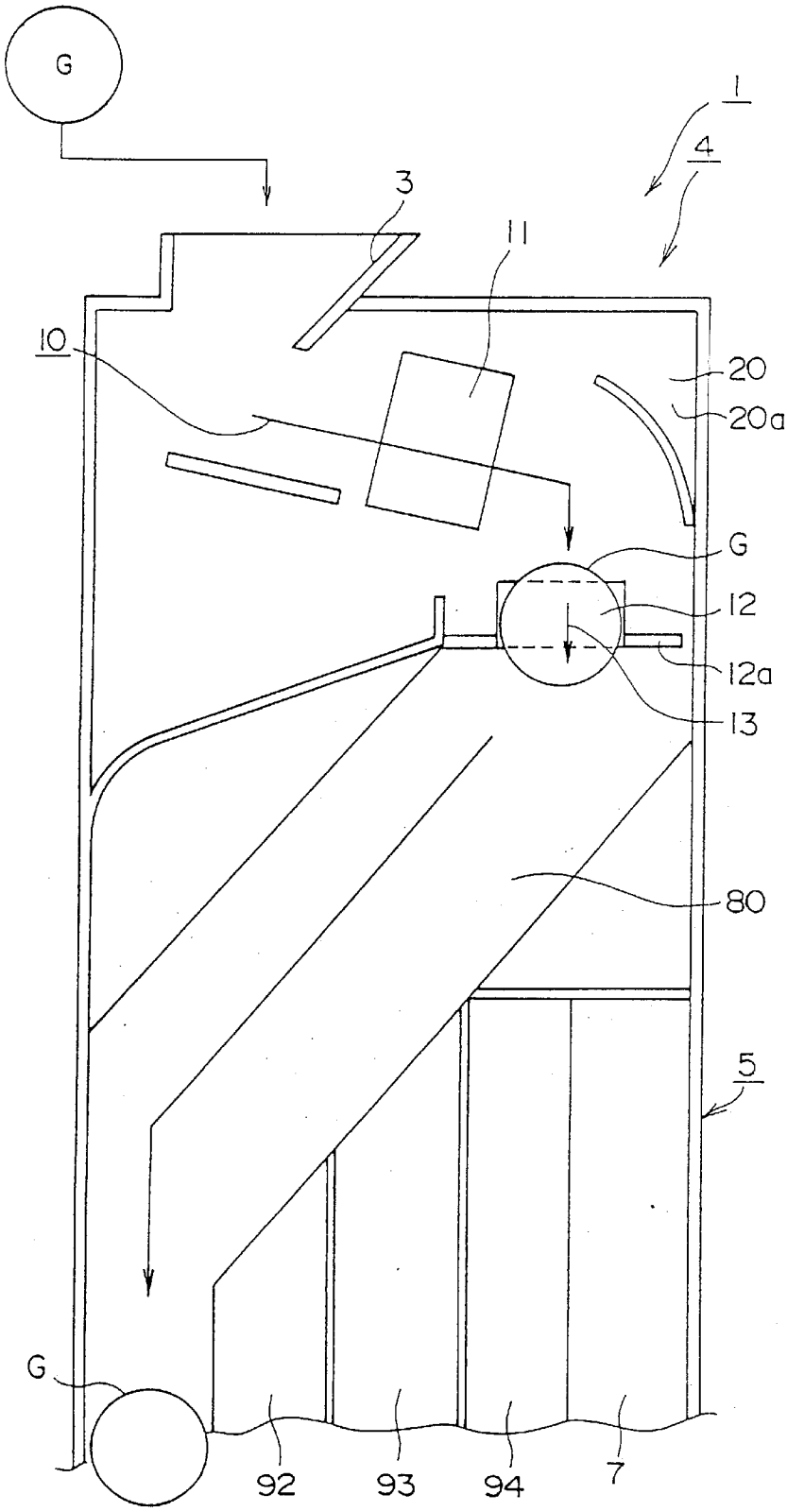
FIG. 3 is a schematic front view of the main components of the coin processing device according to the first and second inventions, illustrating the processing of counterfeit coins.

Out of the coin passage formed at the end of this coin identification passage 10, the counterfeit coin ejection passage 13 communicates with a coin ejection chute 80 (FIG. 3) formed on the front side of a main plate 20, that is, on the front side of the coin sorting component 4 shown in FIG. 1, and this coin ejection chute 80 is formed sloping to the left in the figure (FIG. 3). This coin ejection chute 80 also communicates with a coin return slot (not shown), and a counterfeit coin G guided to the counterfeit coin ejection passage 13 is returned to the coin return slot through the coin ejection chute 80, as indicated by the arrow in FIG. 3.

At the downstream end of the first coin sorting passage 14 shown in FIG. 2 there is disposed a first denomination sorting lever 15 (first denomination sorting component) for sorting coins determined to be genuine and transferred to the first coin sorting passage 14 (namely, the four types of genuine coins A, B, C, and D) into a group comprising coins A and C and a group comprising coins B and D.

The first coin sorting passage 14 is split by this first denomination sorting lever 15 into a second coin sorting passage 16, which slopes to the left in the figure, for guiding only coins of the A/C group, and a third coin sorting passage 17, which extends downward in the figure, for guiding only coins of the B/D group.

As shown in FIG. 2, the overall configuration of the first denomination sorting lever 15 is L-shaped when viewed from the front.

Figure 4:
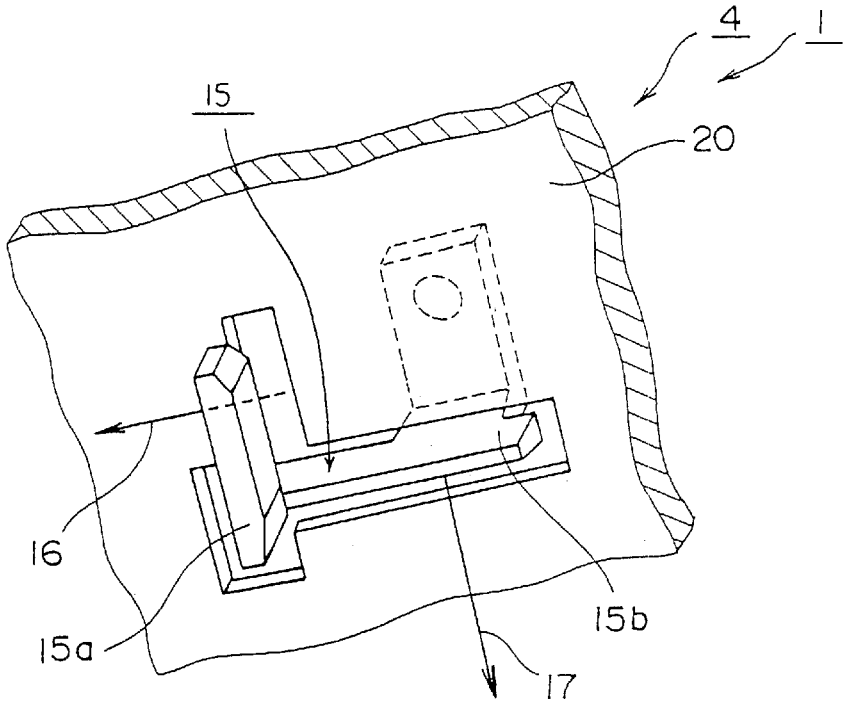
FIG. 4 is a schematic perspective view of the main components in FIG. 2, illustrating the operation of a first denomination sorting lever.
Figure 5:
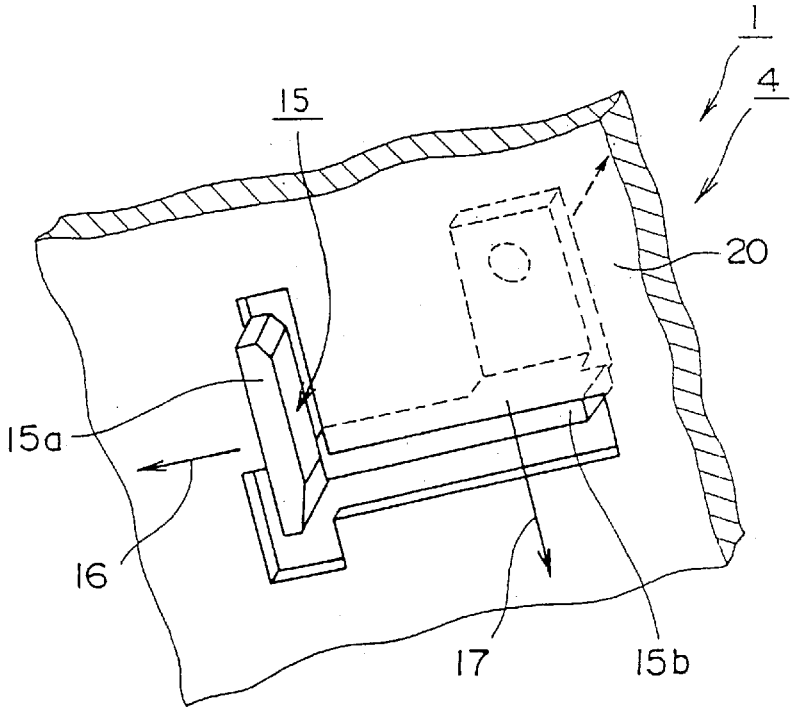
FIG. 5 is a schematic perspective view of the main components in FIG. 2, illustrating the operation of a first denomination sorting lever.

As shown in FIG. 4, which is a schematic perspective view of the main components in FIG. 2, this first denomination sorting lever 15 is made up of a first gate 15*a* that when projected from the surface of the main plate 20 of the coin sorting component 4, opens the second coin sorting passage 16 situated to the side, and that when drawn towards the main plate 20 as shown in FIG. 5, blocks off the above-mentioned second coin sorting passage 16; and a second gate 15*b* that when projected from the main plate 20 as shown in FIG. 4, blocks off the third coin sorting passage 17 situated on the bottom surface, and when drawn towards the main plate 20 as shown in FIG. 5, opens the above-mentioned third coin sorting passage 17.

The effect of this first denomination sorting lever 15 is that when the first denomination sorting lever 15 projects from the main plate 20 as shown in FIG. 4, the second coin sorting passage 16 is opened and the third coin sorting passage 17 is blocked, so only coins of the A/C group are guided into the second coin sorting passage 16.

When the first denomination sorting lever 15 is drawn toward the main plate 20 as shown in FIG. 5, the second coin sorting passage 16 is blocked and the third coin sorting passage 17 is opened, so only coins of the B/D group are guided into the third coin sorting passage 17.

Meanwhile, as shown in FIG. 2, a second denomination sorting lever 60 (second denomination sorting component) for sorting coins of the A/C group transferred to the second coin sorting passage 16 into coins A and coins C is provided at the downstream end of the second coin sorting passage 16. The second coin sorting passage 16 is divided by this second denomination sorting lever 60 into a fourth coin sorting passage 61 for guiding only coins A, and a fifth coin sorting passage 62 for guiding only coins C.

This second denomination sorting lever 60 is a denomination sorting lever of a type in which the right end 60*b* opens and closes in a direction perpendicular to the plane of the figure around a shaft 60*a* at the left end thereof.

As shown in FIG. 2, at the downstream end of the third coin sorting passage 17 there is provided a third denomination sorting lever 65 (third denomination sorting component) formed on the back of the main plate 20, for sorting coins into a sixth coin sorting passage 63, which leads to a cashbox (not shown), and a seventh coin sorting passage 64.

With this third denomination sorting lever 65, in the event that coins B or D stacked and stored in the coin tubes 93 and 94, respectively, of the coin storage component 5 (FIG. 1; discussed below) should overflow, the overflowing coins B or D are sorted and guided to the sixth coin sorting passage 63, which leads to the cashbox, whereas under normal circumstances in which coins B or D stacked and stored in the coin tubes 93 and 94, respectively (FIG. 1), are not overflowing, coins B or D that have passed through the third coin sorting passage 17 are sorted and guided to the seventh coin sorting passage 64.

This third denomination sorting lever 65 is also a denomination sorting lever of a type in which the upper end opens and closes in a direction perpendicular to the plane of the figure around a shaft 65*a* at its bottom end.

As shown in FIG. 2, a fourth denomination sorting lever 66 (fourth denomination sorting component) for sorting coins of the B/D group guided into the seventh coin sorting passage 64 into coins B and coins D is provided at the downstream end of the seventh coin sorting passage 64.

This fourth denomination sorting lever 66 is a lever with the same construction as the first denomination sorting lever 15. The effect of this fourth denomination sorting lever 66 is that when the fourth denomination sorting lever 66 projects from the main plate 20, the eighth coin sorting passage 67 is opened and a ninth coin sorting passage 68 is blocked, so only coins B are guided into the eighth coin sorting passage 67, and when the fourth denomination sorting lever 66 is drawn toward the main plate 20 side, the eighth coin sorting passage 67 is blocked and the ninth coin sorting passage 68 is opened, so only coins D are guided into the ninth coin sorting passage 68.

Figure 6:
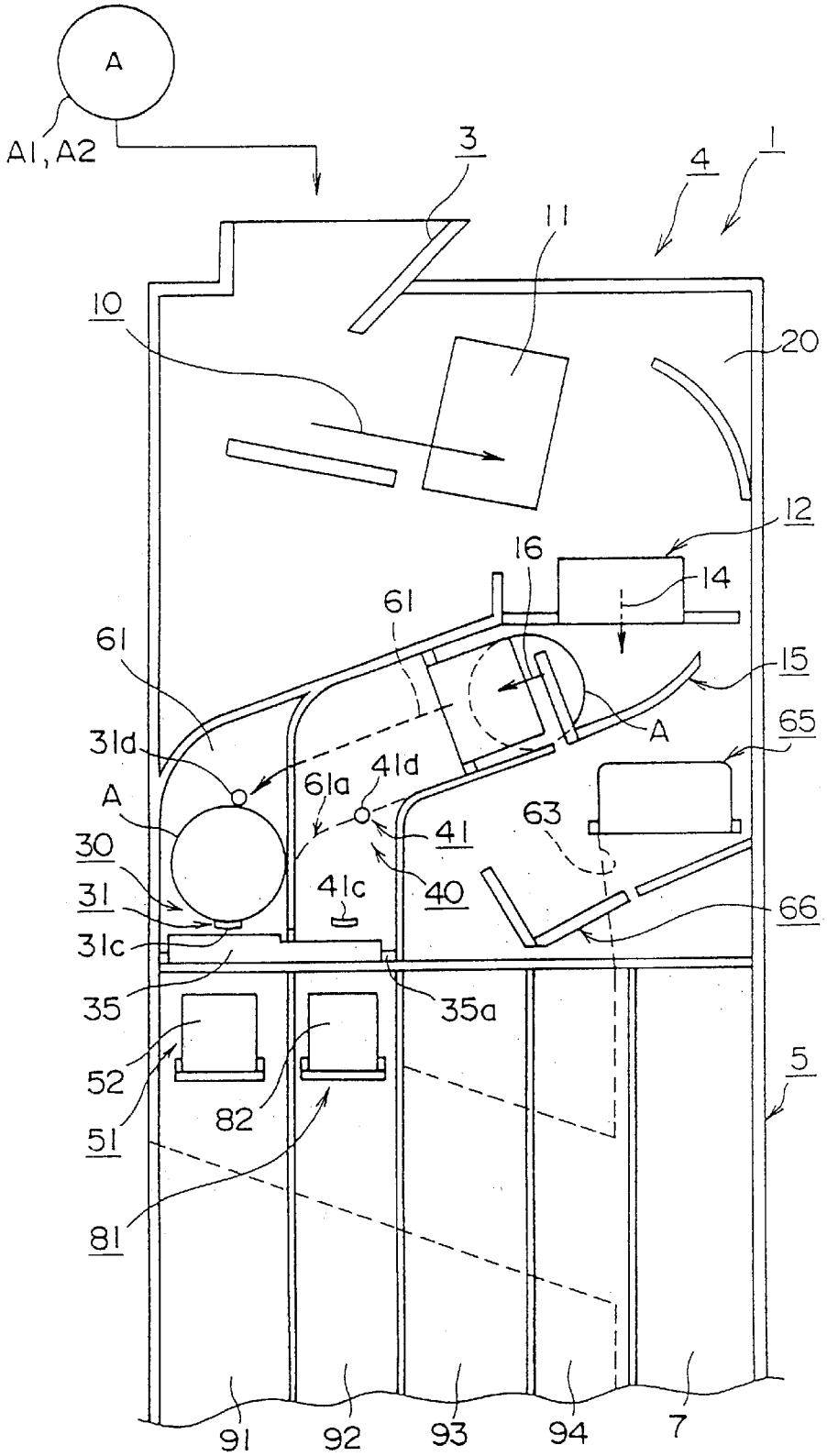
FIG. 6 is a schematic front view of the main components of the coin processing device in FIG. 1, illustrating the processing of a coin A.

As shown in FIG. 6, downstream from the fourth coin sorting passage 61 there is provided a first coin detaining means 30 consisting of a first coin detaining lever 31 that temporarily detains coins that are deemed to be coins A and pass through the fourth coin sorting passage 61, regardless of whether they are new-type coins A1 or old-type coins A2.

Figure 7:
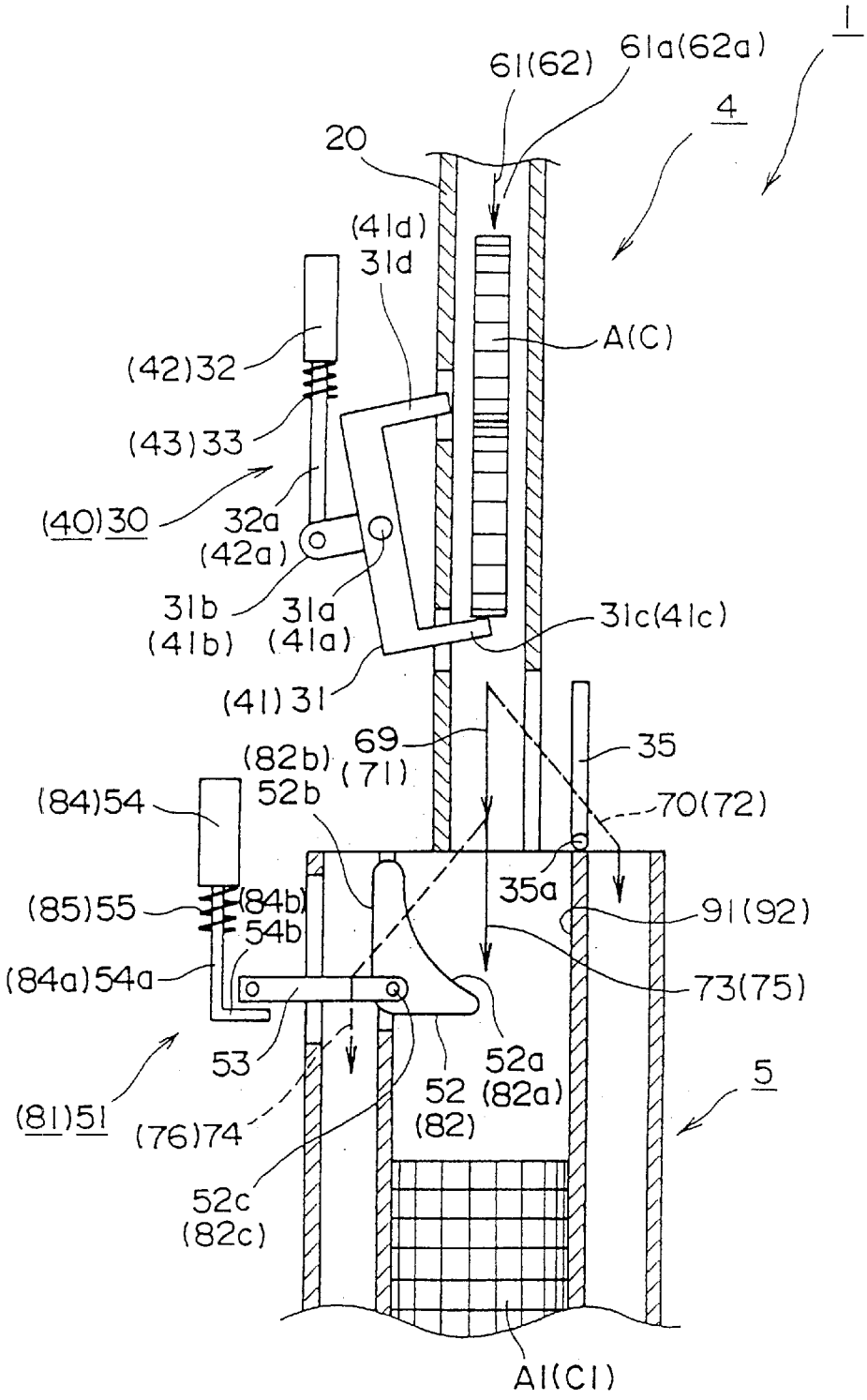
FIG. 7 is a schematic cross section of the main components in FIG. 6, illustrating the operation of the coin detaining means, the first sorting means, and the second sorting means.

As shown in FIG. 7, which is a schematic cross section of the main components in FIG. 6, the first coin detaining means 30 comprises the first coin detaining lever 31 for temporarily detaining coins that are deemed to be coins A and pass through the fourth coin sorting passage 61, regardless of whether they are new-type or old-type coins, and a first detaining component drive means consisting of a solenoid 32 for driving the first coin detaining lever 31. the first coin detaining lever 31 is a metal lever supported rotatably around a shaft 31*a,* and comprises a rear end component 31*b* linked to a drive shaft 32*a* of the solenoid 32, and a distal end component on which are formed a first distal end component 31*c* and a second distal end component 32*d* protruding into the fourth coin sorting passage 61. A coil spring 33 is fitted around the drive shaft 32*a* of the solenoid 32 linked to the rear end component 31*b* of the first coin detaining lever 31.

The effect of this first coin detaining means 30 is that in the initial state shown in FIG. 7, the distal end component of the first coin detaining lever 31 is constantly biased and halted in the counterclockwise direction around the shaft 31*a* by the biasing force of the coil spring 33, the first distal end component 31*c* projects from the surface of the main plate 20 and blocks the downstream end of the fourth coin sorting passage 61, while the second distal end component 31*d* is retracted from the main plate 20 to open up the approximate midstream of the fourth coin sorting passage 61.

Figure 8:
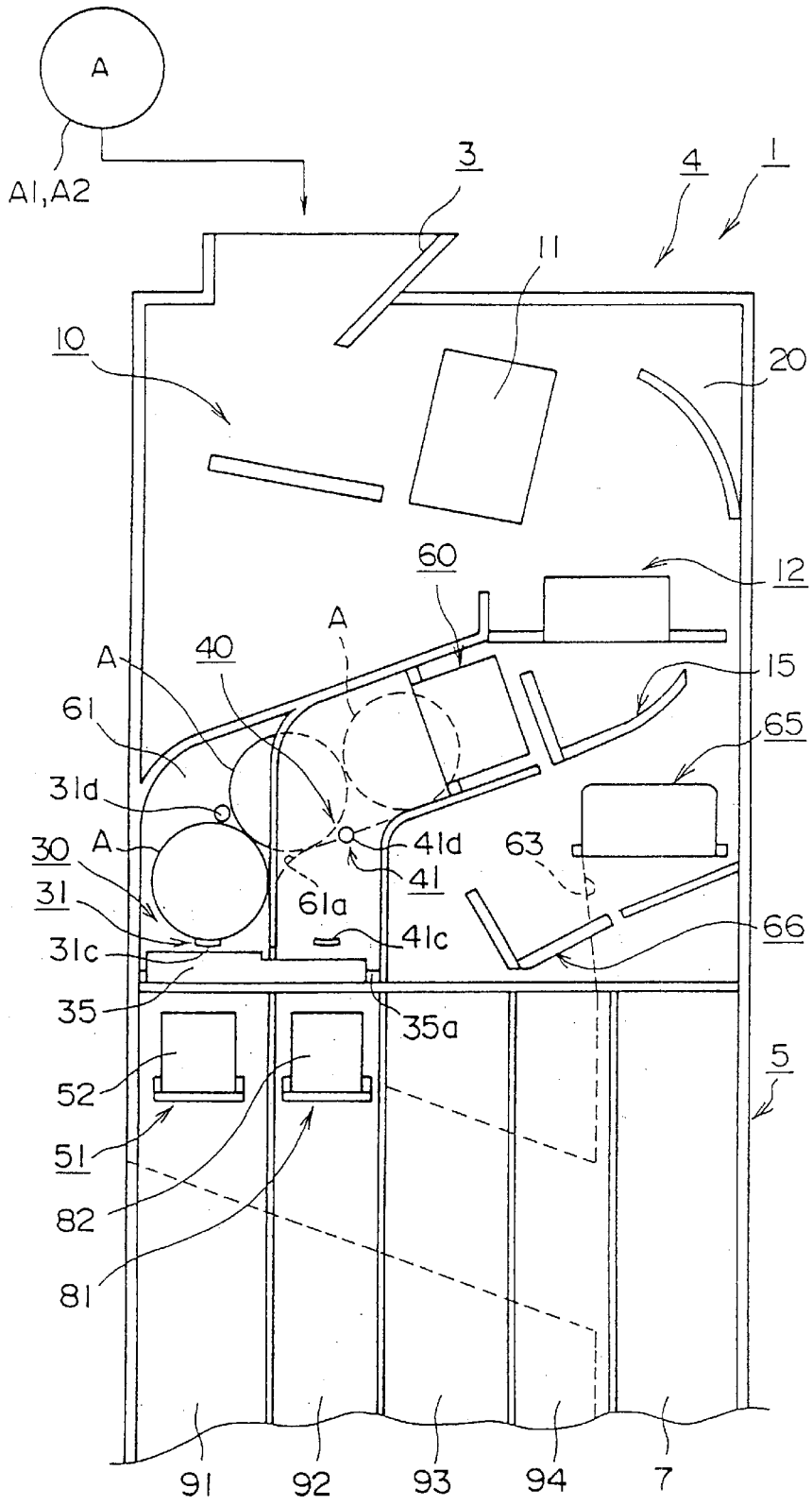
FIG. 8 is a schematic front view of the main components of the coin processing device in FIG. 1, illustrating the processing of a coin A.

When a coin A is guided into the fourth coin sorting passage 61 as shown in FIG. 6 in this initial state, the first distal end component 31*c* of the first coin detaining lever 31 supports the edge of the coin A and detains the coin A as shown in FIGS. 6 and 7, and when a plurality of coins A are guided into the fourth coin sorting passage 61 after this first coin A has been detained, the first distal end component 31*c* temporarily detains the plurality of coins A above the coin A directly supported by the first distal end component 31*c,* as shown in FIG. 8.

Figure 9:
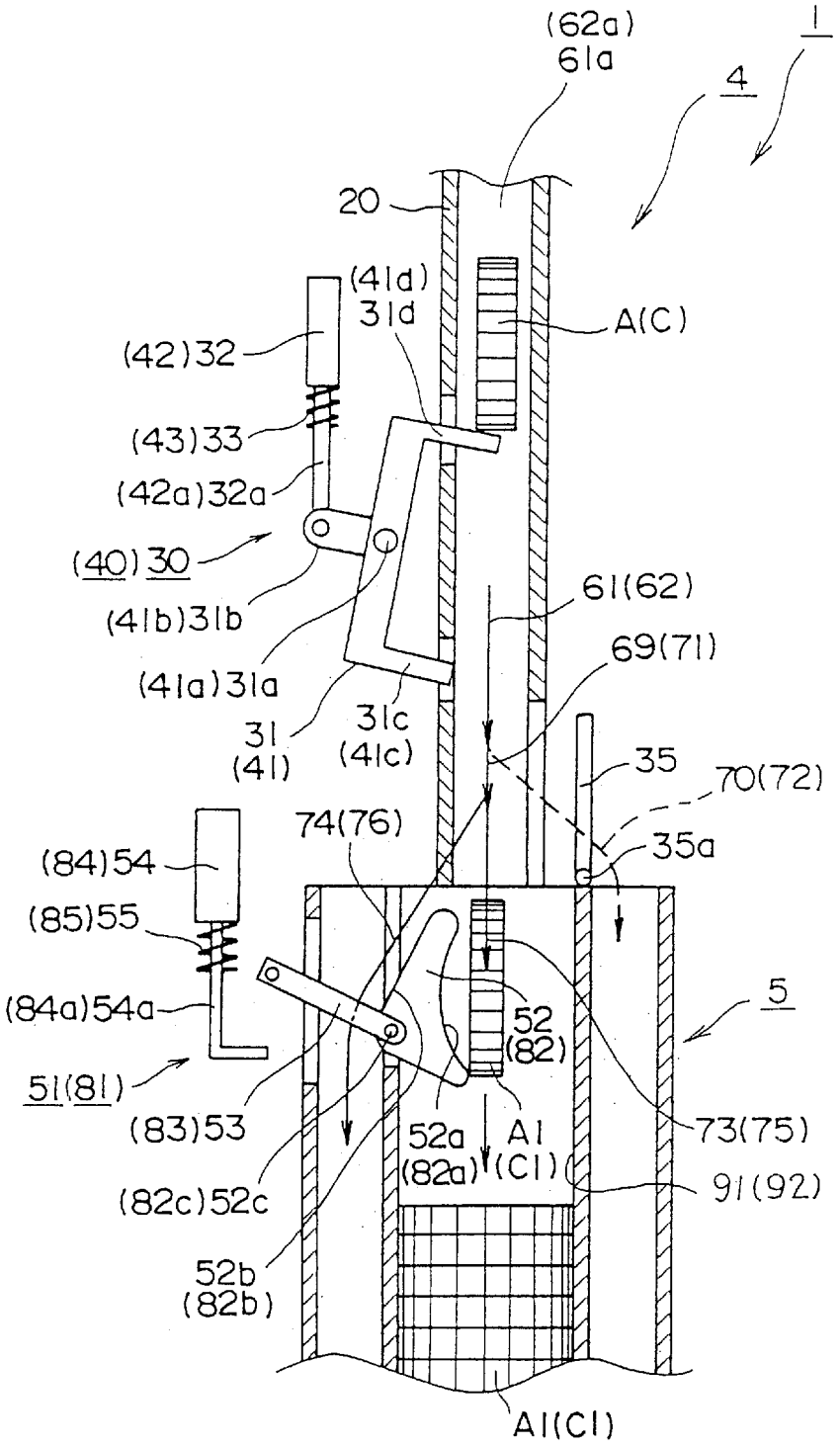
FIG. 9 is a schematic cross section illustrating the operation of the coin detaining means, the first sorting means, and the second sorting means of the coin processing device in FIG. 1.

When the solenoid 32 in FIG. 7 is actuated on the basis of a drive signal from a control unit (not shown) and the rear end component 31*b* of the first coin detaining lever 31 is drawn to the top in the figure, the first coin detaining lever 31 rotates clockwise around the shaft 31*a* against the biasing force of the coil spring 33, the first distal end component 31*c* is retracted from the main plate 20 to open up the downstream end of the fourth coin sorting passage 61, and the second distal end component 31*d* is projected to the surface of the main plate 20 to block off the approximate midstream of the fourth coin sorting passage 61, as shown in FIG. 9.

The first distal end component 31*c* of the first coin detaining lever 31, which has been temporarily detaining the plurality of coins A, releases the plurality of coins A as shown in FIG. 9, and out of the plurality of coins A temporarily detained by the second distal end component 31*d* above the coin A directly supported by the first distal end component 31*c,* the edge of the coin A at the lowermost position is supported by the wall surface 61*a* of the fourth coin sorting passage 61 and by the second distal end component 31*d,* and these plurality of coins A are temporarily halted in approximate midstream of the fourth coin sorting passage 61, the result of which is that only one coin A is guided to the downstream end of the fourth coin sorting passage 61.

FIG. 9 omits part of the depiction of the plurality of coins A (FIG. 8) temporarily halted by the wall surface 61*a* of the fourth coin sorting passage 61 and the second distal end component 31*d.*

When the solenoid 32 is turned off on the basis of a drive signal from the control unit (not shown), the drive shaft 32*a* of the solenoid 32 is slid back downward (in the figure) by the biasing force of the coil spring 33 as shown in FIG. 7, and the first coin detaining lever 31 is rotated counterclockwise around the shaft 31*a,* the result of which is that the first distal end component 31*c* projects from the surface of the main plate 20 and blocks the downstream end of the fourth coin sorting passage 61, and the second distal end component 31*d* retracts from the main plate 20 and returns to the above-mentioned initial state in which the approximate midstream of the fourth coin sorting passage 61 is open.

When this happens, the second distal end component 31*d* of the first coin detaining lever 31 releases the coin A that had been temporarily halted and guides the plurality of coins A that had been temporarily halted downstream from the fourth coin sorting passage 61, while the first distal end component 31*c* supports as shown in FIG. 7 the lowermost coin A out of the plurality of coins A guided downstream from the fourth coin sorting passage 61, and the supported coin A and the coin A upstream from this supported coin A are temporarily detained by the fourth coin sorting passage 61.

Downstream of the fifth coin sorting passage 62 shown in FIG. 2 is provided a second coin detaining means 40 comprising a second coin detaining lever 41 that temporarily detains any coins that are deemed to be coins C and pass through the fifth coin sorting passage 62, regardless of whether these coins C are new-type coins C1 or old-type coins C2.

As shown in FIG. 7, this second coin detaining means 40 comprises the second coin detaining lever 41 for temporarily detaining coins that are deemed to be coins C, both of new-type and old, and that pass through the fifth coin sorting passage 62, and a second detaining component drive means consisting of a solenoid 42 for driving the second coin detaining lever 41 and a coil spring 43 that is fitted around a drive shaft 42*a* of the solenoid 42. The second coin detaining lever 41 is a lever with the same construction as the first coin detaining lever 31. The second coin detaining means 40 also has the same construction as the first coin detaining means 30.

The effect of this second coin detaining means 40 is that the same operation as with the above-mentioned first coin detaining means 30 can be carried out for coins that are deemed to be coins C and are guided into the fifth coin sorting passage 62.

As shown in FIG. 7, at the downstream end of the fourth coin sorting passage 61, which is downstream from the first coin detaining means 30 shown in FIG. 2, are formed an eleventh coin sorting passage 69 formed directly under the fourth coin sorting passage 61, and a first coin return passage 70 that is formed on the front side of the coin storage component 5 and communicates with the coin ejection chute 80 (FIG. 3).

As shown in FIG. 7, the downstream end of the fifth coin sorting passage 62, which is located downstream from the second coin detaining means 40 shown in FIG. 2, are formed a twelfth coin sorting passage 71 formed directly under the fifth coin sorting passage 62, and a second coin return passage 72 that is formed on the front side of the coin storage component 5 and communicates with the coin ejection chute 80 (FIG. 3).

At the downstream end of the fourth coin sorting passage 61 and the downstream end of the fifth coin sorting passage 62 is provided a sorting lever 35 (the first sorting means of the present invention) for sorting the coins A guided to the downstream end of the fourth coin sorting passage 61 into the eleventh coin sorting passage 69 and the first coin return passage 70 communicating with the coin ejection chute 80 (FIG. 3), and for sorting the coins C that have passed through the fifth coin sorting passage 62 into the twelfth coin sorting passage 71 and the second coin return passage 72 communicating with the coin ejection chute 80 (FIG. 3).

Figure 10:
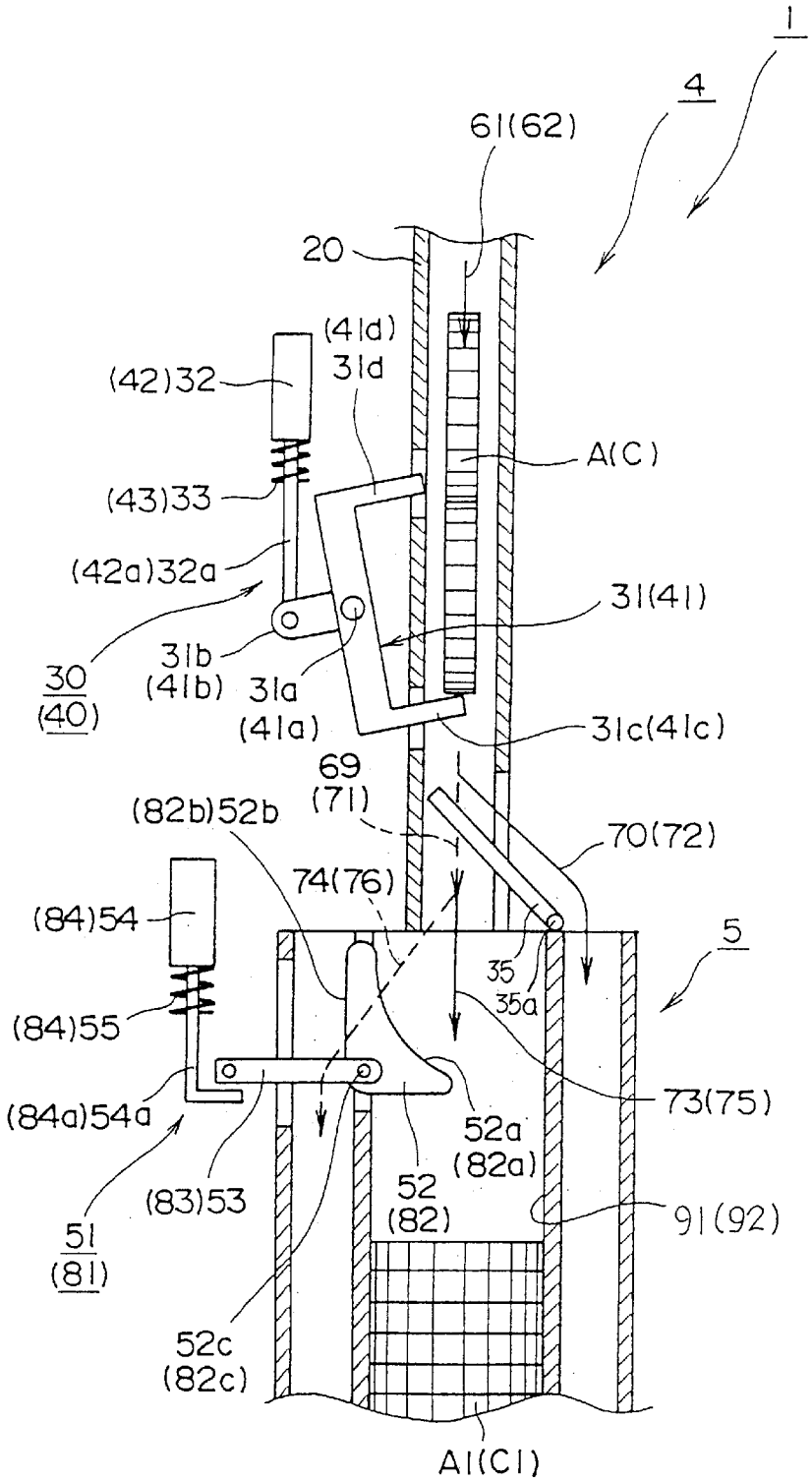
FIG. 10 is a schematic cross section illustrating the operation of the coin detaining means, the first sorting means, and the second sorting means of the coin processing device in FIG. 1.

This sorting lever 35 is designed such that when the coin return lever is operated without a product being purchased while a coin A is temporarily detained, the eleventh coin sorting passage 69 is blocked off while the first coin return passage 70 is opened, and the twelfth coin sorting passage 71 is blocked off while the second coin return passage 72 is opened, as shown in FIG. 10.

Figure 11:
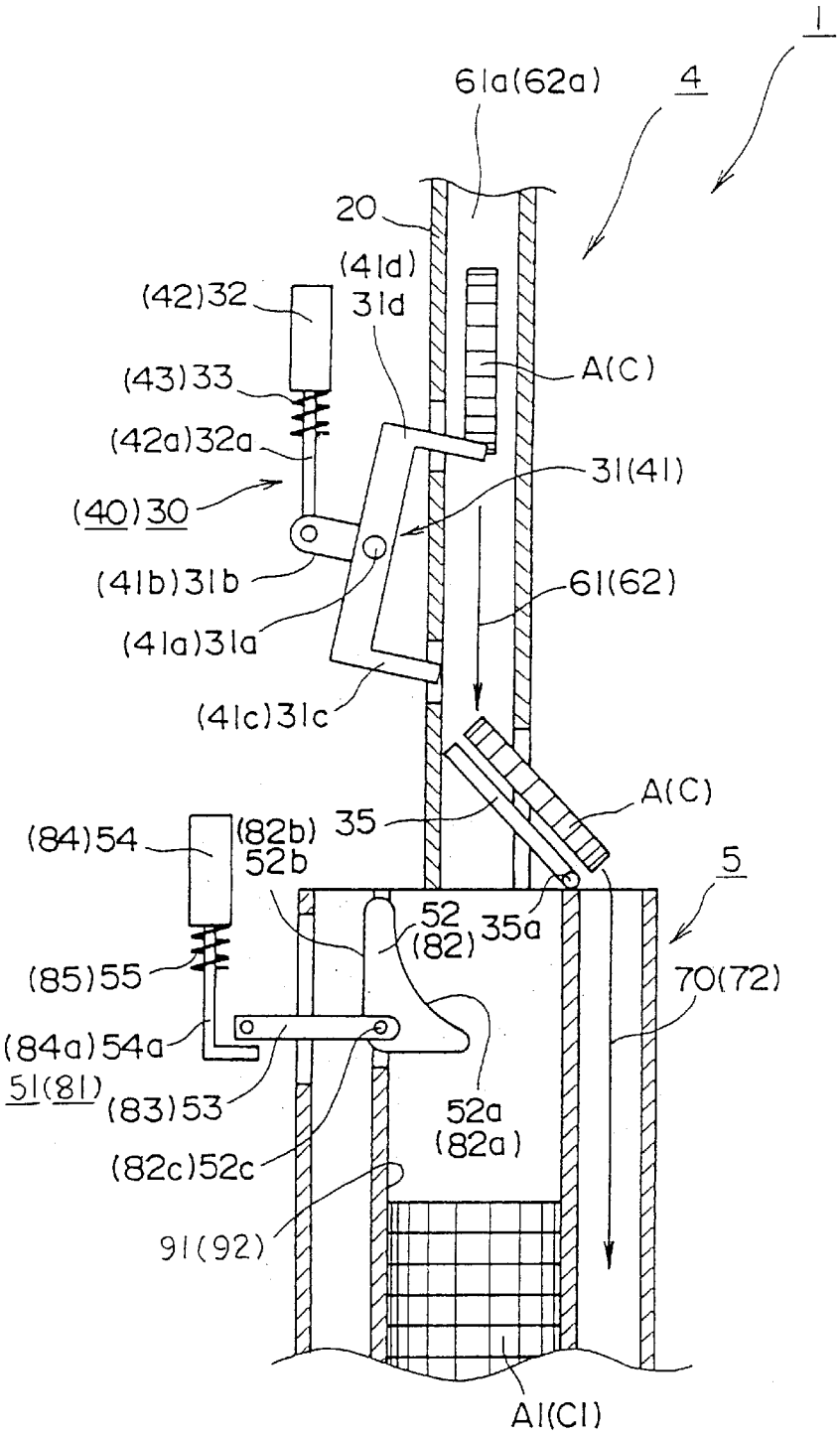
FIG. 11 is a schematic cross section illustrating the operation of the coin detaining means, the first sorting means, and the second sorting means of the coin processing device in FIG. 1.

Accordingly, a coin A that has been guided to the downstream end of the fourth coin sorting passage 61 is guided by the sorting lever 35 into the first coin return passage 70 as shown in FIG. 11 and ejected from the coin return slot (not shown) via the coin ejection chute 80 (FIG. 3) regardless of whether it is a new-type coin A1 or an old-type coin A2, and at the same time, a coin C that has passed downstream from the fifth coin sorting passage 62 is guided by the sorting lever 35 into the second coin return passage 72 and ejected from the coin return slot via the coin ejection chute 80 (FIG. 3) regardless of whether it is a new-type coin C1 or an old-type coin C2.

When a product has been purchased without the coin return lever being operated while a coin A is temporarily detained, the sorting lever 35 opens the eleventh coin sorting passage 69 and blocks off the first coin return passage 70, and opens the twelfth coin sorting passage 71 and blocks off the second coin return passage 72, as shown in FIG. 9.

Accordingly, a coin A that has been guided to the downstream end of the fourth coin sorting passage 61 is guided into the eleventh coin sorting passage 69 regardless of whether this coin A is a new-type coin A1 or an old-type coin A2, and at the same time, a coin C that has passed downstream from the fifth coin sorting passage 62 is guided by the sorting lever 35 into the twelfth coin sorting passage 71 regardless of whether this coin C is a new-type coin C1 or an old-type coin C2.

The sorting lever 35 is also a denomination sorting lever of a type in which the upper end opens and closes in a direction perpendicular to the plane of the figure around a shaft 35*a* at lower end thereof, and is driven open and closed by a solenoid (not shown).

The above-mentioned genuine/counterfeit coin sorting lever 12 and the first to fourth denomination sorting levers (15, 60, 65, and 66) are also driven open and closed by a solenoid (not shown) in a conventional manner.

A thirteenth coin sorting passage 73 formed directly under the eleventh coin sorting passage 69, and a fourteenth coin sorting passage 74 provided on the back face of the coin storage component 5 and communicating with a cashbox (not shown) are formed at the downstream end of the eleventh coin sorting passage 69, and a fifteenth coin sorting passage 75 formed directly under the twelfth coin sorting passage 71, and a sixteenth coin sorting passage 76 provided on the back face of the coin storage component 5 and communicating with a cashbox (not shown) are formed at the downstream end of the twelfth coin sorting passage 71.

Next, the coin storage component 5 of the coin processing device 1 shown in FIG. 2 will be described in detail.

The coin storage component 5 basically stores four types of genuine coin A, B, C, and D, whose diameters are different from one another, but also subjects genuine coins A and C to the following processing depending on whether the coins are of new-type or old-type as determined by the coin sorting component 4.

This coin storage component 5 comprises a coin tube 91 for storing A coins, a coin tube 92 for storing C coins, a coin tube 93 for storing B coins, a coin tube 94 for storing D coins, and the auxiliary tube 7.

Of these, the coin tube 93 is located at the downstream end of the eighth coin sorting passage 67, while the coin tube 94 is located at the downstream end of the ninth coin sorting passage 68.

As shown in FIG. 7, the coin tube 91 is located at the downstream end of the thirteenth coin sorting passage 73, while the coin tube 92 is located at the downstream end of the fifteenth coin sorting passage 75.

Also, as shown in FIG. 7, so-called block-out levers 52 and 82 are provided to the coin tube 91 and the coin tube 92, respectively. These block-out levers 52 and 82 have the same construction, but to use the block-out lever 52 as an example, it usually comprises an edge component 52*a* formed in a gentle curve, and a back component 52*b* that is flat, and is rotatably supported via a shaft 52*c*.

This block-out lever 52 generally rotates clockwise around the shaft 52*c* upon striking the edge 52*a* of a coin that passes the block-out lever 52 under normal circumstances when the coin tube 91 is not filled with A coins, and guides this A coin into the coin tube 91, but when the coin tube 91 is filled with A coins, then the A coins stacked and stored in the coin tube 91 are always engaged under the edge component 52*a*, and the block-out lever 52 is maintained in a position in which it is rotated clockwise around the shaft 52*c*, so the A coin is guided along the back component 52*b* and sorted into the fourteenth coin sorting passage 74 leading to the cashbox (not shown).

With this coin processing device 1, the block-out levers 52 and 82 that are usually used constitute the second sorting means 51 and 81 of the present invention, which sort and guide coins into different passages on the basis of the results from the coin identification sensor 11 as to whether the coins A are of new-type or old-type and the coins C are of new-type or old-type.

As shown in FIG. 7, the second sorting means 51 comprises the above-mentioned block-out lever 52, a support component 53 for rotatably supporting the block-out lever 52 via the shaft 52*c*, a solenoid 54 having a drive shaft 54*a* engageable with the support component 53, and overflow detection means (not shown) for detecting whether the number of coins stored in the coin tube 91 has reached a predetermined number. Of these, the support component 53 comprises a distal end component that supports the shaft 52*c* formed on the block-out lever 52, and a rear end component engageable with the drive shaft 54*a* of the solenoid 54.

The drive shaft 54*a* of the solenoid 54 is formed in an approximate L-shape, and a coil spring 55 is fitted around the drive shaft 54*a*.

In the initial state with this second sorting means 51, the block-out lever 52 is halted in the initial position depicted in FIG. 7 by the biasing force of the coil spring 55, and the distal end 54*b* of the drive shaft 54*a* supports the rear end component of the support component 53 from below.

At this point, when an A coin is guided to the downstream end of the eleventh coin sorting passage 69, this A coin strikes the edge component 52*a* from below and causes the block-out lever 52 to rotate clockwise around the shaft 52*c* as shown in FIG. 9, so the A coin that has been guided to the downstream end of the eleventh coin sorting passage 69 is guided by the block-out lever 52 into the thirteenth coin sorting passage 73, and is then guided to and stacked and stored in the coin tube 91 located at the downstream end of the thirteenth coin sorting passage 73.

Figure 12:
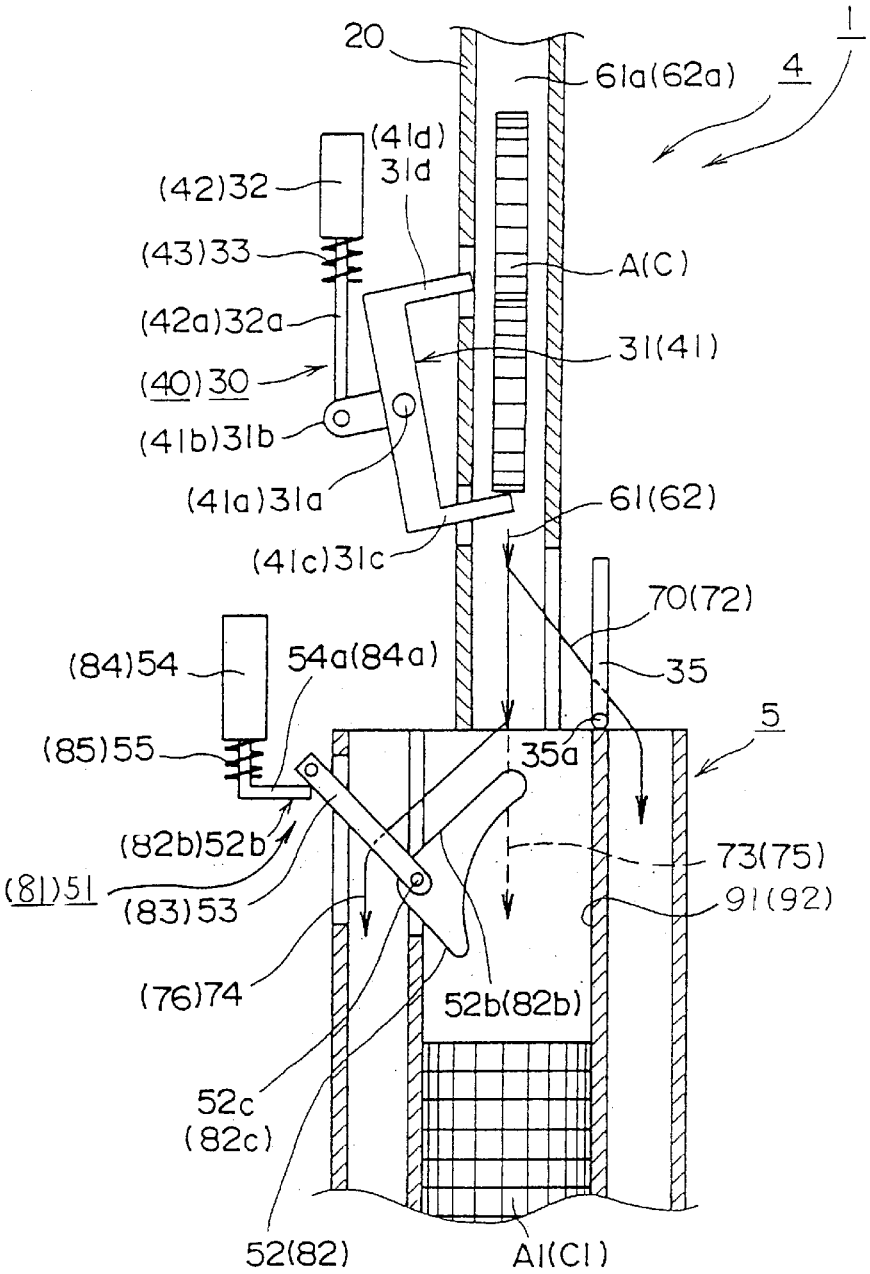
FIG. 12 is a schematic cross section illustrating the operation of the coin detaining means, the first sorting means, and the second sorting means of the coin processing device in FIG. 1.

When the solenoid 54 is actuated on the basis of a drive signal from a control unit (not shown), the drive shaft 54*a* moves upward (in the figure) in the lengthwise direction of the coin tube 91 against the biasing force of the coil spring 55 as shown in FIG. 12, thereby lifting up the rear end component of the support component 53 and causing the block-out lever 52 to rotate clockwise around the shaft 52*c*.

Figure 13:
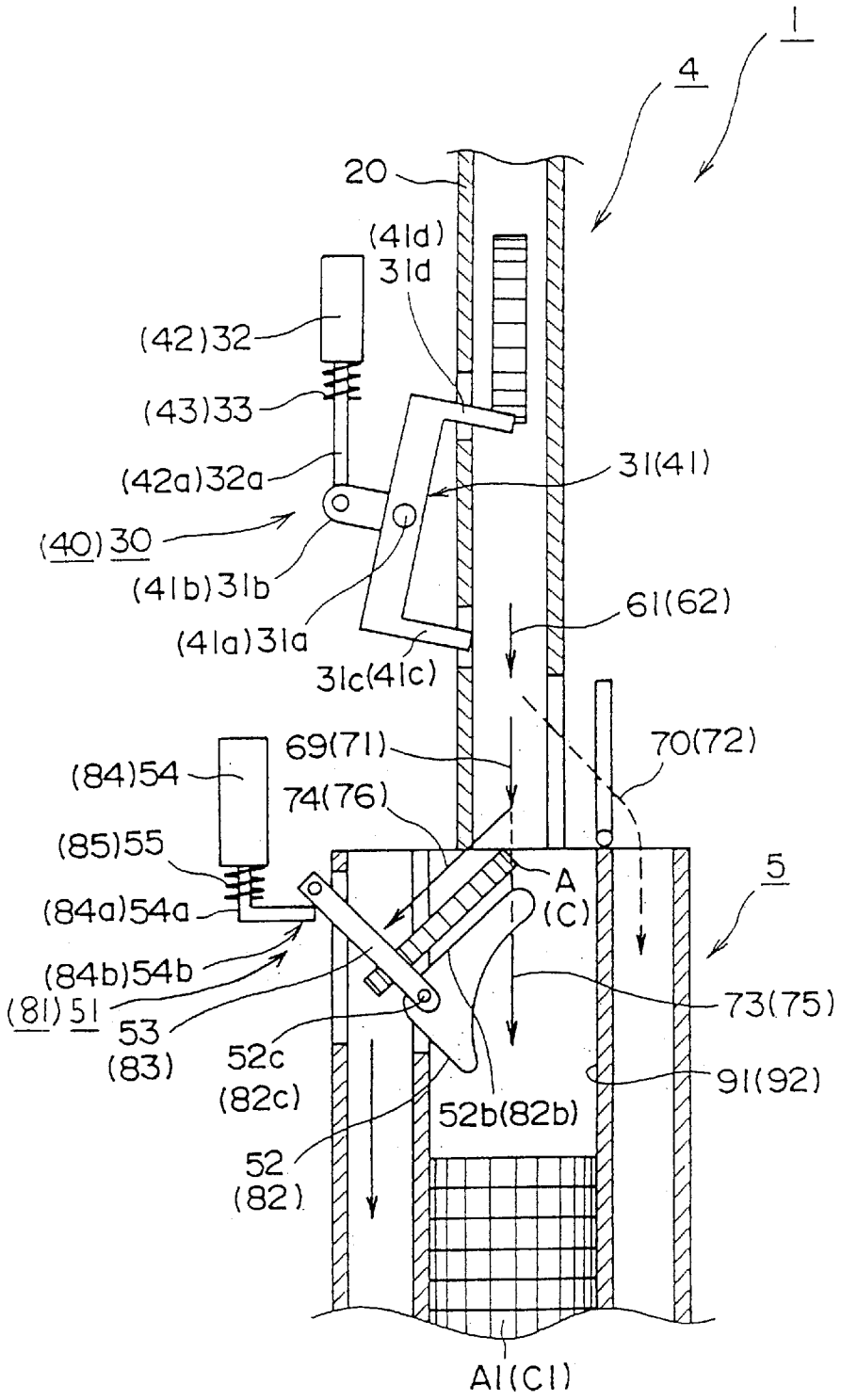
FIG. 13 is a schematic cross section illustrating the operation of the coin detaining means, the first sorting means, and the second sorting means of the coin processing device in FIG. 1.

When the A coin is guided to the downstream end of the eleventh coin sorting passage 69, this A coin is guided along the back component 52*b* of the block-out lever 52 as shown in FIG. 13, and is guided into the fourteenth coin sorting passage 74 leading to a cashbox (not shown).

Under normal circumstances, when it is determined by the overflow detection means of the coin tube 91 that the number of coins stored in the coin tube 91 by the second sorting means 51 (consisting of the block-out lever 52) has yet to reach the predetermined number, A coins that have been guided to the downstream end of the eleventh coin sorting passage 69 are sorted, with new-type coins A1 being guided into the thirteenth coin sorting passage 73 leading to the coin tube 91, and old-type coins A2 being guided into the fourteenth coin sorting passage 74 leading to the cashbox (not shown). When it is determined by the overflow detection means that the number of coins stored in the coin tube 91 has reached the predetermined number, then A coins that have reached the downstream end of the eleventh coin sorting passage 69 are sorted by the second sorting means 51 into the fourteenth coin sorting passage 74 leading to the cashbox (not shown) regardless of whether the coins are new-type coins A1 or old-type coins A2.

The second sorting means 81 consisting of the block-out lever 82 located in the coin tube 92 has the same construction as the second sorting means 51 of the coin tube 91 discussed above. Under normal circumstances, when it is determined by the overflow detection means of the coin tube 92 that the number of coins stored in the coin tube 92 by the second sorting means 81 has yet to reach the predetermined number, C coins that have reached the downstream end of the twelfth coin sorting passage 71 are sorted, with new-type coins C1 being guided into the fifteenth coin sorting passage 75 leading to the coin tube 92, and old-type coins C2 being guided into the sixteenth coin sorting passage 76 leading to the cashbox (not shown). Meanwhile, when it is determined by the overflow detection means of the coin tube 92 that the number of coins stored in the coin tube 92 has reached the predetermined number, C coins that have reached the downstream end of the twelfth coin sorting passage 71 are sorted into the sixteenth coin sorting passage 76 leading to the cashbox (not shown) regardless of whether the C coins are new-type coins C1 or old-type coins C2.

The operation of the coin processing device 1 discussed above will now be described, and the structure will also be described in detail.

As shown in FIG. 3, when a coin G inserted in the coin insertion slot 3 is determined to be counterfeit on the basis of the detection signal of the coin identification sensor 11, the genuine/counterfeit coin sorting lever 12 opens up the counterfeit coin ejection passage 13 and at the same time blocks off the upstream end of the first coin sorting passage 14 on the basis of this identification signal. The counterfeit coin G rolling through the coin identification passage 10 is thereupon guided by the genuine/counterfeit coin sorting lever 12 into the counterfeit coin ejection passage 13, and is returned to the coin return slot (not shown) via the coin ejection chute 80 (FIG. 3) communicating with this counterfeit coin ejection passage 13.

Next, as shown in FIG. 6, when a coin is inserted in the coin insertion slot 3 and it is determined on the basis of the detection signal of the coin identification sensor 11 that this coin is genuine and is an A coin, a control unit (not shown) actuates the genuine/counterfeit coin sorting lever 12 on the basis of this identification signal, blocking off the upstream end of the counterfeit coin ejection passage 13 in FIG. 2 and opening up the upstream end of the first coin sorting passage 14. At the same time, the upstream end of the second coin sorting passage 16 is opened up and the upstream end of the third coin sorting passage 17 is blocked off by the first denomination sorting lever 15. Furthermore, the fourth coin sorting passage 61 is opened up and the fifth coin sorting passage 62 is blocked off by the second denomination sorting lever 60.

When the control unit (not shown) determines that an inserted coin is a genuine coin A on the basis of the detection signal from the coin identification sensor 11, the solenoid 32 is actuated as shown in FIG. 7, the result of which is that the biasing force of the coil spring 33 causes the first distal end component 31*c* of the first coin detaining lever 31 to project to the surface of the main plate 20 and block off the downstream end of the fourth coin sorting passage 61, and causes the second distal end component 31*d* to retract from the main plate 20 and open up the approximate midstream of the fourth coin sorting passage 61.

Accordingly, after rolling through the coin identification passage 10, a coin A inserted into the coin insertion slot 3 is guided by the genuine/counterfeit coin sorting lever 12 into the first coin sorting passage 14, after which this coin A is guided by the first denomination sorting lever 15 into the second coin sorting passage 16, after which it is guided by the second denomination sorting lever 60 into the fourth coin sorting passage 61, and then after this it is temporarily detained downstream from the fourth coin sorting passage 61 by the first distal end component 31*c* of the first coin detaining lever 31. If, after this temporarily detention, coins inserted through the coin insertion slot 3 are judged to be coins A by the coin identification sensor 11 and guided into the fourth coin sorting passage 61, then these coins A are temporarily detained above the coin A directly supported by the first distal end component 31*c,* as shown in FIG. 8.

This fourth coin sorting passage 61 can temporarily detain a maximum of three coins, including the coin directly supported by the first distal end component 31*c,* as shown in FIG. 8.

If the coin return lever is operated without a product being purchased from the vending machine in which the coin processing device 1 is installed while this coin A is being temporarily detained, then the control unit (not shown) actuates the solenoid 32 of the first coin detaining means 30 as shown in FIG. 9 on the basis of the operation signal from this coin return lever, which causes the first distal end component 31*c* of the first coin detaining lever 31 to be retracted from the main plate 20 so as to open up the downstream end of the fourth coin sorting passage 61, and causes the second distal end component 31*d* to project to the surface of the main plate 20 so as to block off the approximate midstream of the fourth coin sorting passage 61. Consequently, as shown in FIG. 9, the plurality of coins A temporarily detained in the fourth coin sorting passage 61 are released by the first distal end component 31*c* and guided to the downstream end of the fourth coin sorting passage 61, and the plurality of coins A located upstream from the coin A directly supported by the first distal end component 31*c* are halted in their progress by the wall surface 61*a* of the fourth coin sorting passage 61 and a second distal end component 30*b,* and as a result only the one coin A directly supported and temporarily detained by the first distal end component 31*c* is guided to the downstream end of the fourth coin sorting passage 61.

Also, if the coin return lever is operated without a product being purchased from the vending machine in which the coin processing device 1 is installed while this coin A is being temporarily detained, then on the basis of the operation signal from this coin return lever, the control unit (not shown) causes the sorting lever 35 to open the first coin return passage 70 communicating with the coin ejection chute 80 (FIG. 3) and block off the eleventh denomination sorting lever 69, as shown in FIG. 10. Consequently, as shown in FIG. 11, the coin A guided to the downstream end of the fourth coin sorting passage 61 is sorted by the sorting lever 35 into the first coin return passage 70 communicating with the coin ejection chute 80 (FIG. 3), and this coin A is returned through a coin return slot (not shown) via the coin ejection chute 80.

Therefore, with this coin processing device 1, when the coin return lever is operated without a product purchase in order to return a coin A, the inserted coin that has actually been inserted, that is, the temporarily detained coin A, is itself dispensed to the coin return slot, so even if a counterfeit coin manufactured skillfully enough to pass as genuine in the coin sorting component 4 has been inserted, since the inserted (counterfeit) coin A itself is returned to the coin return slot, coin switching is effectively thwarted.

Furthermore, with this coin processing device 1, the coin A is temporarily detained and the above-mentioned actual coin return is carried out regardless of whether the coin A is a new-type coin A1 or an old-type coin A2.

On the other hand, when a product is purchased during the temporary detention of the coin A, the control unit (not shown) actuates the solenoid 32 of the first coin detaining means 30 on the basis of a product purchase signal as shown in FIG. 9, as a result of which, just as above, only one coin A temporarily detained downstream from the fourth coin sorting passage 61 is guided to the downstream end of the fourth coin sorting passage 61.

The control unit (not shown) operates the sorting lever 35 on the basis of the product purchase signal, blocks off the first coin return passage 70, and opens the eleventh coin sorting passage 69, as shown in FIG. 9. Accordingly, the coin A that has been guided to the downstream end of the fourth coin sorting passage 61 is guided by the sorting lever 35 into the eleventh coin sorting passage 69.

The control unit (not shown) also stores information about whether the inserted coins A are of old-type or new-type, which is determined as the inserted coins pass the coin identification sensor 11, in the order of the coins temporarily detained by the first distal end component 31*c* of the first coin detaining lever 31, and switches the solenoid 54 of the second sorting means 51 on and off on the basis of this coin new/old information.

When the control unit determines on the basis of the detection signal from the coin identification sensor 11 that the coin A guided into the eleventh coin sorting passage 69 is a new-type coin A1, it turns off the solenoid 54 of the second sorting means 51 as shown in FIG. 7, as a result of which the thirteenth coin sorting passage 73 is opened and the fourteenth coin sorting passage 74 is blocked off.

Figure 14:
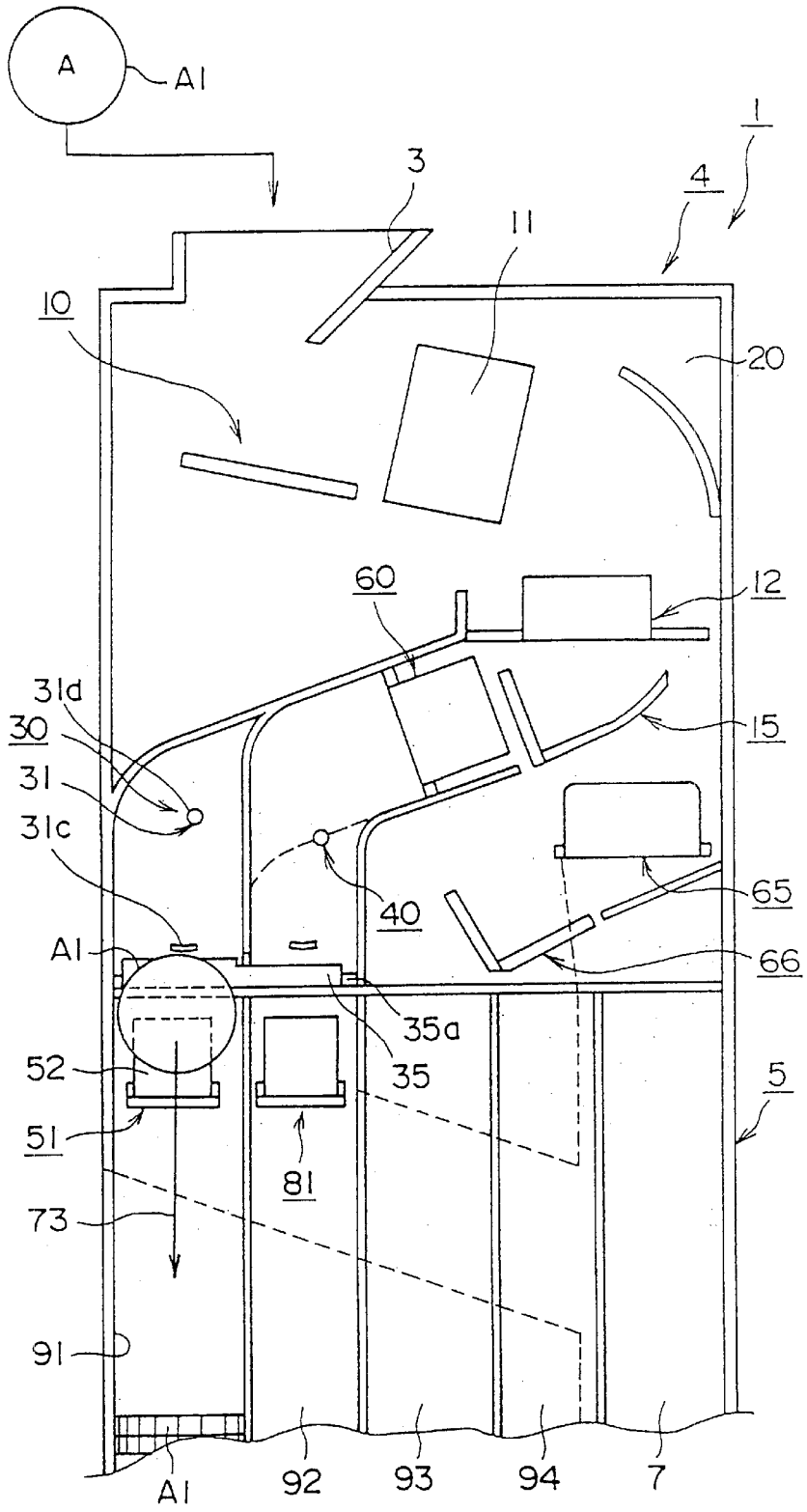
FIG. 14 is a schematic front view of the main components of the coin processing device in FIG. 1, illustrating the processing of a coin A.

The new-type coin A1 guided to the downstream end of the eleventh coin sorting passage 69 is guided into the thirteenth coin sorting passage 73 as shown in FIG. 9, and is stacked and stored in the coin tube 91 as shown in FIG. 14.

When the control unit (not shown) determines on the basis of the detection signal from the coin identification sensor 11 that the coin A guided to the downstream end of the eleventh coin sorting passage 69 is an old-type coin A2, it actuates the solenoid 54 of the second sorting means 51 as shown in FIG. 12, as a result of which the fourteenth coin sorting passage 74 is opened and the thirteenth coin sorting passage 73 is blocked off.

Figure 15:
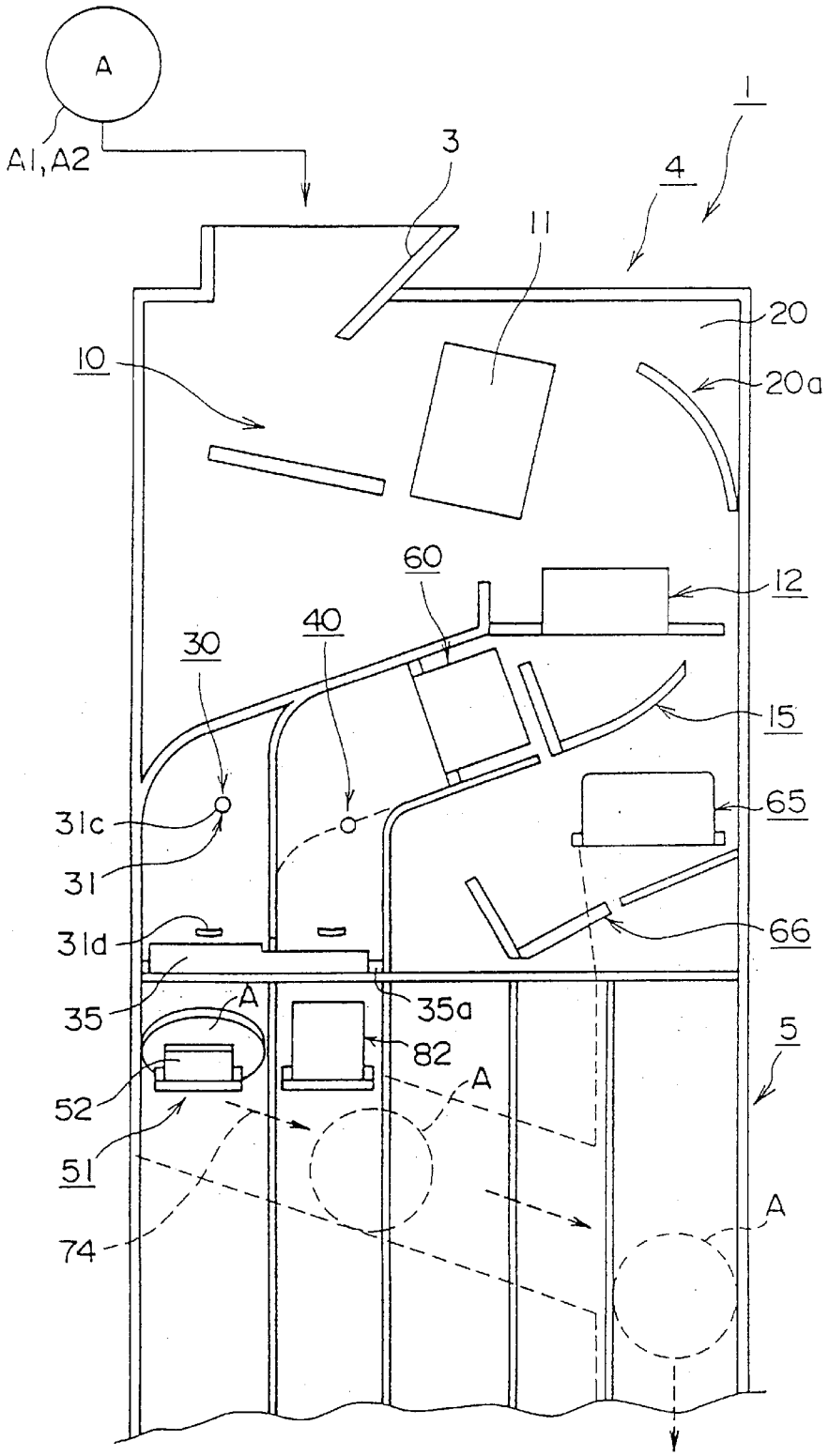
FIG. 15 is a schematic front view of the main components of the coin processing device in FIG. 1, illustrating the processing of a coin A.

Consequently, as shown in FIGS. 13 and 15, the old-type coin A2 guided to the downstream end of the eleventh coin sorting passage 69 is guided along the back component 52*b* of the block-out lever 52 into the fourteenth coin sorting passage 74, after which it is stored in a cashbox communicating with the fourteenth coin sorting passage 74.

If the plurality of coins A detained as shown in FIG. 8 by the first distal end component 31*c* of the first coin detaining lever 31 comprise, for instance, a new-type coin A1, an old-type coin A2, and a new-type coin A1, in that order, then the control unit (not shown) stores the coin new/old information in the order in which the coins are detained (new, old, new) on the basis of the detection signal of the coin identification sensor 11, and the solenoid 54 is switched off, on, and off for the detained new-type coin A1, old-type coin A2, and new-type coin A1, respectively, on the basis of this stored information.

With this coin processing device 1, a maximum of three coins A can be temporarily detained in the fourth coin sorting passage 61 as mentioned above, and if another coin A is inserted through the coin insertion slot 3 after three coins A have already been temporarily detained, then the same processing is carried out as when the above-mentioned counterfeit coin G is ejected. Specifically, the control unit (not shown) causes this inserted coin A to be guided by the genuine/counterfeit coin sorting lever 12 into the counterfeit coin ejection passage 13 and returned from the coin return slot (not shown).

Figure 16:
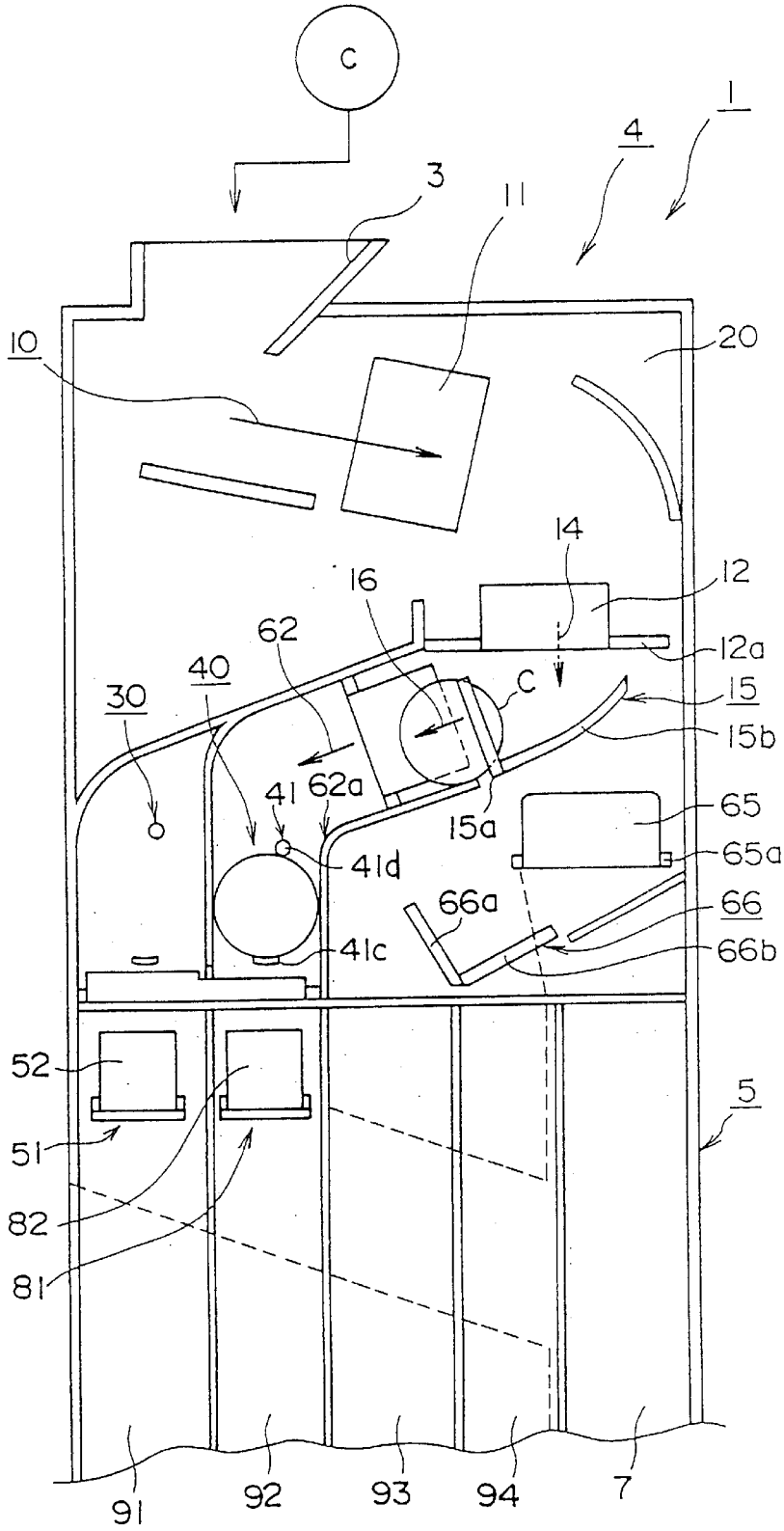
FIG. 16 is a schematic front view of the main components of the coin processing device in FIG. 1, illustrating the processing of a coin C.

Next, as shown in FIG. 16, if a coin is inserted through the coin insertion slot 3 and this coin is determined on the basis of the detection signal from the coin identification sensor 11 to be a coin C, the control unit (not shown) actuates the genuine/counterfeit coin sorting lever 12 on the basis of this identification signal, blocks off the upstream end of the counterfeit coin ejection passage 13, and opens up the upstream end of the first coin sorting passage 14. At the same time, the first denomination sorting lever 15 is actuated, the upstream end of the second coin sorting passage 16 is opened, and the upstream end of the third coin sorting passage 17 is blocked off Then the second denomination sorting lever 60 is actuated to block off the fourth coin sorting passage 61 and open the fifth coin sorting passage 62.

If the control unit (not shown) determines on the basis of the detection signal from the coin identification sensor 11 that the coin is a C coin, it turns off the solenoid 42 of the second coin detaining means 40 on the basis of this detection signal as shown in FIG. 7, projecting the first distal end component 41*c* of the second coin detaining lever 41 to the surface of the main plate 20 and opening the downstream end of the fifth coin sorting passage 62, and retracting the second distal end component 41*d* from the main plate 20 and opening the approximate midstream of the fifth coin sorting passage 62.

Accordingly, after the coin C inserted in the coin insertion slot 3 has rolled through the coin identification passage 10, as shown in FIG. 16, it is guided by the genuine/counterfeit coin sorting lever 12 into the first coin sorting passage 14, then guided by the first denomination sorting lever 15 into the second coin sorting passage 16, after which it is guided by the second denomination sorting lever 60 into the fifth coin sorting passage 62, and, as shown in FIGS. 7 and 16, is temporarily detained downstream from the fourth coin sorting passage 61 by the first distal end component 41*c* of the second coin detaining lever 41. If coins inserted through the coin insertion slot 3 after this temporary detention are judged by the coin identification sensor 11 to be C coins and are guided into the fifth coin sorting passage 62, these coins C are temporarily detained above the coin C directly supported by the first distal end component 41*c*, as shown in FIG. 17.

Figure 17:
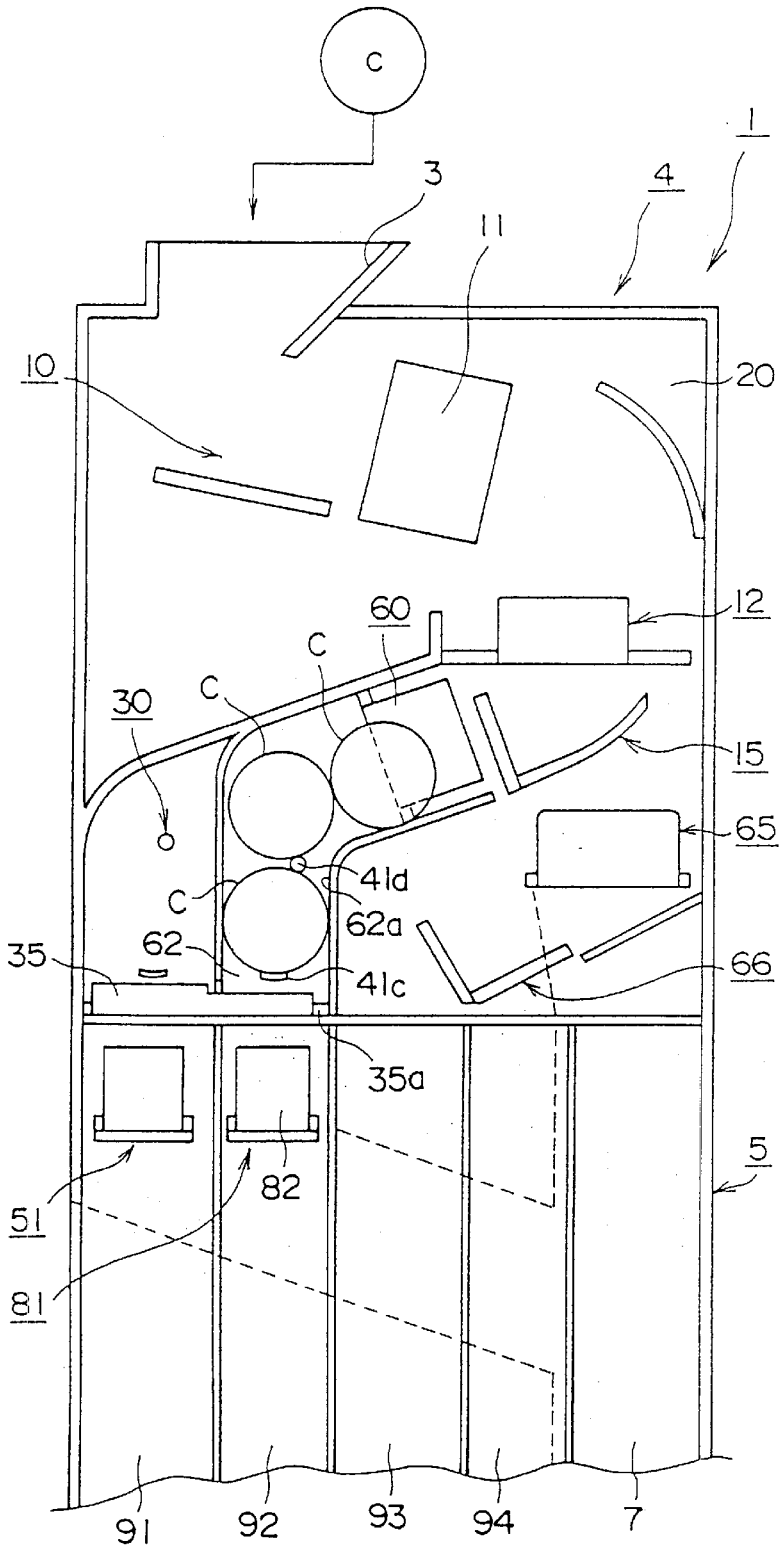
FIG. 17 is a schematic front view of the main components of the coin processing device in FIG. 1, illustrating the processing of a coin C.

This fifth coin sorting passage 62 can temporarily detain a maximum of three coins C, including the coin directly supported by the first distal end component 41*c* of the second coin detaining lever 41, as shown in FIG. 17.

If the coin return lever is operated without a product being purchased from the vending machine in which the coin processing device 1 is installed while this coin C is being temporarily detained, then the control unit (not shown) actuates the solenoid 42 of the second coin detaining means 40 as shown in FIG. 9 on the basis of the operation signal from this coin return lever, which causes the first distal end component 41*c* of the second coin detaining lever 41 to be retracted from the main plate 20 so as to open up the downstream end of the fifth coin sorting passage 62, and causes the second distal end component 41*d* to project to the surface of the main plate 20 so as to block off the approximate midstream of the fifth coin sorting passage 62. Consequently, as shown in FIG. 9, the plurality of coins C temporarily detained in the fifth coin sorting passage 62 are released by the first distal end component 41*c* and guided to the downstream end of the fifth coin sorting passage 62, and the plurality of coins C located upstream from the coin C directly supported by the first distal end component 41*c* are halted in their progress by the second distal end component 41*d*, and as a result only the one coin C directly supported and temporarily detained by the wall surface 62*a* of the fifth coin sorting passage 62 and the first distal end component 41*c* is guided to the downstream end of the fifth coin sorting passage 62.

Also, if the coin return lever is operated without a product being purchased from the vending machine in which the coin processing device 1 is installed while this coin C is being temporarily detained, then on the basis of the operation signal from this coin return lever, the control unit (not shown) causes the sorting lever 35 to open the second coin return passage 72 communicating with the coin ejection chute 80 (FIG. 3) and block off the twelfth coin sorting passage 71. Consequently, the coin C guided to the downstream end of the fifth coin sorting passage 62 is sorted by the sorting lever 35 into the second coin return passage 72 communicating with the coin ejection chute 80 (FIG. 3), and this coin C is returned through a coin return slot (not shown) via the coin ejection chute 80.

Therefore, with this coin processing device 1, when the coin return lever is operated without a product purchase in order to return a coin C, the inserted coin that has actually been inserted, that is, the temporarily detained coin C, is itself dispensed to the coin return slot, so even if a counterfeit coin manufactured skillfully enough to pass as genuine in the coin sorting component 4 has been inserted, since the inserted (counterfeit) coin C itself is returned to the coin return slot, coin switching is effectively thwarted.

Furthermore, with this coin processing device 1, the coin C is subjected to the above-mentioned actual coin return regardless of whether the coin C is a new-type coin C1 or an old-type coin C2.

On the other hand, when a product is purchased during the temporary detention of the coin C, the control unit (not shown) actuates the solenoid 42 of the second coin detaining means 40 on the basis of a product purchase signal as shown in FIG. 9, as a result of which, just as above, only one coin C temporarily detained in the fifth coin sorting passage 62 is guided to the downstream end of the fifth coin sorting passage 62.

The control unit (not shown) operates the sorting lever 35 on the basis of the product purchase signal, blocks off the second coin return passage 72, and opens the twelfth coin sorting passage 71, as shown in FIG. 9. Accordingly, the coin C that has been guided to the downstream end of the fifth coin sorting passage 62 is guided by the sorting lever 35 into the twelfth coin sorting passage 71.

The control unit (not shown) also stores information about whether the inserted coins C are of old-type or new-type, which is determined as the inserted coins pass the coin identification sensor 11, in the order of the coins temporarily detained by the first distal end component 41*c* of the second coin detaining lever 41, and switches the solenoid 84 of the second sorting means 81 on and off on the basis of this coin new/old information.

When the control unit determines on the basis of the detection signal from the coin identification sensor 11 that the coin C guided to the downstream end of the twelfth coin sorting passage 71 is a new-type coin C1, it turns off the solenoid 84 of the second sorting means 81 as shown in FIG. 7, as a result of which the fifteenth coin sorting passage 75 is opened and the sixteenth coin sorting passage 76 is blocked off.

Figure 18:
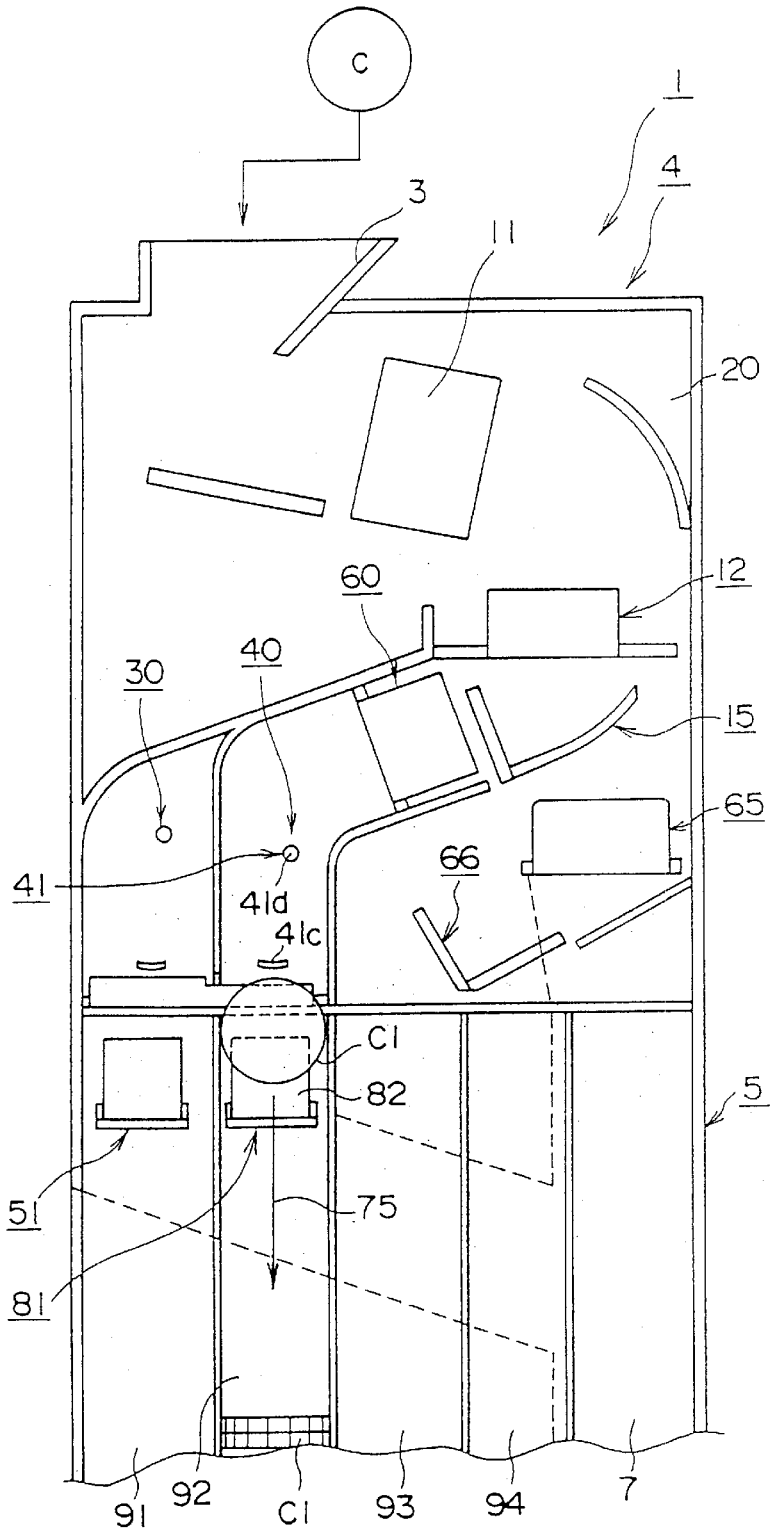
FIG. 18 is a schematic front view of the main components of the coin processing device in FIG. 1, illustrating the processing of a coin C.

Consequently, the new-type coin C1 guided to the downstream end of the twelfth coin sorting passage 71 is guided into the fifteenth coin sorting passage 75 and stacked and stored in the coin tube 92 as shown in FIGS. 9 and 18.

On the other hand, when the control unit (not shown) determines on the basis of the detection signal from the coin identification sensor 11 that the coin C guided to the downstream end of the twelfth coin sorting passage 71 is an old-type coin C2, it actuates the solenoid 84 of the second sorting means 81 as shown in FIG. 12, as a result of which the sixteenth coin sorting passage 76 is opened and the fifteenth coin sorting passage 75 is blocked off.

Figure 19:
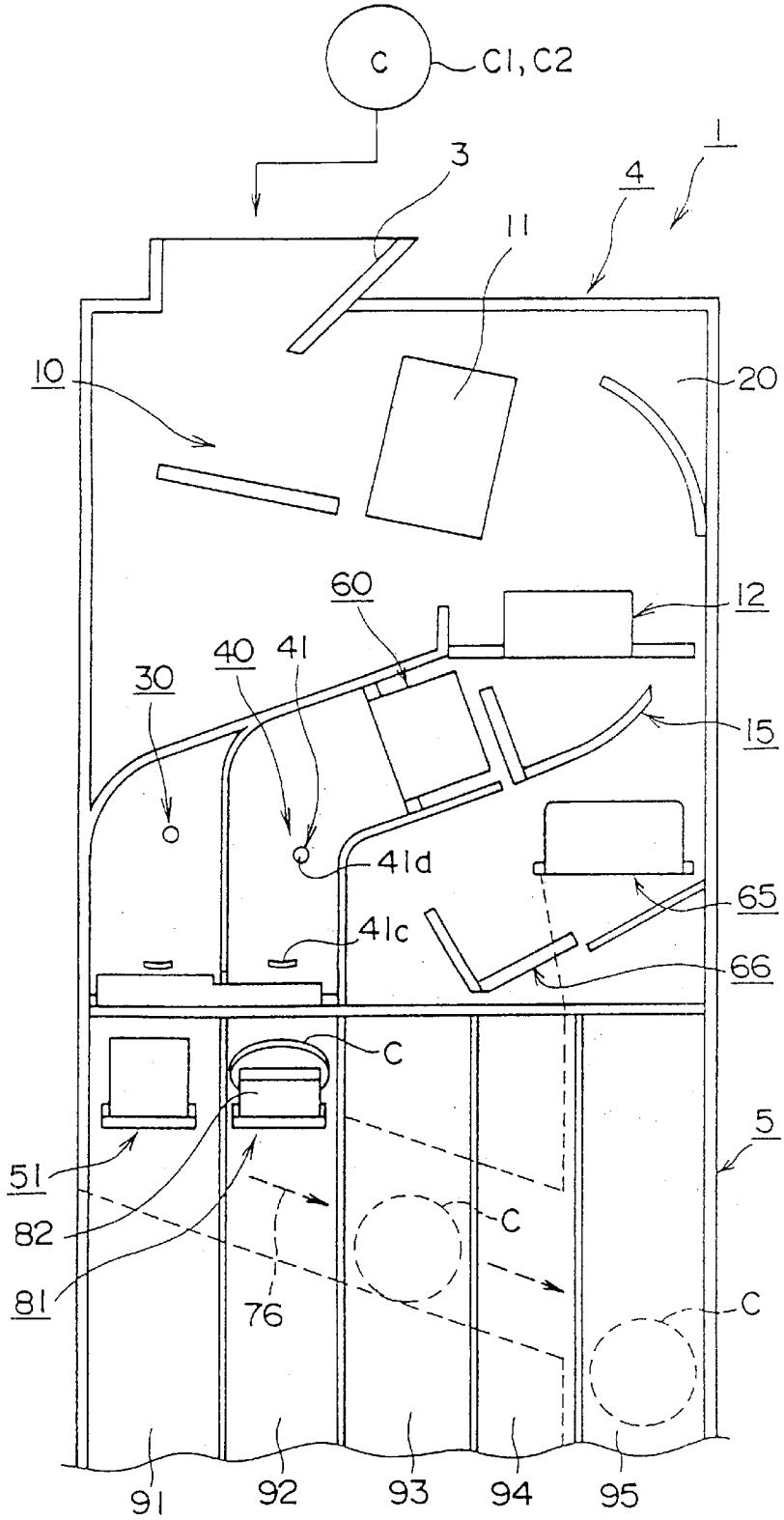
FIG. 19 is a schematic front view of the main components of the coin processing device in FIG. 1, illustrating the processing of a coin C.

Consequently, as shown in FIG. 13, the old-type coin C2 guided to the downstream end of the twelfth coin sorting passage 71 is guided along the back component 82*b* of the block-out lever 82 into the sixteenth coin sorting passage 76, after which it is stored in a cashbox communicating with the sixteenth coin sorting passage 76, as shown in FIG. 19.

If the plurality of coins C detained as shown in FIG. 17 by the first distal end component 41*c* of the second coin detaining lever 41 comprise, for instance, a new-type coin C1, an old-type coin C2, and a new-type coin C1, in that order, then the control unit (not shown) stores the coin new/old information in the order in which the coins are detained (new, old, new) on the basis of the detection signal of the coin identification sensor 11, and the solenoid 84 is switched off, on, and off for the detained new-type coin C1, old-type coin C2, and new-type coin C1, respectively, on the basis of this stored information.

With this coin processing device 1, a maximum of three coins C can be temporarily detained in the fifth coin sorting passage 62 as mentioned above, and if another coin C is inserted through the coin insertion slot 3 after three coins C have already been temporarily detained, then the same processing is carried out as when the above-mentioned counterfeit coin G is ejected. Specifically, the control unit (not shown) causes this inserted coin C to be guided by the genuine/counterfeit coin sorting lever 12 into the counterfeit coin ejection passage 13 and returned from the coin return slot (not shown).

Figure 20:
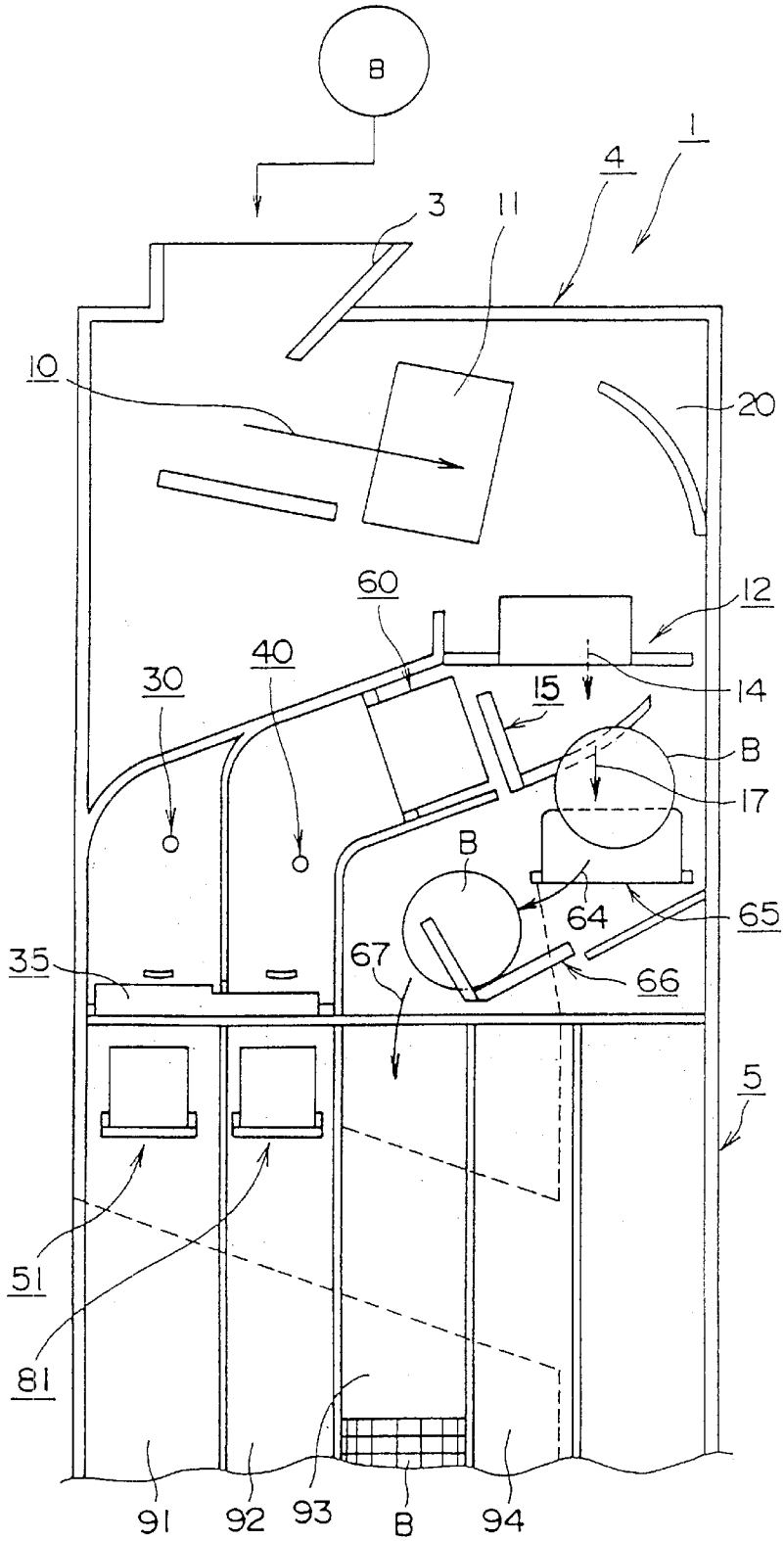
FIG. 20 is a schematic front view of the main components of the coin processing device in FIG. 1, illustrating the processing of a coin B.

Next, as shown in FIG. 20, if a coin is inserted through the coin insertion slot 3 and this coin is determined on the basis of the detection signal from the coin identification sensor 11 to be a coin B, the control unit (not shown) actuates the genuine/counterfeit coin sorting lever 12 on the basis of this identification signal, blocks off the upstream end of the counterfeit coin ejection passage 13 in FIG. 2, and opens up the upstream end of the first coin sorting passage 14. At the same time, the first denomination sorting lever 15 is actuated, the upstream end of the second coin sorting passage 16 is opened, and the upstream end of the third coin sorting passage 17 is blocked off.

At the same time, the control unit (not shown) actuates the third denomination sorting lever 65, blocks the upstream end of the sixth coin sorting passage 63, and opens the upstream end of the seventh coin sorting passage 64, and at the same time actuates the fourth denomination sorting lever 66, opens the eighth coin sorting passage 67, and blocks off the ninth coin sorting passage 68.

Accordingly, the coin B rolling through the coin identification passage 10 is guided by the genuine/counterfeit coin sorting lever 12 into the first coin sorting passage 14 as shown in FIG. 20, then guided by the first denomination sorting lever 15 into the third coin sorting passage 17 situated below, after which it is guided by the third denomination sorting lever 65 into the seventh coin sorting passage 64, then guided by the fourth denomination sorting lever 66 into the eighth coin sorting passage 67, and finally drops from the bottom of the eighth coin sorting passage 67 and is stacked and stored in the coin tube 93.

Figure 21:
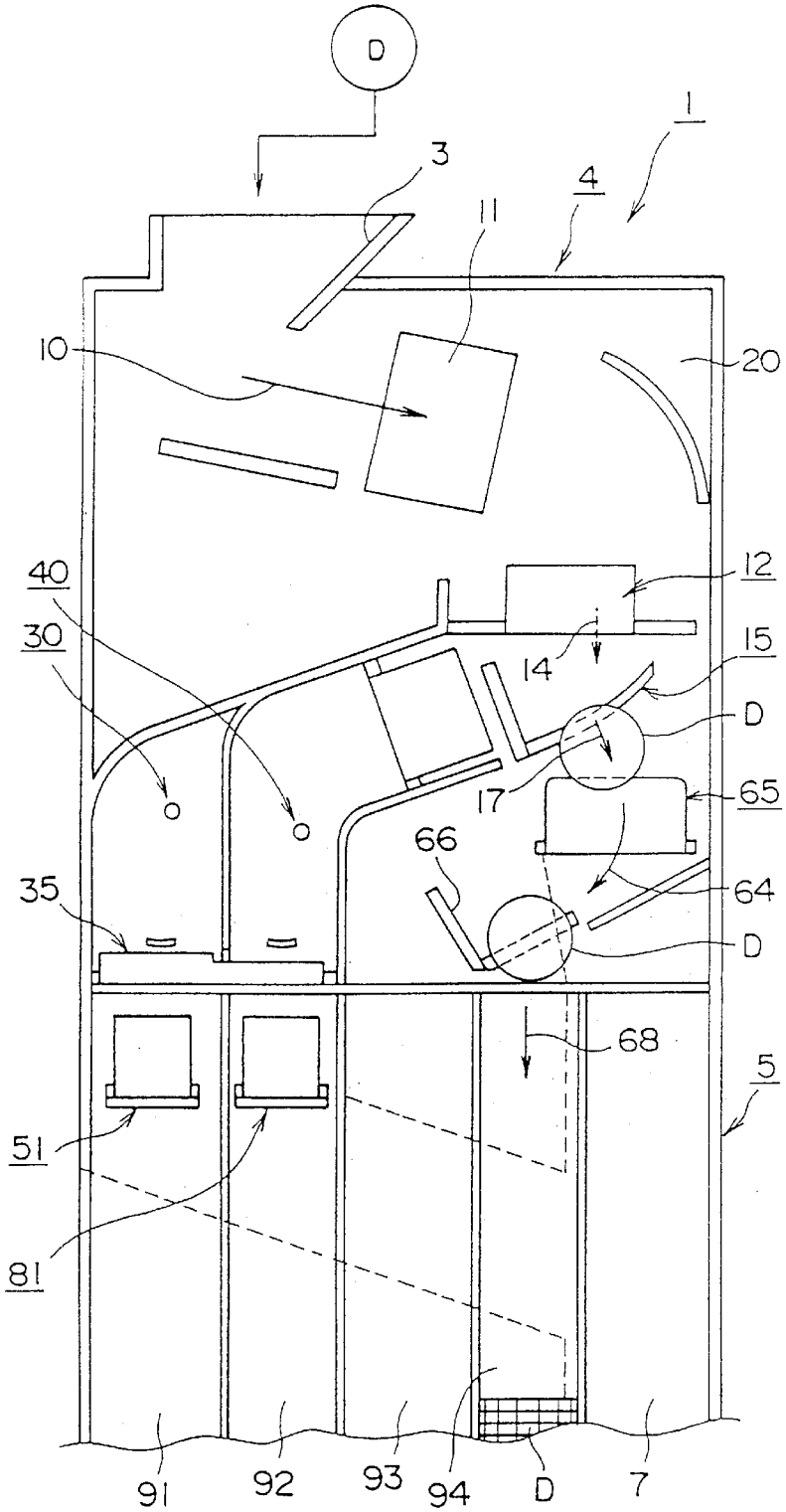
FIG. 21 is a schematic front view of the main components of the coin processing device in FIG. 1, illustrating the processing of a coin D.

Next, as shown in FIG. 21, if a coin is inserted through the coin insertion slot 3 and this coin is determined on the basis of the detection signal from the coin identification sensor 11 to be a coin D, the control unit (not shown) actuates the genuine/counterfeit coin sorting lever 12 on the basis of this identification signal, blocks off the upstream end of the counterfeit coin ejection passage 13, and opens up the upstream end of the first coin sorting passage 14. At the same time, the first denomination sorting lever 15 is actuated, the upstream end of the third coin sorting passage 17 is opened, and the upstream end of the second coin sorting passage 16 is blocked off. At the same time, the control unit (not shown) actuates the third denomination sorting lever 65, opens the upstream end of the seventh coin sorting passage 64, and blocks off the upstream end of the sixth coin sorting passage 63. At the same time, the control unit (not shown) actuates the fourth denomination sorting lever 66, blocks off the upstream end of the eighth coin sorting passage 67, and opens the upstream end of the ninth coin sorting passage 68.

Accordingly, the coin D rolling through the coin identification passage 10 is guided by the genuine/counterfeit coin sorting lever 12 into the first coin sorting passage 14, then guided by the first denomination sorting lever 15 into the third coin sorting passage 17, after which it is guided by the third denomination sorting lever 65 into the seventh coin sorting passage 64, then guided by the fourth denomination sorting lever 66 into the ninth coin sorting passage 68, and finally drops from the bottom of the ninth coin sorting passage 68 and is stacked and stored in the coin tube 94.

When new-type coins A1, new-type coins C1, coins B, and coins D are sorted by the above-mentioned sorting operation of the coin sorting component 4, the various coins are successively stacked and stored in the coin tubes 91, 92, 93, and 94, respectively.

Figure 22:
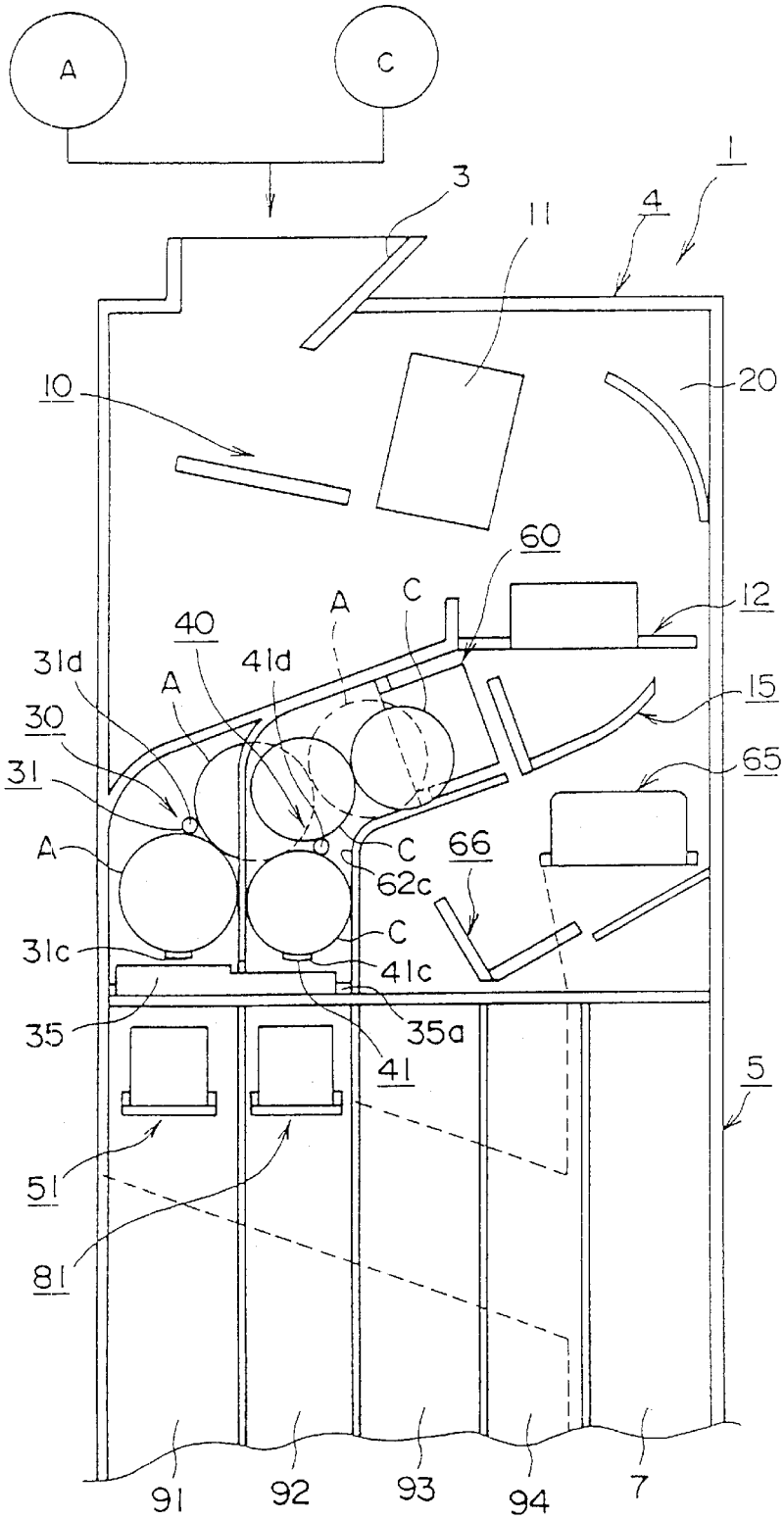
FIG. 22 is a schematic front view of the main components of the coin processing device in FIG. 1, illustrating the processing of a coin A and a coin C.

As a result of the -mentioned sorting operation of the coin sorting component 4, with this coin processing device 1, when a plurality of coins A and a plurality of coins C are inserted in the coin insertion slot 3, as shown in FIG. 22, the plurality of coins A and the plurality of coins C can be detained at the same time in the fourth coin sorting passage 61 and the fifth coin sorting passage 62, up to a maximum of three coins each.

Meanwhile, overflow occurs when the number of coins A, C, B, and D stacked in the coin tubes 91, 92, 93, and 94, respectively, exceeds the specified capacity. In view of this, with the coin processing device 1 in this embodiment, the numbers of coins A, C, B, and D stored the respective coin tubes 91, 92, 93, and 94 are detected by an overflow detection means provided to each of the coin tubes 91, 92, 93, and 94, and if it is detected that the predetermined number has been reached and an inserted coin representing overflow is subsequently inserted, this coin is sent directly to the cashbox.

Let us assume, for example, that the overflow detection means (not shown) has detected that the number of coins stacked and stored in the coin tube 93 for storing coins B has reached a predetermined number, in which case the above-mentioned coin sorting component 4 performs the following sorting operation.

Figure 23:
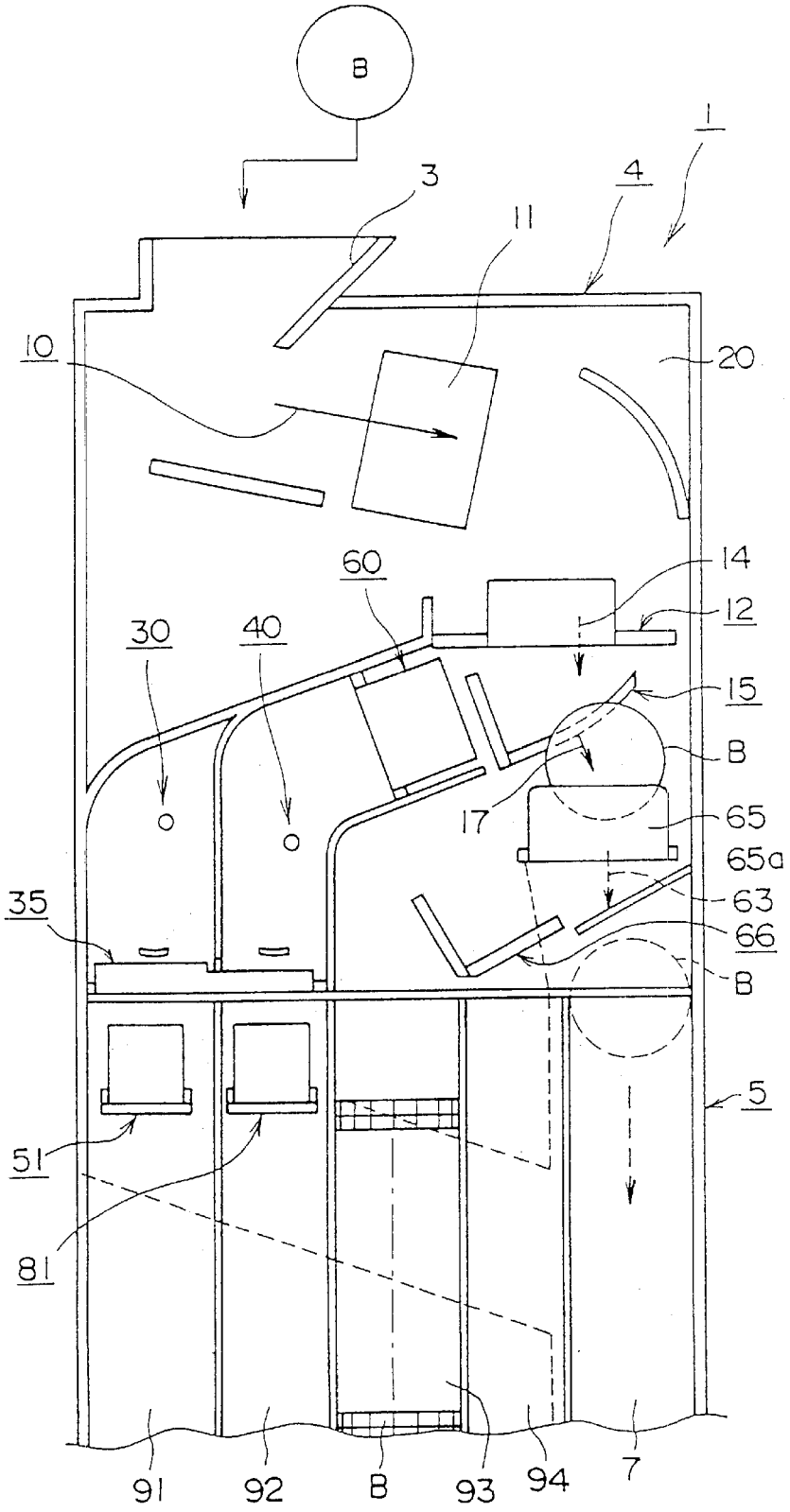
FIG. 23 is a schematic front view of the main components of the coin processing device in FIG. 1, illustrating the processing of a coin B.

Referring to FIG. 23, when a coin is inserted into the coin insertion slot 3 and the coin is determined on the basis of the detection signal from the coin identification sensor 11 to be a coin B, and the overflow detection means detects that the number of coins B stored in the coin tube 93 has reached a predetermined number, the control unit (not shown) actuates the genuine/counterfeit coin sorting lever 12 on the basis of this determination signal so as to block the upstream end of the counterfeit coin ejection passage 13 and open the upstream end of the first coin sorting passage 14, while at the same time actuating the first denomination sorting lever 15 to open the upstream end of the third coin sorting passage 17 and block the upstream end of the second coin sorting passage 16. At the same time, the third denomination sorting lever 65 is actuated to open the upstream end of the sixth coin sorting passage 63 and block the upstream end of the seventh coin sorting passage 64.

Consequently, as shown in FIG. 23, the coin B rolling through the coin identification passage 10 is guided into the first coin sorting passage 14 by the genuine/counterfeit coin sorting lever 12, and this coin B is then guided by the first denomination sorting lever 15 into the third coin sorting passage 17 situated below. This coin B is then guided by the third denomination sorting lever 65 into the sixth coin sorting passage 63, then drops from the bottom of the sixth coin sorting passage 63 and is sent directly to the cashbox (not shown) communicating with the sixth coin sorting passage 63.

Let us assume, for example, that the overflow detection means (not shown) has detected that the number of coins stacked and stored in the coin tube 94 for storing coins D has reached a predetermined number, in which case the above-mentioned coin sorting component 4 performs the following sorting operation.

Figure 24:
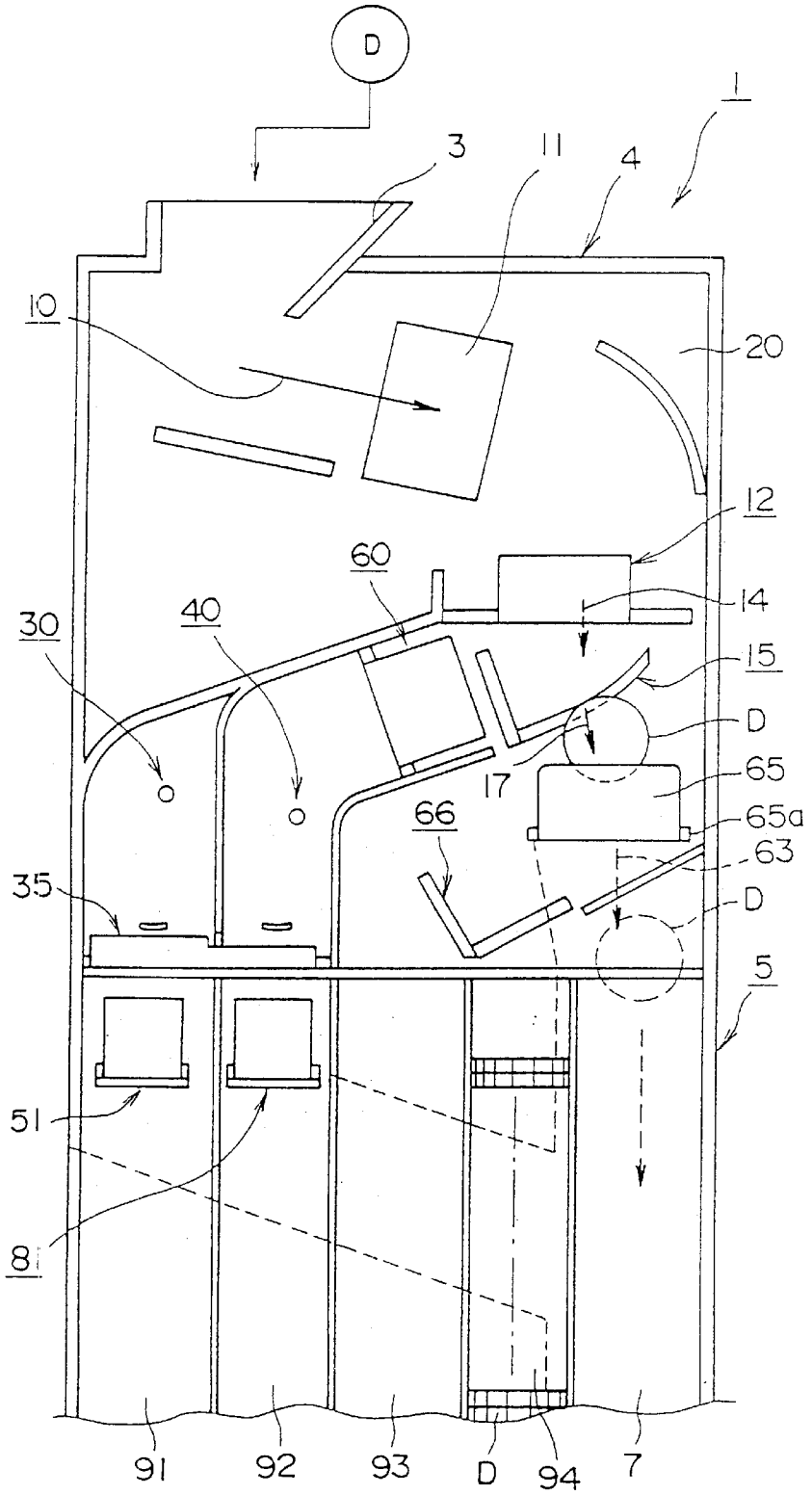
FIG. 24 is a schematic front view of the main components of the coin processing device in FIG. 1, illustrating the processing of a coin D.

Referring to FIG. 24, when a coin is inserted into the coin insertion slot 3 and the coin is determined on the basis of the detection signal from the coin identification sensor 11 to be a coin D, and the overflow detection means detects that the number of coins D stored in the coin tube 94 has reached a predetermined number, the control unit (not shown) actuates the genuine/counterfeit coin sorting lever 12 on the basis of this determination signal so as to block the upstream end of the counterfeit coin ejection passage 13 in FIG. 2 and open the upstream end of the first coin sorting passage 14, while at the same time actuating the first denomination sorting lever 15 to open the upstream end of the third coin sorting passage 17 and block the upstream end of the second coin sorting passage 16. At the same time, the third denomination sorting lever 65 is actuated to open the upstream end of the sixth coin sorting passage 63 and block the upstream end of the seventh coin sorting passage 64.

Consequently, as shown in FIG. 24, the coin D rolling through the coin identification passage 10 is guided into the first coin sorting passage 14 by the genuine/counterfeit coin sorting lever 12, and this coin D is then guided by the first denomination sorting lever 15 into the third coin sorting passage 17 situated below. This coin D is then guided by the third denomination sorting lever 65 into the sixth coin sorting passage 63, then drops from the bottom of the sixth coin sorting passage 63 and is sent directly to the cashbox (not shown) communicating with the sixth coin sorting passage 63.

Meanwhile, the following sorting operation is performed once the overflow detection means (not shown) detects that the number of coins A stacked and stored in the coin tube 91 for storing only new-type coins A1 has reached a predetermined number.

When a coin is inserted into the coin insertion slot 3 and the coin is determined on the basis of the detection signal from the coin identification sensor 11 to be a coin A, and the overflow detection means detects that the number of coins new-type coins A1 stored in the coin tube 91 has reached a predetermined number, the control unit (not shown) actuates the genuine/counterfeit coin sorting lever 12 on the basis of this determination signal so as to block the upstream end of the counterfeit coin ejection passage 13 and open the upstream end of the first coin sorting passage 14, while at the same time actuating the first denomination sorting lever 15 to open the upstream end of the second coin sorting passage 16 and block the upstream end of the third coin sorting passage 17. At the same time, the control unit (not shown) actuates the second denomination sorting lever 60 to open the fourth coin sorting passage 61 and block the fifth coin sorting passage 62.

When the control unit (not shown) determines that an inserted coin is a genuine coin A on the basis of the detection signal from the coin identification sensor 11 as shown in FIG. 7, the solenoid 32 is actuated as shown in FIG. 7, the result of which is that the biasing force of the coil spring 33 causes the first distal end component 31*c* of the first coin detaining lever 31 to project to the surface of the main plate 20 and block off the downstream end of the fourth coin sorting passage 61, and causes the second distal end component 31*d* to retract from the main plate 20 and open up the approximate midstream of the fourth coin sorting passage 61.

Accordingly, after rolling through the coin identification passage 10 as shown in FIG. 6, a coin A inserted into the coin insertion slot 3 is guided by the genuine/counterfeit coin sorting lever 12 into the first coin sorting passage 14, after which this coin A is guided by the first denomination sorting lever 15 into the second coin sorting passage 16, after which it is guided by the second denomination sorting lever 60 into the fourth coin sorting passage 61, and then after this it is temporarily detained downstream from the fourth coin sorting passage 61 by the first distal end component 31*c* of the first coin detaining lever 31. If, after this temporarily detention, coins inserted through the coin insertion slot 3 are judged to be coins A by the coin identification sensor 11 and guided into the fourth coin sorting passage 61, then these coins A are temporarily detained above the coin A directly supported by the first distal end component 31*c*, as shown in FIG. 8.

Specifically, even when the overflow detection means (not shown) detects that the number of coins stored in the coin tube 91 has reached a predetermined number, the inserted coins A are temporarily detained by the fourth coin sorting passage 61, without being immediately guided to the cashbox.

As mentioned above, this fourth coin sorting passage 61 can temporarily detain a maximum of three coins, and if another coin A is inserted through the coin insertion slot 3 after three coins A have already been temporarily detained, then the same processing is carried out as when the above-mentioned counterfeit coin G is ejected. Specifically, the control unit (not shown) causes this inserted coin A to be guided by the genuine/counterfeit coin sorting lever 12 into the counterfeit coin ejection passage 13 and returned from the coin return slot (not shown).

If the coin return lever is operated without a product being purchased from the vending machine in which the coin processing device 1 is installed while this coin A is being temporarily detained, then the control unit (not shown) actuates the solenoid 32 of the first coin detaining means 30 as shown in FIG. 9, which causes the first distal end component 31*c* of the first coin detaining lever 31 to be retracted from the main plate 20 so as to open up the downstream end of the fourth coin sorting passage 61, and causes the second distal end component 31*d* to project to the surface of the main plate 20 so as to block off the approximate midstream of the fourth coin sorting passage 61. Consequently, as shown in FIG. 9, the plurality of coins A temporarily detained in the fourth coin sorting passage 61 are released by the first distal end component 31*c* and guided to the downstream end of the fourth coin sorting passage 61, and the plurality of coins A located upstream from the coin A directly supported by the first distal end component 31*c* are halted in their progress by the wall surface 61*a* of the fourth coin sorting passage 61 and the second distal end component 31*d*, and as a result only the one coin A directly supported and temporarily detained by the first distal end component 31*c* is guided to the downstream end of the fourth coin sorting passage 61.

Also, if the coin return lever is operated without a product being purchased from the vending machine in which the coin processing device 1 is installed while this coin A is being temporarily detained, then on the basis of the operation signal from this coin return lever, the control unit (not shown) causes the sorting lever 35 to open the first coin return passage 70 communicating with the coin ejection chute 80 (FIG. 3) and block off the eleventh coin sorting passage 69, as shown in FIG. 10. Consequently, the coin A guided to the downstream end of the fourth coin sorting passage 61 is sorted by the sorting lever 35 into the first coin return passage 70 communicating with the coin ejection chute 80 (FIG. 3), and this coin A is returned through a coin return slot (not shown) via the coin ejection chute 80.

Therefore, with this coin processing device 1, when the coin return lever is operated without a product purchase in order to return a coin A, even if the coin tube 91 is overflowing, the inserted coin that has actually been inserted is temporarily detained and the coin A itself is dispensed at the coin return slot, so even if a coin A (counterfeit coin) manufactured skillfully enough to pass as genuine in the coin sorting component 4 has been inserted, the inserted (counterfeit) coin A itself is dispensed at the coin return slot, and coin switching is effectively thwarted.

On the other hand, when a product is purchased during the temporary detention of the coin A shown in FIG. 7, the control unit (not shown) actuates the solenoid 32 of the first coin detaining means 30 on the basis of the product purchase signal, as a result of which, just as above, only one coin A temporarily detained downstream from the first coin sorting passage is guided to the downstream end of the fourth coin sorting passage 61.

The control unit operates the sorting lever 35 on the basis of the product purchase signal, blocks off the first coin return passage 70, and opens the eleventh coin sorting passage 69, as shown in FIG. 9. Accordingly, the coin A that has been guided to the downstream end of the fourth coin sorting passage 61 is guided by the sorting lever 35 into the eleventh coin sorting passage 69.

The control unit (not shown) also stores information about whether the inserted coins A are of old-type or new-type, which is determined as the inserted coins pass the coin identification sensor 11, in the order of the coins temporarily detained by the first distal end component 31*c* of the first coin detaining lever 31, and controls the solenoid 54 of the second sorting means 51 on the basis of this coin new/old information, and regardless of whether a coin A guided into the eleventh coin sorting passage 69 during overflow is determined on the basis of the detection signal from the coin identification sensor 11 to be a new-type coin A1 or an old-type coin A2, the solenoid 54 of the second sorting means 51 as shown in FIG. 12, as a result of which the fourteenth coin sorting passage 74 is opened and the thirteenth coin sorting passage 73 is blocked.

Consequently, as shown in FIGS. 13 and 15, the coin A guided to the downstream end of the eleventh coin sorting passage 69 is guided along the back component 52*b* of the block-out lever 52 into the fourteenth coin sorting passage 74, after which it is stored in a cashbox communicating with the fourteenth coin sorting passage 74.

When the coin tube 91 overflows, if coins A are detained in the fourth coin sorting passage 61 in the order of new-type coin A1, old-type coin A2, and new-type coin A1, for example, as shown in FIG. 8, then when the control unit (not shown) processes the detained new-type coin A1, old-type coin A2, and new-type coin A1, it turns on the solenoid 54 regardless of the stored information about the order in which the old and new-type coins are detained (new, old, new).

The following sorting operation is carried out when the overflow detection means (not shown) detects that the number of coins C stacked and stored in the coin tube 92, which stores only new-type coins C1, has reached a predetermined number.

When a coin is inserted into the coin insertion slot 3 and the coin is determined on the basis of the detection signal from the coin identification sensor 11 to be a coin C, and the overflow detection means detects that the number of coins new-type coins C1 stored in the coin tube 92 has reached a predetermined number, the control unit (not shown) actuates the genuine/counterfeit coin sorting lever 12 on the basis of this determination signal so as to block the upstream end of the counterfeit coin ejection passage 13 and open the upstream end of the first coin sorting passage 14, while at the same time actuating the first denomination sorting lever 15 to open the upstream end of the second coin sorting passage 16 and block the upstream end of the third coin sorting passage 17. At the same time, the control unit (not shown) actuates the second denomination sorting lever 60 to open the fourth coin sorting passage 61 and block the fifth coin sorting passage 62.

When the control unit (not shown) determines that an inserted coin is a genuine coin C on the basis of the detection signal from the coin identification sensor 11, the solenoid 42 is actuated as shown in FIG. 7 on the basis of this detection signal, the result of which is that the biasing force of the coil spring 43 causes the first distal end component 41*c* of the second coin detaining lever 41 to project to the surface of the main plate 20 and block off the downstream end of the fifth coin sorting passage 62, and causes the second distal end component 41*d* to retract from the fifth coin sorting passage 62 and open up the approximate midstream of the fifth coin sorting passage 62.

Accordingly, after rolling through the coin identification passage 10 as shown in FIG. 6, a coin C inserted into the coin insertion slot 3 is guided by the genuine/counterfeit coin sorting lever 12 into the first coin sorting passage 14, after which this coin C is guided by the first denomination sorting lever 15 into the second coin sorting passage 16, after which it is guided by the second denomination sorting lever 60 into the fifth coin sorting passage 62, and then after this it is temporarily detained downstream from the fifth coin sorting passage 62 by the first distal end component 41*c* of the second coin detaining lever 41 as shown in FIGS. 7 and 16. If, after this temporarily detention, coins inserted through the coin insertion slot 3 are judged to be coins C by the coin identification sensor 11 and guided into the fifth coin sorting passage 62, then these coins C are temporarily detained above the coin C directly supported by the first distal end component 41*c*, as shown in FIG. 17.

Specifically, even when the overflow detection means (not shown) detects that the number of coins stored in the coin tube 92 has reached a predetermined number, the inserted coins C are temporarily detained by the 62, without being immediately guided to the cashbox.

This fifth coin sorting passage 62 can temporarily detain a maximum of three coins C, and if another coin C is inserted through the coin insertion slot 3 after three coins C have already been temporarily detained, then the control unit (not shown) causes this inserted coin C to be guided by the genuine/counterfeit coin sorting lever 12 into the counterfeit coin ejection passage 13 and returned from the coin return slot (not shown).

Next, if the coin return lever is operated without a product being purchased from the vending machine in which the coin processing device 1 is installed while this coin C is being temporarily detained, then the control unit (not shown) actuates the solenoid 42 of the second coin detaining means 40 as shown in FIG. 9 on the basis of the operation signal from this coin return lever, which causes the first distal end component 41*c* of the second coin detaining lever 41 to be retracted from the main plate 20 so as to open up the downstream end of the fifth coin sorting passage 62, and causes the second distal end component 41*d* to project to the surface of the main plate 20 so as to block off the approximate midstream of the fifth coin sorting passage 62. Consequently, as shown in FIG. 9, the plurality of coins C temporarily detained in the fifth coin sorting passage 62 are released by the first distal end component 41*c* and guided to the downstream end of the fifth coin sorting passage 62, and the plurality of coins C located upstream from the coin C directly supported by the first distal end component 41*c* are halted in their progress by the second distal end component 41*d*, and as a result only the one coin C directly supported and temporarily detained by the wall surface 62*a* of the fifth coin sorting passage 62 and the first distal end component 41*c* is guided to the downstream end of the fifth coin sorting passage 62.

Also, if the coin return lever is operated without a product being purchased from the vending machine in which the coin processing device 1 is installed while this coin C is being temporarily detained, then on the basis of the operation signal from this coin return lever, the control unit (not shown) causes the sorting lever 35 to open the second coin return passage 72 communicating with the coin ejection chute 80 (FIG. 3) and block off the twelfth coin sorting passage 71, as shown in FIG. 11. Consequently, the coin C guided to the downstream end of the fifth coin sorting passage 62 is sorted by the sorting lever 35 into the second coin return passage 72 communicating with the coin ejection chute 80 (FIG. 3), and this coin C is returned through a coin return slot (not shown) via the coin ejection chute 80.

Therefore, with this coin processing device 1, when the coin return lever is operated without a product purchase in order to return a coin C, the inserted coin C that has actually been inserted is temporarily detained and this coin C is itself dispensed to the coin return slot, so even if a counterfeit coin manufactured skillfully enough to pass as genuine in the coin sorting component 4 has been inserted, since the inserted (counterfeit) coin C itself is returned to the coin return slot, coin switching is effectively thwarted.

On the other hand, when a product is purchased during the temporary detention of the coin C shown in FIG. 7, the control unit (not shown) actuates the solenoid 42 of the second coin detaining means 40 on the basis of a product purchase signal, as a result of which, just as above, only one coin C temporarily detained at the downstream end of the fifth coin sorting passage 62 is guided to the downstream end of the fifth coin sorting passage 62.

The control unit (not shown) operates the sorting lever 35 on the basis of the product purchase signal, blocks off the second coin return passage 72, and opens the twelfth coin sorting passage 71, as shown in FIG. 9. Accordingly, the coin C that has been guided to the downstream end of the fifth coin sorting passage 62 is guided by the sorting lever 35 into the twelfth coin sorting passage 71.

The control unit (not shown) also stores information about whether the inserted coins C are of old-type or new-type, which is determined as the inserted coins pass the coin identification sensor 11, in the order of the coins temporarily detained by the first distal end component 41*c* of the second coin detaining lever 41, and controls the solenoid 84 of the second sorting means 81 on the basis of this coin new/old information, and regardless of whether a coin C guided into the twelfth coin sorting passage 71 during overflow is determined on the basis of the detection signal from the coin identification sensor 11 to be a new-type coin C1 or an old-type coin C2, the solenoid 84 of the second sorting means 81 as shown in FIG. 12, as a result of which the sixteenth coin sorting passage 76 is opened and the fifteenth coin sorting passage 75 is blocked.

Consequently, as shown in FIGS. 13 and 19, the coin C guided to the downstream end of the twelfth coin sorting passage 71 is guided along the back component 52*b* of the block-out lever 52 into the sixteenth coin sorting passage 76, after which it is stored in a cashbox (not shown) communicating with the sixteenth coin sorting passage 76.

Therefore, with the structure described above, when a product is purchased after the temporary detention of the coin C, the coin C inserted in the coin insertion slot 3 after the coin tube 92 has overflowed can be stored in the cashbox (not shown) regardless of whether it is a new-type coin C1 or an old-type coin C2.

When the coin tube 92 overflows, if coins C are detained in the fifth coin sorting passage 62 in the order of new-type coin C1, old-type coin C2, and new-type coin C1, for example, as shown in FIG. 17, then when the control unit (not shown) processes the detained coins, it turns on the solenoid 84 regardless of the stored information about the order in which the old and new-type coins are detained (new, old, new).

Thus, the coin processing devices of the first and second inventions comprise a first sorting means, provided downstream from first and second coin detaining means 30 and 40 and consisting of a sorting lever 35 that sorts coins A and coins C temporarily detained by these first and second coin detaining means 30 and 40 into first and second coin return passages 70 and 72 and coin tubes 91 and 92, respectively; and second sorting means 51 and 81, provided downstream from the sorting lever 35 and consisting of block-out levers 52 and 82 that sort the coins A and C that have been sorted by the sorting lever 35 into the coin tubes 91 and 92 into the coin tube 91 and the cashbox, and the coin tube 92 and the cashbox, respectively. Therefore, if the coins A and coins C are determined to be old or new by the coin identification sensor 11, and if the second sorting means 51 and 81 are operated by the control unit (not shown) so that the old-type coins A2 and C2 are sorted into the cashbox, then the respective old-type coins can be recovered in the cashbox.

Therefore, the coin processing devices of the first and second inventions allow old-type coins to be recovered and the use of these old-type coins to be prevented as much as possible, and more specifically, in Japan, old 500-yen coins can be recovered and the use of these old 500-yen coins can be prevented as much as possible.

Also, with the coin processing device 1 in this embodiment, the second sorting means 51 and 81 that make up the coin processing device of the present invention are constituted by the block-out levers 52 and 82, so the coin processing device of the present invention can be manufactured by modifying the design of a conventional coin processing device equipped with block-out levers, which allows manufacturing costs to be kept low.

Furthermore, since the second sorting means 51 and 81 that make up the coin processing device in the present invention are constituted by the block-out levers 51 and 81, respectively, the above-mentioned overflow detection means need not be provided to the coin tubes 91 and 92, and these block-out levers 52 and 82 can be used as ordinary block-out levers that operate when the coin tubes 91 and 92 are full.

When the block-out levers 52 and 82 are controlled by the solenoids 54 and 84, as with the coin processing device 1 in this embodiment, these block-out levers 52 and 82 can be operated intentionally, affording greater freedom in setting the number of coins that can be stored in the coin tubes 91 and 92.

Specifically, with the coin processing device of the second invention, the block-out levers 52 and 82, which are the second sorting means 51 and 81, are operated by the solenoids 54 and 84, making it possible to employ a so-called tube-remaining system, in which block-out levers can be operated via solenoids according to the set number of coins that can be stored in the coin tubes, and the number of coins that can be stored in the coin tubes can be freely set even though block-out levers are provided. The result of this is that the number of coins kept on hand as change in the coin tubes can be reduced, and in particular, the number of high-denomination coins that are stored can be kept to a minimum as dictated by the set prices for the vending machine unit.

This minimizes losses in the event that the coin processing device should malfunction due to vandals using a stun-gun or a radio transmitter, for example.

Also, the first and second sorting means 51 and 81 were constituted by the block-out levers 52 and 82 in the coin processing device 1 of this first embodiment, but the first and second sorting means 51 and 81 may instead be levers that sort coins A and coins C into first and second coin return passages 70 and 72 and eleventh and twelfth coin sorting passages 69 and 71, and may, for example, be constituted by sorting levers whose upper ends rotate around shafts at the lower ends.

Furthermore, with the coin processing device 1 in the above embodiment, the coins to be processed on the basis of whether the coins were new or old were coins A and coins C, but the coins that can be sorted by new/old with the coin processing device of the present invention are not limited to these, and may instead be coins B or coins D.

As described above, the coin processing device of the first invention comprises a first sorting means disposed downstream from the coin detaining means, for sorting the coins temporarily detained by the coin detaining means into a return passage and the coin storage means, and second sorting means disposed downstream from the first sorting means, for further sorting the coins sorted by the first sorting means into the coin storage means into the coin storage means and a cashbox. Therefore, genuine coins can be identified as being old or new by the coin identification means, and old-type coins can be recovered by opening the second sorting means on the basis of the identification by this coin identification means as to whether the genuine coins are old or new, and sorting the old-type coins into the cashbox.

Therefore, old-type coins (such as old 500-yen coins) can be recovered by this first coin processing device, allowing the use of these old-type coins (such as old 500-yen coins) to be prevented as much as possible.

The coin processing device of the second invention comprises a first sorting means disposed downstream from the coin detaining means, for sorting the coins temporarily detained by the coin detaining means into a return passage and the coin storage means, and second sorting means disposed downstream from the first sorting means, for further sorting the coins sorted by the first sorting means into the coin storage means into the coin storage means and a cashbox, this second sorting means is constituted by a block-out lever that guides to the cashbox any coins sorted by the first sorting means to the coin storage means when the coin storage means overflows, and this block-out lever is actuated by a solenoid, so old-type coins can be recovered as described for the coin processing device of the first invention, and this coin processing device can also be used as a tube-remaining type of coin processing device, despite being a coin processing device equipped with a block-out lever, by controlling the solenoid according to the set number of coins that can be stored in the coin tubes.

Next, the coin processing device according to the third invention will be described in detail through a coin processing device of a second embodiment.

Figure 25:
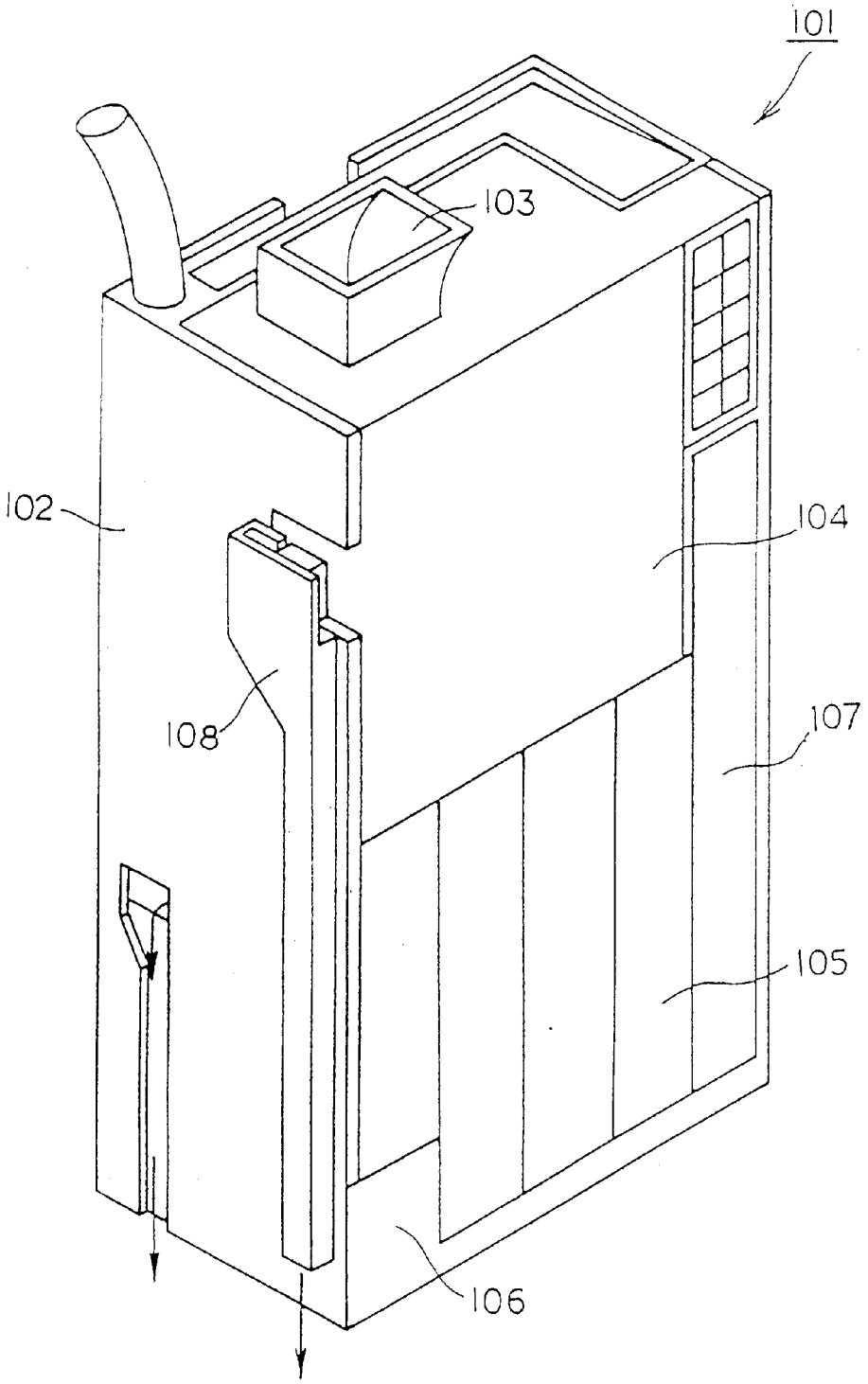
FIG. 25 is a schematic perspective view of the coin processing device according to the third invention.

FIG. 25 is a schematic perspective view of the coin processing device 101 of the second embodiment, according to the third invention.

Broadly classified, this coin processing device 101 also consists of the following four sections, as in the past: a device main body 102 constituting a cabinet, a coin sorting component 104 located in the uppermost portion of the device main body 102, for determining whether inserted coins are genuine and sorting genuine coins by denomination, a coin storage component 105 located below the coin sorting component 104 and comprising a plurality of coin tubes for storing by denomination genuine coins that have been sorted by the coin sorting component 104, and a coin dispensing component 106 located below the coin storage component 105, for dispensing the genuine coins from the coin storage component 105 according to the value of the change to be given.

107 in FIG. 25 is an auxiliary tube for storing coins used especially frequently, and 108 is a liquid discharge tube for discharging from the coin processing device 101 any liquid that has penetrated therein (a liquid such as a cleanser).

The coin sorting component 104 of the above-mentioned coin processing device 101 will now be described in detail.

Figure 26:
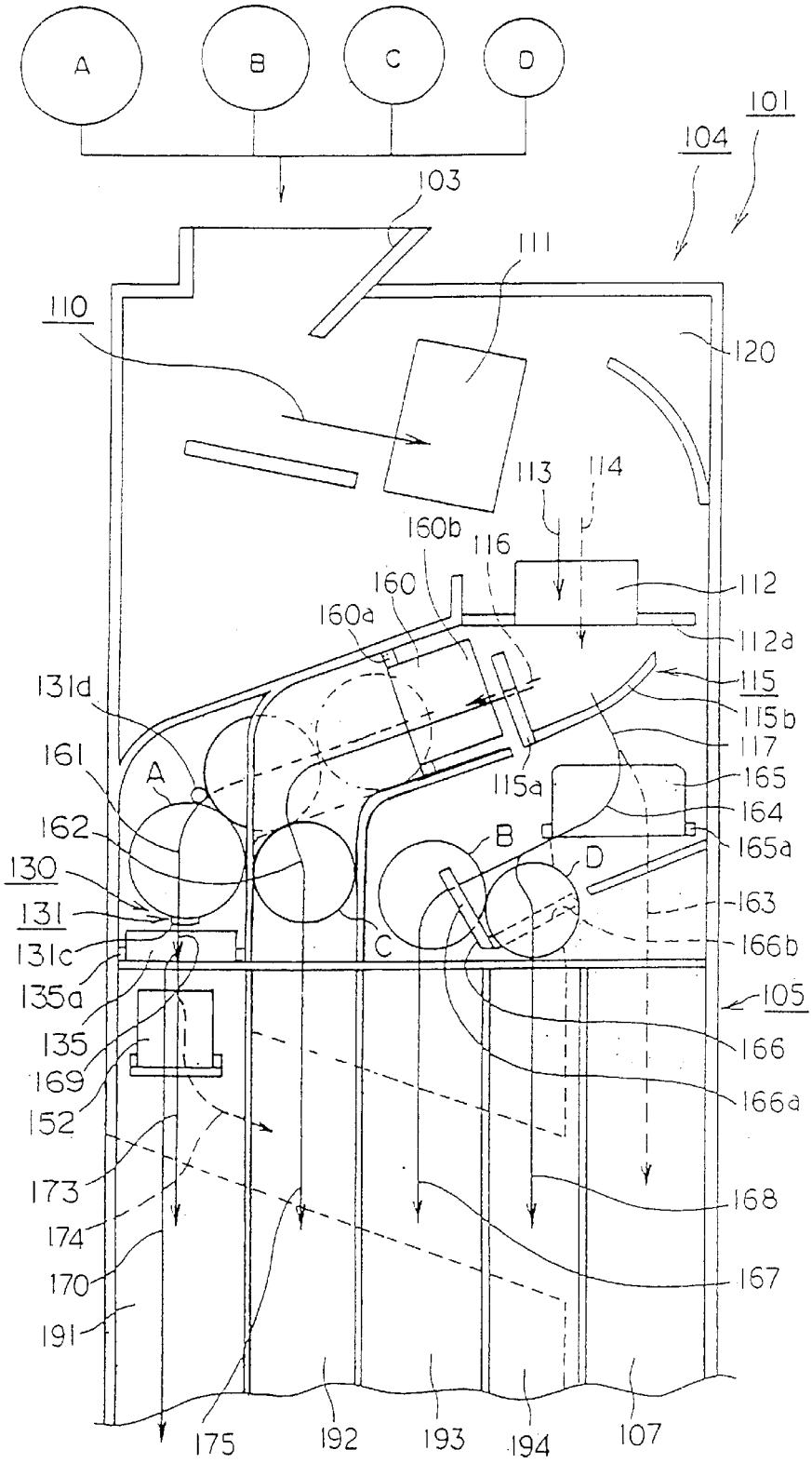
FIG. 26 is a schematic front view of the coin processing device according to the third invention.

FIG. 26 is a schematic front view of the coin processing device 101.

This coin sorting component 4 basically performs sorting of four genuine coins whose diameters are different from one another: genuine coins A (500-yen coins), genuine coins B (10-yen coins), genuine coins C (100-yen coins), genuine coins D (50-yen coins), and counterfeit coins.

A coin identification passage 110, which slopes to the right in the figure, is formed directly beneath the coin insertion slot 103 of the coin sorting component 104. A coin identification sensor 111 for identifying whether a coin is genuine or counterfeit and the denomination of genuine coins is disposed at some point along this passage.

At the end of this coin identification passage 110 is situated a genuine/counterfeit coin sorting lever 112 (genuine/counterfeit coin sorting component) for sorting coins transferred from the coin identification passage 110 into genuine coins and counterfeit coins, and guiding genuine coins and counterfeit coins into different coin passages.

This genuine/counterfeit coin sorting lever 112 is a sorting lever of a type in which the upper end opens and closes in a direction perpendicular to the plane of the figure, rotating around a shaft 112*a* at lower end thereof.

The end of the coin identification passage 110 is divided by this genuine/counterfeit coin sorting lever 112 into a counterfeit coin ejection passage 113 for guiding the inserted coins that are counterfeit, and a first coin sorting passage 114 for guiding just the coins determined to be genuine.

Figure 27:
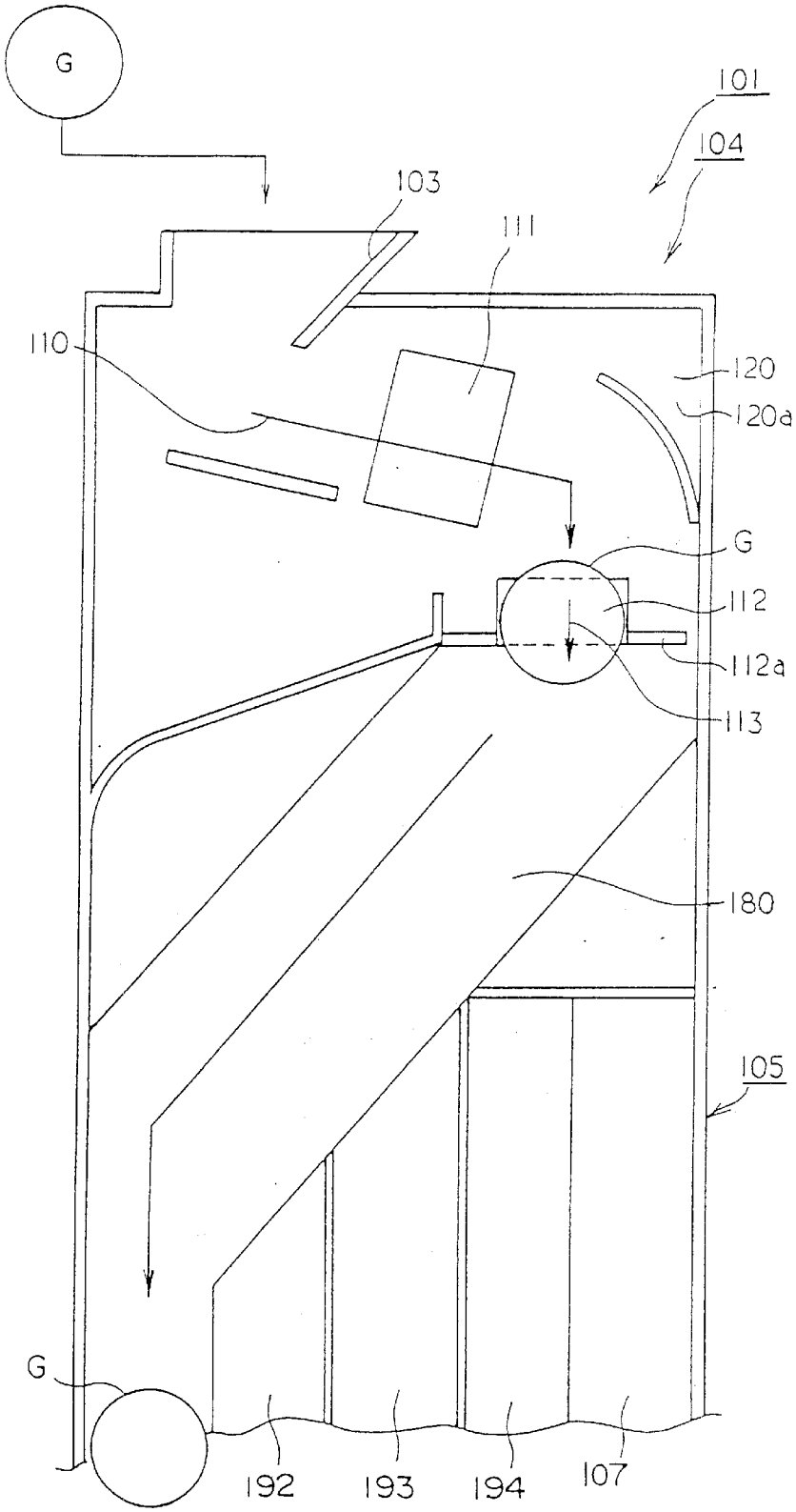
FIG. 27 is a schematic front view of the coin processing device according to the third invention, illustrating the processing of a counterfeit coin.

Out of the coin passage formed at the end of this genuine/counterfeit coin identification passage 110, the counterfeit coin ejection passage 113 communicates with a coin ejection chute 180 (FIG. 27) formed on the front side of a main plate 120, that is, on the front side of the coin sorting component 104 shown in FIG. 25, and this coin ejection chute 180 is formed sloping to the left in the figure (FIG. 27). This coin ejection chute 180 also communicates with a coin return slot (not shown), and a counterfeit coin G guided to the counterfeit coin ejection passage 113 is returned to the coin return slot through the coin ejection chute 180, as indicated by the arrow.

At the downstream end of the first coin sorting passage 114 shown in FIG. 26 there is disposed a first denomination sorting lever 115 (first denomination sorting component) for sorting coins determined to be genuine and transferred to the first coin sorting passage 114 (namely, the four types of genuine coins A, B, C, and D) into a group comprising coins A and C and a group comprising coins B and D.

The first coin sorting passage 114 is split by this first denomination sorting lever 115 into a second coin sorting passage 116, which slopes to the left in the figure, for guiding only coins of the A/C group, and a third coin sorting passage 117, which slopes slightly to the right in the figure, for guiding only coins of the B/D group.

As shown in FIG. 26, the overall configuration of the first denomination sorting lever 115 is L-shaped when viewed from the front.

Figure 28:
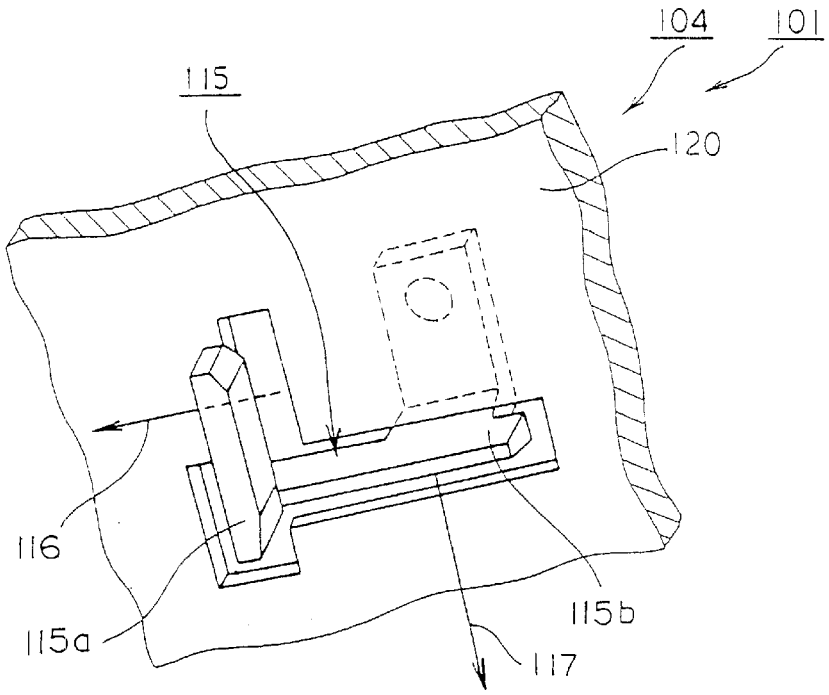
FIG. 28 is a schematic perspective view of the main components in FIG. 26, illustrating the operation of the first denomination sorting lever.
Figure 29:
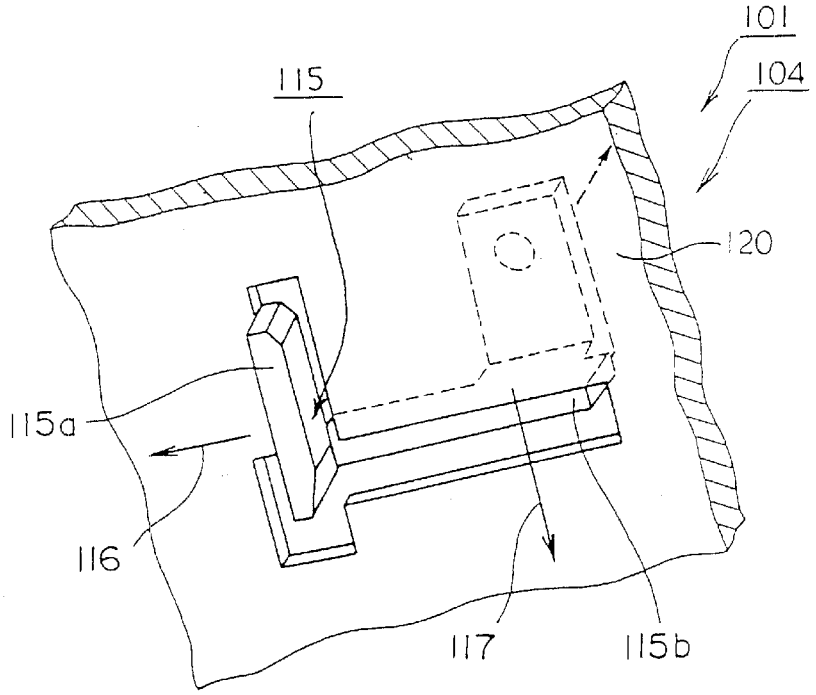
FIG. 29 is a schematic perspective view of the main components in FIG. 26, illustrating the operation of the first denomination sorting lever.

As shown in FIG. 28, which is a schematic perspective view of the main components in FIG. 26, this first denomination sorting lever 115 is made up of a first gate 115*a* that when projected from the surface of the main plate 120 of the coin sorting component 104, opens the second coin sorting passage 116 situated to the side, and that when drawn towards the main plate 120 as shown in FIG. 28, blocks off the above-mentioned second coin sorting passage 116; and a second gate 115*b* that when projected from the main plate 120 as shown in FIG. 28, blocks off the third coin sorting passage 117 situated on the bottom surface, and when drawn towards the main plate 120 as shown in FIG. 29, opens the above-mentioned third coin sorting passage 117.

The effect of this first denomination sorting lever 115 is that when the first denomination sorting lever 115 projects from the main plate 120 as shown in FIG. 28, the second coin sorting passage 116 is opened and the third coin sorting passage 117 is blocked, so only coins of the A/C group are guided into the second coin sorting passage 116.

When the first denomination sorting lever 115 is drawn toward the main plate 120 as shown in FIG. 29, the second coin sorting passage 116 is blocked and the third coin sorting passage 117 is opened, so only coins of the B/D group are guided into the third coin sorting passage 117.

Meanwhile, as shown in FIG. 26, a second denomination sorting lever 160 (second denomination sorting component) for sorting coins of the A/C group transferred to the second coin sorting passage 116 into coins A and coins C is provided at the downstream end of the second coin sorting passage 116. The second coin sorting passage 116 is divided by this second denomination sorting lever 160 into a fourth coin sorting passage 161 for guiding only coins A, and a fifth coin sorting passage 162 for guiding only coins C.

This second denomination sorting lever 160 is a denomination sorting lever of a type in which the right end 160*b* opens and closes in a direction perpendicular to the plane of the figure around a shaft 160*a* at the left end thereof.

As shown in FIG. 26, at the downstream end of the third coin sorting passage 117 there is provided a third denomination sorting lever 165 (third denomination sorting component) formed on the back of the main plate 120, for sorting coins into a sixth coin sorting passage 163, which leads to a cashbox (not shown), and a seventh coin sorting passage 164.

With this third denomination sorting lever 165, in the event that the number of coins C, B, or D stacked and stored in the coin tubes 192, 193, and 194, respectively, of the coin storage component 105 (FIG. 25; discussed below) should reach a predetermined number of coins stacked in the coin tubes 192, 193, and 194, any subsequently inserted coins C, B, or D are sorted and guided to the sixth coin sorting passage 163, which leads to the cashbox.

The determination as to whether the number of coins stacked in the coin tubes 192, 193, and 194 has reached the predetermined number is made by known full-detecting sensors (such as photosensors) provided at specific locations within the coin tubes 192, 193, and 194).

This third denomination sorting lever 165 is also a denomination sorting lever of a type in which the upper end opens and closes in a direction perpendicular to the plane of the figure around a shaft 165*a* at its bottom end.

As shown in FIG. 26, a fourth denomination sorting lever 166 (fourth denomination sorting component) for sorting coins of the B/D group guided into the seventh coin sorting passage 164 into coins B and coins D is provided at the downstream end of the seventh coin sorting passage 164.

This fourth denomination sorting lever 166 is a lever with the same construction as the first denomination sorting lever 115. The effect of this fourth denomination sorting lever 166 is that when the fourth denomination sorting lever 166 projects from the main plate 120, the eighth coin sorting passage 167 is opened and a ninth coin sorting passage 168 is blocked, so only coins B are guided into the eighth coin sorting passage 167, and when the fourth denomination sorting lever 166 is drawn toward the main plate 120 side, the eighth coin sorting passage 167 is blocked and the ninth coin sorting passage 168 is opened, so only coins D are guided into the ninth coin sorting passage 168.

Figure 30:
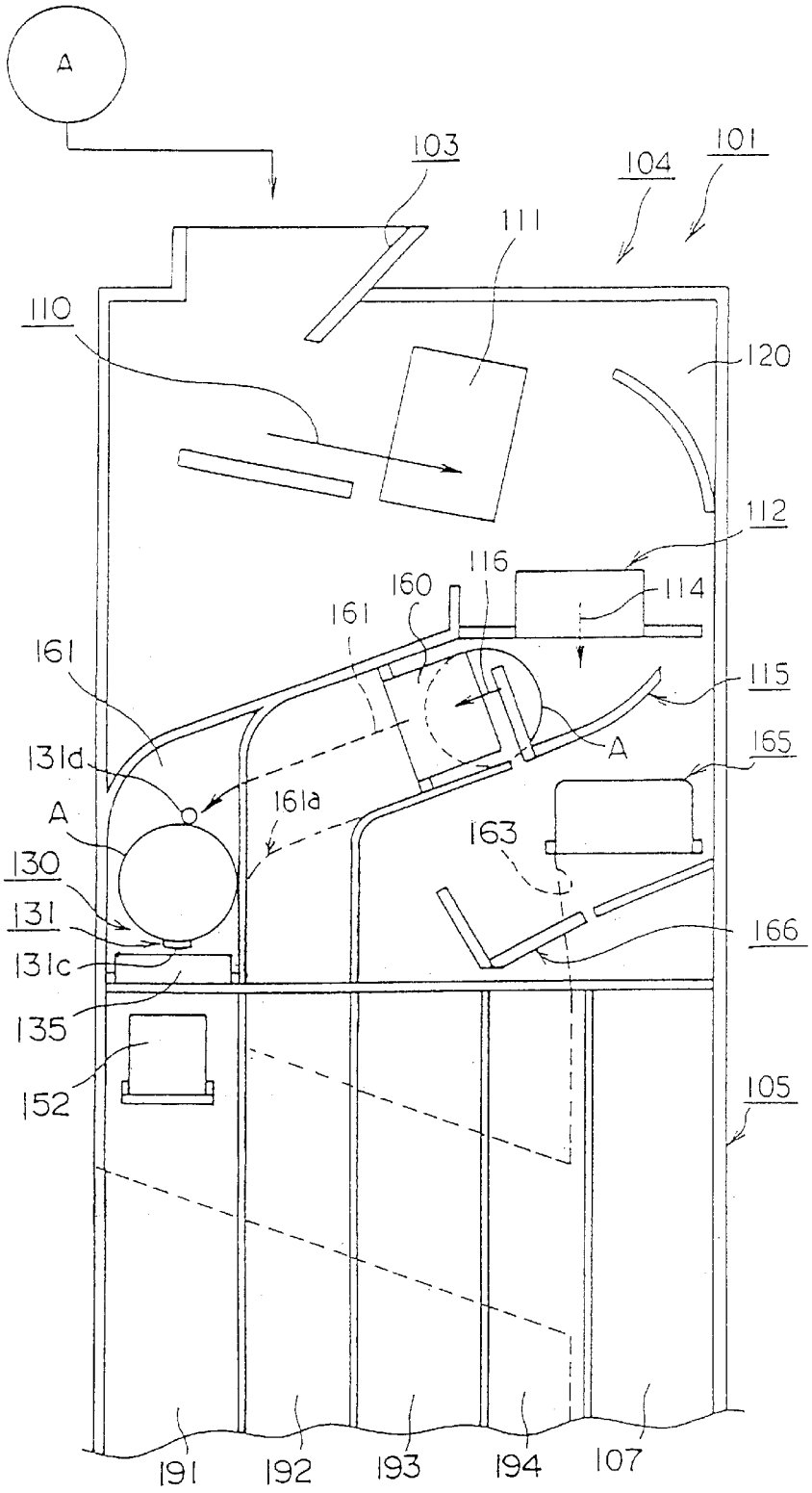
FIG. 30 is a schematic front view of the coin processing device in FIG. 25, illustrating the processing of a coin A.

As shown in FIG. 30, downstream from the fourth coin sorting passage 161 there is provided a coin detaining means 130 consisting of a coin detaining lever 131 that temporarily detains a plurality of coins (three coins according to the length of the fourth coin sorting passage 161 as shown in FIG. 26) that are deemed to be coins A and pass through the fourth coin sorting passage 161.

Figure 31:
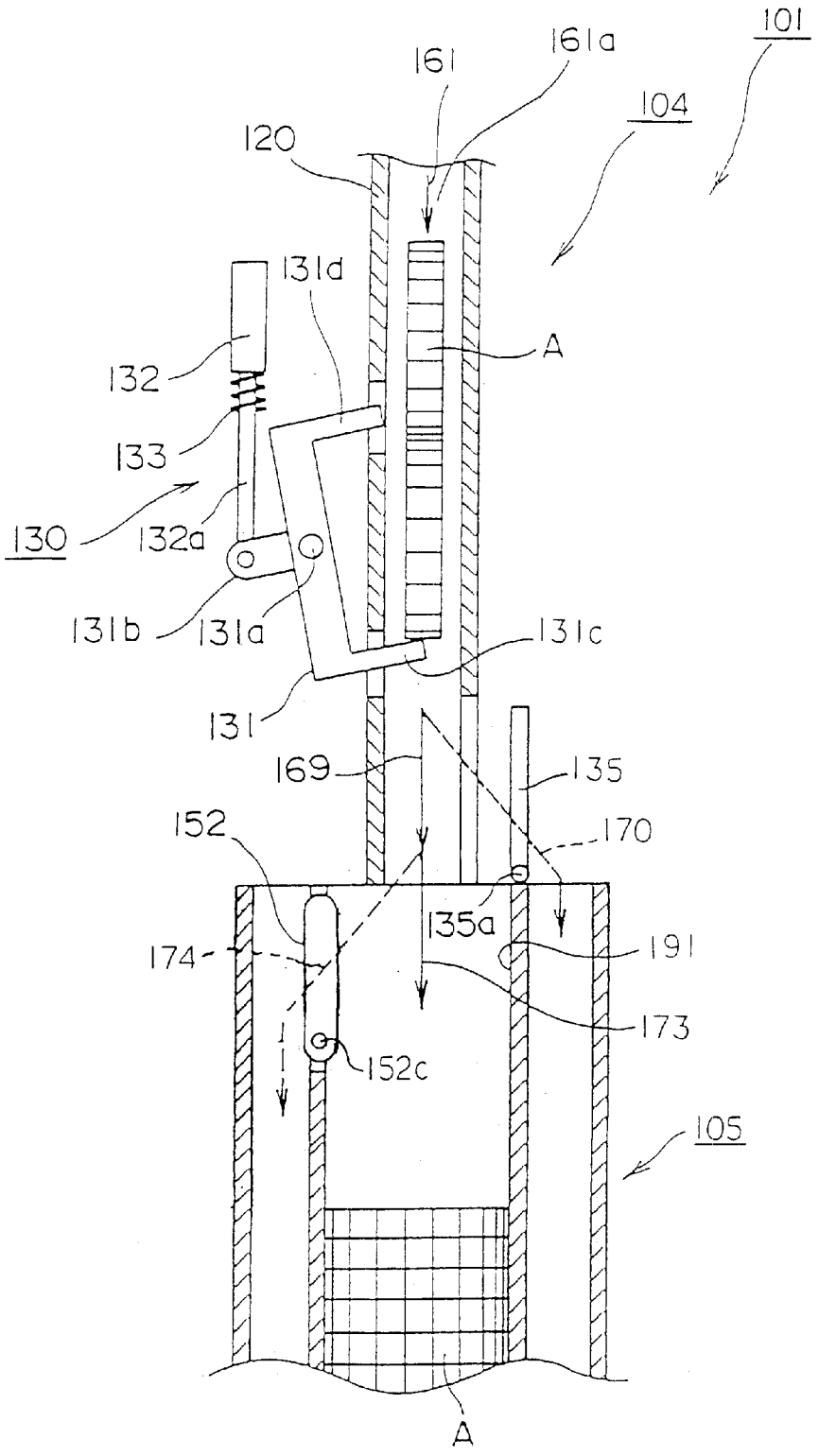
FIG. 31 is a schematic cross section of the main components in FIG. 30, illustrating the operation of the coin detaining means, the first sorting means, and the second sorting means.

As shown in FIG. 31, which is a schematic cross section of the main components in FIG. 30, the coin detaining means 130 comprises the coin detaining lever 131 for temporarily detaining coins that are deemed to be coins A and pass through the fourth coin sorting passage 161, and a first detaining component drive means consisting of a solenoid 132 for driving the coin detaining lever 131. The coin detaining lever 131 is a metal lever supported rotatably around a shaft 131*a,* and comprises a rear end component 131*b* linked to a drive shaft 132*a* of the solenoid 132, and a distal end component on which are formed a first distal end component 131*c* and a second distal end component 132*d* protruding into the fourth coin sorting passage 161. A coil spring 133 is fitted around the drive shaft 132*a* of the solenoid 132 linked to the rear end component 131*b* of the coin detaining lever 131.

The effect of this coin detaining means 130 is that in the initial state shown in FIG. 31, the distal end component of the coin detaining lever 131 is constantly biased and halted in the counterclockwise direction around the shaft 131*a* by the biasing force of the coil spring 133, the first distal end component 131*c* projects from the surface of the main plate 120 and blocks the downstream end of the fourth coin sorting passage 161, while the second distal end component 131*d* is retracted from the main plate 120 to open up the approximate midstream of the fourth coin sorting passage 161.

Figure 32:
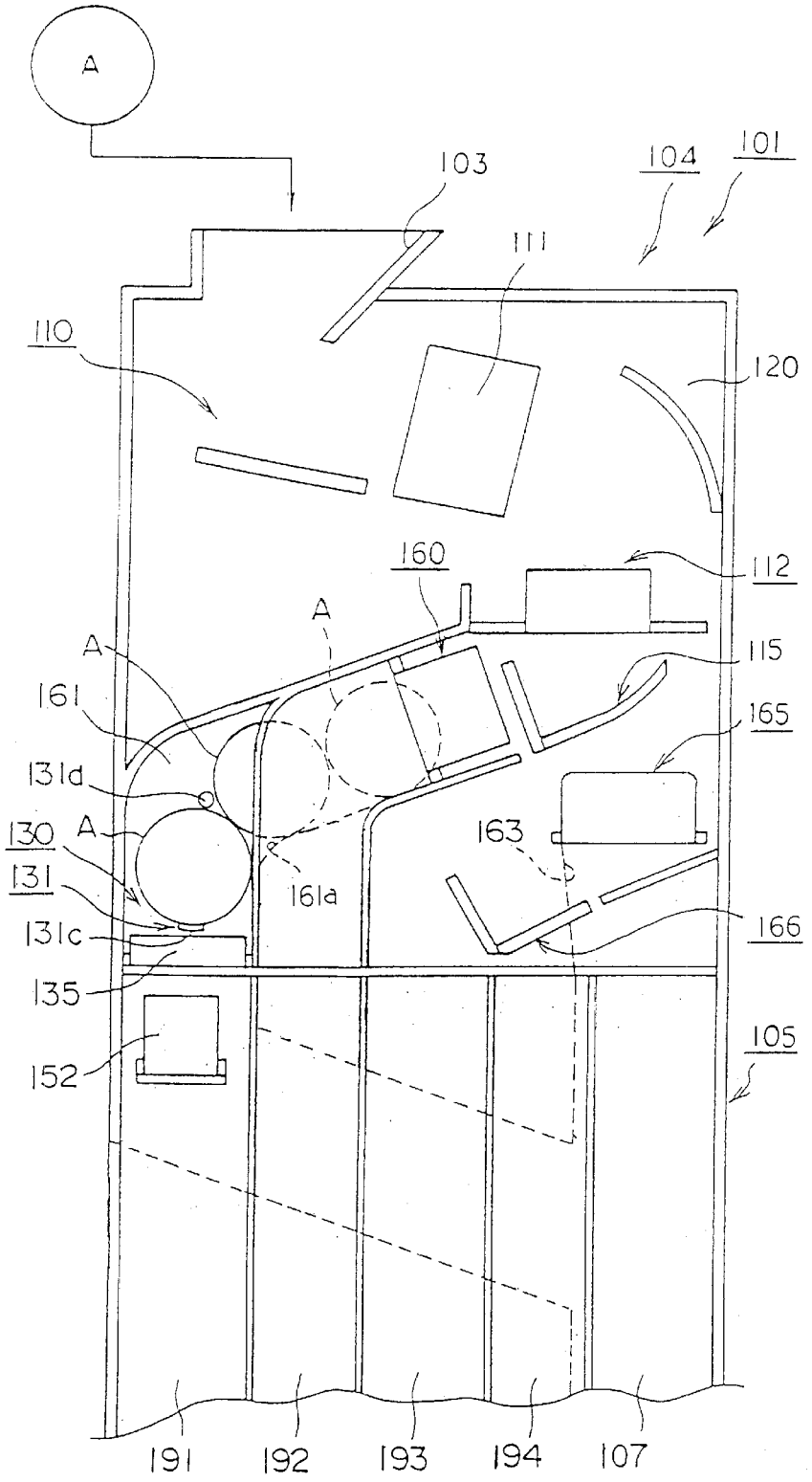
FIG. 32 is a schematic front view of the main components of the coin processing device in FIG. 25, illustrating the processing of a coin A.

When a coin A is guided into the fourth coin sorting passage 161 as shown in FIG. 30 in this initial state, the first distal end component 131*c* of the coin detaining lever 131 supports the edge of the coin A and detains the coin A as shown in FIGS. 30 and 31, and when a plurality of (three) coins A are guided into the fourth coin sorting passage 161 after this first coin A has been detained, the first distal end component 131*c* temporarily detains these three coins A as shown in FIG. 32.

Figure 33:
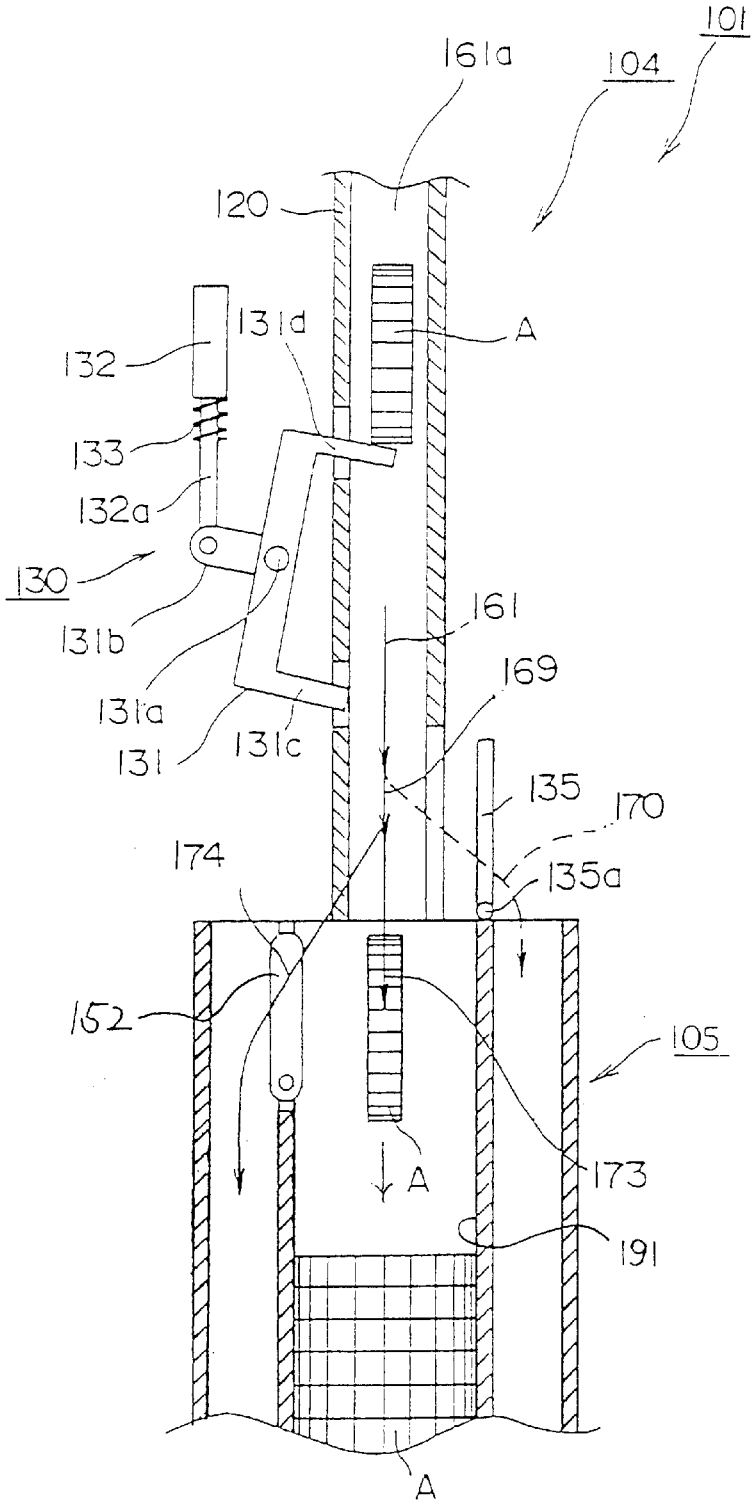
FIG. 33 is a schematic cross section illustrating the operation of the coin detaining means, the first sorting means, and the second sorting means of the coin processing device in FIG. 25.

When the solenoid 132 in FIG. 31 is actuated on the basis of a drive signal from a control unit (not shown) and the rear end component 131*b* of the coin detaining lever 131 is drawn to the top in the figure, the coin detaining lever 131 rotates clockwise around the shaft 131*a* against the biasing force of the coil spring 133, the first distal end component 131*c* is retracted from the main plate 120 to open up the downstream end of the fourth coin sorting passage 161, and the second distal end component 131*d* is projected to the surface of the main plate 120 to block off the approximate midstream of the fourth coin sorting passage 161, as shown in FIG. 33.

Consequently, the first distal end component 131*c* of the coin detaining lever 131, which has been temporarily detaining the plurality of coins A, releases the plurality of coins A as shown in FIG. 33, and the edge of the next coin A temporarily detained by the second distal end component 131*d* immediately after the coin A supported by the first distal end component 31*c* is supported by the wall surface 161*a* of the fourth coin sorting passage 161 and by the second distal end component 131*d,* and the coin A is temporarily halted in approximate midstream of the fourth coin sorting passage 161, the result of which is that only one coin A is guided to the downstream end of the fourth coin sorting passage 161.

FIG. 33 omits part of the depiction of the plurality of coins A (FIG. 32) temporarily halted by the wall surface 161*a* of the fourth coin sorting passage 161 and the second distal end component 131*d.*

When the solenoid 132 is turned off on the basis of a drive signal from the control unit (not shown), the drive shaft 132*a* of the solenoid 132 is slid back downward (in the figure) by the biasing force of the coil spring 133 as shown in FIG. 31, and the coin detaining lever 131 is rotated counterclockwise around the shaft 131*a,* the result of which is that the first distal end component 131*c* projects from the surface of the main plate 120 and blocks the downstream end of the fourth coin sorting passage 161, and the second distal end component 131*d* retracts from the main plate 120 and returns to the above-mentioned initial state in which the approximate midstream of the fourth coin sorting passage 161 is open.

When this happens, the second distal end component 131*d* of the coin detaining lever 131 releases the coin A that had been temporarily halted and guides the plurality of coins A that had been temporarily halted downstream from the fourth coin sorting passage 161, while the first distal end component 131*c* supports as shown in FIG. 31 the lowermost coin A out of the plurality of coins A guided downstream from the fourth coin sorting passage 161, and the supported coin A and the next coin A upstream from this supported coin A are temporarily detained by the fourth coin sorting passage 161.

Specifically, the effect of the coin detaining lever 131 of the coin detaining means 130 is that the first distal end component 131*c* and second distal end component 131*d* thereof alternately project into the fourth coin sorting passage 161, which causes the three coins A temporarily detained in the fourth coin sorting passage 161 to intermittently drop one at a time.

Meanwhile, as shown in FIG. 31, at the downstream end of the fourth coin sorting passage 161, which is downstream from the coin detaining means 130 shown in FIG. 26, are formed an eleventh coin sorting passage 169 formed directly under the fourth coin sorting passage 161, and a first coin return passage 170 that is formed on the front side of the coin storage component 105 and communicates with the coin ejection chute 180 (FIG. 27).

As is clear from FIGS. 26 and 31, at the downstream end of the fourth coin sorting passage 161 is situated a first coin sorting lever 135 (the first sorting means) for sorting the coins A guided to the downstream end of the fourth coin sorting passage 161 into the eleventh coin sorting passage 169 and the first coin return passage 170 communicating with the coin ejection chute 180 (FIG. 27).

Figure 34:
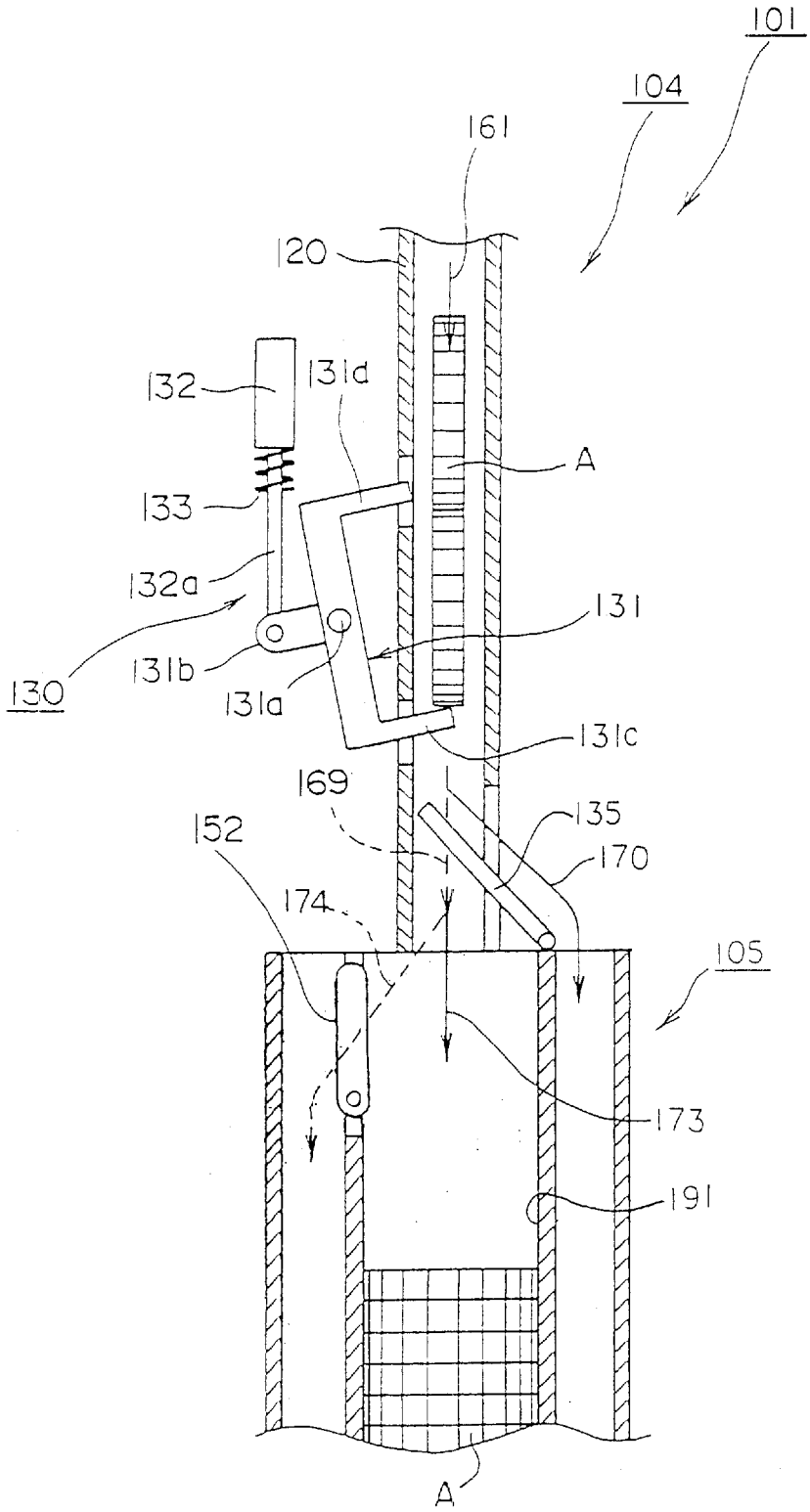
FIG. 34 is a schematic cross section illustrating the operation of the coin detaining means, the first sorting means, and the second sorting means of the coin processing device in FIG. 25.

This first coin sorting lever 135 is designed such that when the coin return lever is operated without a product being purchased while a coin A is temporarily detained, the eleventh coin sorting passage 169 is blocked off while the first coin return passage 170 is opened, as shown in FIG. 34.

Figure 35:
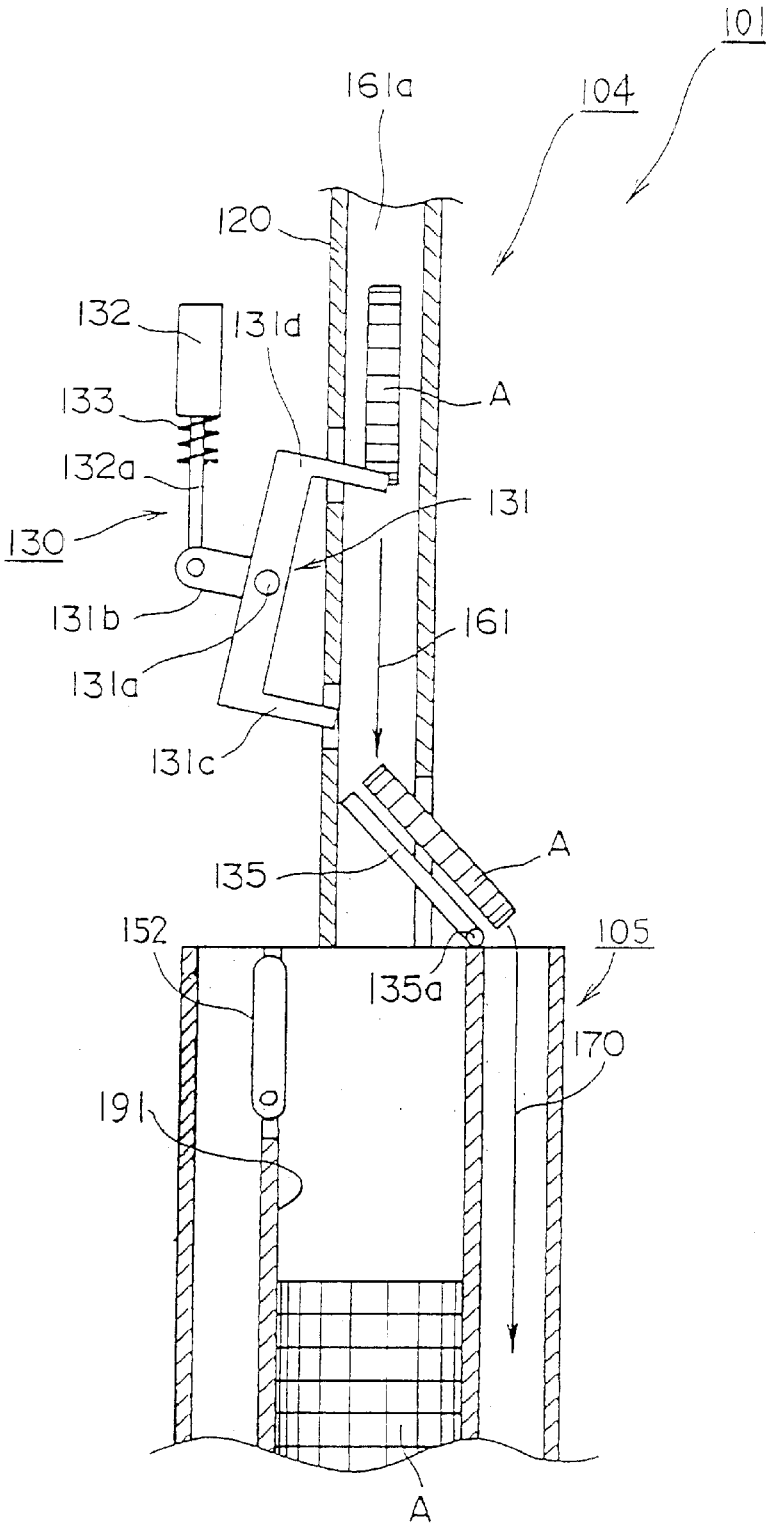
FIG. 35 is a schematic cross section illustrating the operation of the coin detaining means, the first sorting means, and the second sorting means of the coin processing device in FIG. 25.

Accordingly, a detained coin A that has been guided to the downstream end of the fourth coin sorting passage 161 is guided by the first coin sorting lever 135 into the first coin return passage 170 as shown in FIG. 35 and ejected from the coin return slot (not shown) via the coin ejection chute 180 (FIG. 27).

When a product has been purchased without the coin return lever being operated while a coin A is temporarily detained, the first coin sorting lever 135 opens the eleventh coin sorting passage 169 and blocks off the first coin return passage 170, as shown in FIG. 33.

Accordingly, a coin A that has been guided to the downstream end of the fourth coin sorting passage 161 drops straight down and is guided into the eleventh coin sorting passage 169.

The first coin sorting lever 135 that constitutes the above-mentioned first coin sorting means is also a denomination sorting lever of a type in which the upper end opens and closes in a direction perpendicular to the plane of the figure around a shaft 135*a* at lower end thereof, and is driven open and closed by a solenoid (not shown).

The above-mentioned genuine/counterfeit coin sorting lever 112 and the first to fourth denomination sorting levers (115, 160, 165, and 166) are also driven open and closed by a solenoid (not shown) in a conventional manner.

Meanwhile, a thirteenth coin sorting passage 173 formed directly under the eleventh coin sorting passage 169, and a fourteenth coin sorting passage 174 provided on the back face of the coin storage component 105 and communicating with a cashbox (not shown) are formed at the downstream end of the eleventh coin sorting passage 169.

Next, the coin storage component 105 of the coin processing device 101 shown in FIG. 26 will be described in detail.

The coin storage component 105 basically stores four types of genuine coin A, B, C, and D, whose diameters are different from one another.

This coin storage component 105 comprises a coin tube 191 for storing A coins, a coin tube 192 for storing C coins, a coin tube 193 for storing B coins, a coin tube 194 for storing D coins, and an auxiliary tube 107 for storing coins used especially frequently.

Of these, the coin tube 192 is located at the downstream end of a fifteenth coin passage 175, the coin tube 193 is located at the downstream end of the eighth coin sorting passage 167, and the coin tube 194 is located at the downstream end of the ninth coin sorting passage 168.

The coin tube 191 is located at the downstream end of the thirteenth coin sorting passage 173 as shown in FIG. 31.

As shown in FIG. 31, at the upstream end of the coin tube 191 is situated a second coin sorting lever 152 (the second sorting means) for sorting the detained coins A that have dropped from the eleventh coin sorting passage 169, into the coin tube 191 and the fourteenth coin sorting passage 174 formed on the back thereof and communicating with the cashbox (not shown).

This second coin sorting lever 152 is rotatably supported by the coin storage component 105 via a shaft 152*c*, and is rotationally driven at a specific timing by a solenoid (not shown) and a control unit (not shown) that controls the drive of this solenoid.

This second coin sorting lever 152 maintains its initial position state shown in FIG. 31 under normal circumstances in which the number of coins A stacked in the coin tube 191 is less than a preset number of stacked coins A as detected by a full-detecting sensor (not shown) provided at a specific location within the coin tube 191, the result of which is that the detained coins A that drop are guided to and stored in the coin tube 191.

Meanwhile, if it is detected by the full-detecting sensor (not shown) that the number of coins A stacked in the coin tube 191 has reached the preset number of stacked coins, the second coin sorting lever 152 rotates by a specific angle of rotation on the basis of this detection signal, after which the detained coins A that drop are sorted into the fourteenth coin sorting passage 174 leading to the cashbox (not shown). The second coin sorting lever 152 is also rotationally driven by a solenoid (not shown) in a conventional manner.

In its initial state, this second coin sorting lever 152 is stopped at the initial position in FIG. 31, and if at this point a coin A is guided to the downstream end of the eleventh coin sorting passage 169, this coin A is guided to and stacked and stored in the coin tube 191 via the thirteenth coin sorting passage 173.

Figure 36:
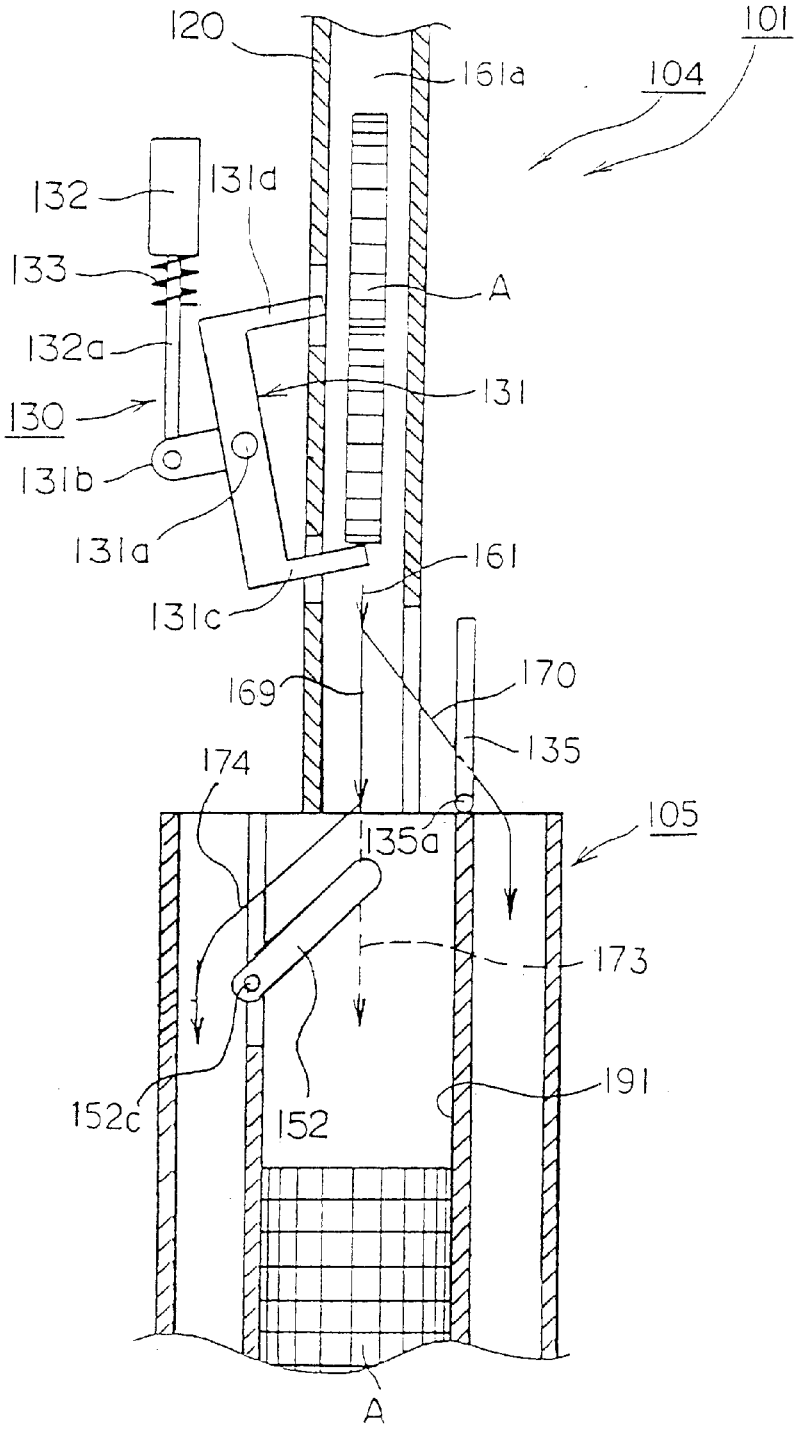
FIG. 36 is a schematic cross section illustrating the operation of the coin detaining means, the first sorting means, and the second sorting means of the coin processing device in FIG. 25.

If it is detected on the basis of the detection signal from the full-detecting sensor (not shown) that the preset number of stacked coins has been reached, the control unit (not shown) rotates the second coin sorting lever 152 clockwise around the shaft 152*c* by a specific angle of rotation as shown in FIG. 36 on the basis of this detection signal.

Figure 37:
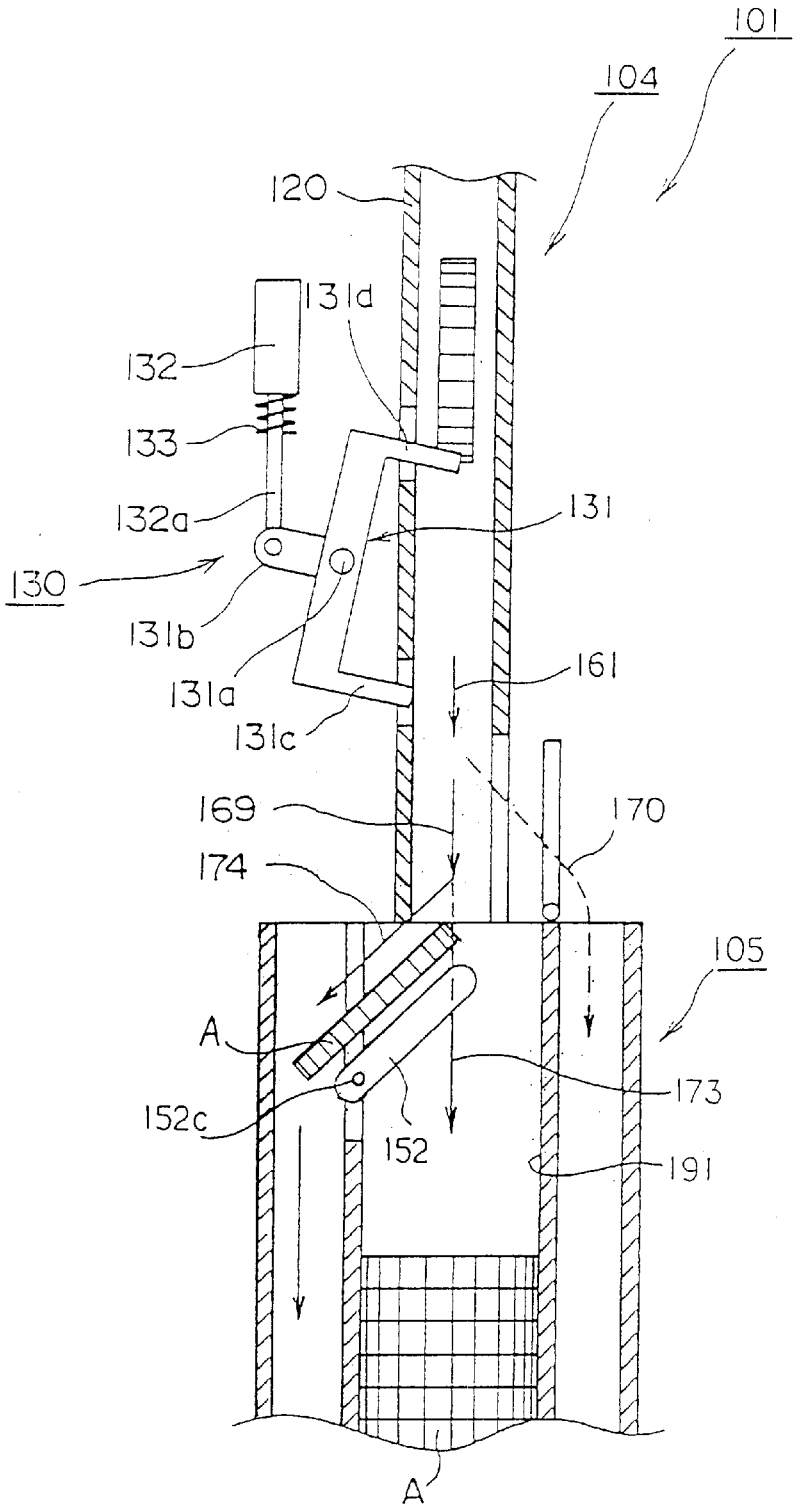
FIG. 37 is a schematic cross section illustrating the operation of the coin detaining means, the first sorting means, and the second sorting means of the coin processing device in FIG. 25.

Consequently, the coin A guided to the downstream end of the eleventh coin sorting passage 169 is guided along the back of the second coin sorting lever 152 as shown in FIG. 37, after which it is stored in the cashbox (not shown) via the fourteenth coin sorting passage 174.

Next, the operation of the above coin processing device 101 will be described, and the structure will also be described in detail.

As shown in FIG. 27, when a coin G inserted in the coin insertion slot 103 is determined to be counterfeit on the basis of the detection signal of the coin identification sensor 111, the genuine/counterfeit coin sorting lever 112 opens up the counterfeit coin ejection passage 113 and at the same time blocks off the upstream end of the first coin sorting passage 114 on the basis of this identification signal. The counterfeit coin G rolling through the coin identification passage 110 is thereupon guided by the genuine/counterfeit coin sorting lever 112 into the counterfeit coin ejection passage 113, and is returned to the coin return slot (not shown) via the coin ejection chute 180 communicating with this counterfeit coin ejection passage 113.

Next, as shown in FIG. 30, when a coin is inserted in the coin insertion slot 103 and it is determined on the basis of the detection signal of the coin identification sensor 111 that this coin is genuine and is an A coin, a control unit (not shown) actuates the genuine/counterfeit coin sorting lever 112 on the basis of this identification signal, opening up the upstream end of the first coin sorting passage 114. At the same time, the upstream end of the second coin sorting passage 116 is opened up and the upstream end of the third coin sorting passage 117 is blocked off by the first denomination sorting lever 115. Furthermore, the fourth coin sorting passage 161 is opened up and the fifth coin sorting passage 162 is blocked off by the second denomination sorting lever 160.

When the control unit (not shown) determines that an inserted coin is a genuine coin A on the basis of the detection signal from the coin identification sensor 111, the solenoid 132 is actuated as shown in FIG. 31, the result of which is that the biasing force of the coil spring 133 causes the first distal end component 131*c* of the first coin detaining lever 131 to project from the surface of the main plate 120 and block off the downstream end of the fourth coin sorting passage 161, and causes the second distal end component 131*d* to retract from the main plate 120 and open up the approximate midstream of the fourth coin sorting passage 161.

Accordingly, as shown in FIG. 30, after rolling through the coin identification passage 110, a coin A inserted into the coin insertion slot 103 is guided by the genuine/counterfeit coin sorting lever 112 into the first coin sorting passage 114, after which this coin A is guided by the first denomination sorting lever 115 into the second coin sorting passage 116.

After this, as shown in FIG. 30, the coin A is further guided by the second denomination sorting lever 160 into the fourth coin sorting passage 161, and then temporarily detained downstream from the fourth coin sorting passage 161 by the first distal end component 131*c* of the first coin detaining lever 131.

Then, if any coins inserted through the coin insertion slot 103 are judged to be coins A by the coin identification sensor 111 and guided into the fourth coin sorting passage 161, these coins A are temporarily detained one after another above the coin A directly supported by the first distal end component 131*c,* as shown in FIG. 32.

This fourth coin sorting passage 161 can temporarily detain a maximum of three coins, including the coin directly supported by the first distal end component 131*c,* according to the length of the passage, as shown in FIG. 32.

If the coin return lever is then operated without a product being purchased from the vending machine in which the coin processing device 101 is installed while this coin A is being temporarily detained, then the control unit (not shown) actuates the solenoid 132 of the first coin detaining means 130 as shown in FIG. 33 on the basis of the operation signal from this coin return lever, which causes the first distal end component 131*c* of the first coin detaining lever 131 to be retracted from the main plate 120 so as to open up the downstream end of the fourth coin sorting passage 161, and causes the second distal end component 131*d* to project to the surface of the main plate 120 so as to block off the approximate midstream of the fourth coin sorting passage 161.

Consequently, as shown in FIG. 33, the coin A at the front of those being temporarily detained in the fourth coin sorting passage 161 is released by the first distal end component 131*c* and guided to the downstream end of the fourth coin sorting passage 161, and the next coin A located upstream from the coin A directly supported by the first distal end component 131*c* is halted in its progress by the wall surface 161*a* of the fourth coin sorting passage 161 and a second distal end component 131*d,* and as a result only the one coin A directly supported and temporarily detained by the first distal end component 131*c* is guided to the downstream end of the fourth coin sorting passage 161.

When the coin return lever is operated, the control unit (not shown) operates the first coin sorting lever 135 on the basis of the operation signal of this coin return lever to open up the first coin return passage 170 communicating with the coin ejection chute 180 (FIG. 27) and block the eleventh coin sorting passage 169, as shown in FIG. 34, so the coin A guided to the downstream end of the fourth coin sorting passage 161 is sorted by the first coin sorting lever 135 into the first coin return passage 170 communicating with the coin ejection chute 180 (FIG. 27) as shown in FIG. 35, and this coin A is returned from the coin return slot (not shown) via the coin ejection chute 180.

Therefore, if the coin return lever is operated without purchasing a product, such processing is carried out for the number of retained coins, and all the retained coins A which drop intermittently are returned to the coin return slot.

Therefore, when the coin return lever is operated without a product purchase in order to return a coin A, the inserted coin that has actually been inserted, that is, the temporarily detained coin A, is itself dispensed to the coin return slot, so even if a counterfeit coin manufactured skillfully enough to pass as genuine in the coin sorting component 104 has been inserted, since the inserted (counterfeit) coin A itself is returned to the coin return slot, coin switching is effectively thwarted.

On the other hand, when a product is purchased during the temporary detention of the coin A, the coin processing device 101 performs different processing for each of the following situations.

(a) When there is a purchase of a product whose value corresponds to the number of detained coins A.

(b) When there is a purchase of a product whose value is less than to the number of detained coins A, and a coin A will be dispensed as change.

Let us start by describing in detail the case (a); when there is a purchase of a product whose value corresponds to the number of detained coins A.

When there is a purchase of a product whose value corresponds to the number of detained coins A, as shown in FIG. 33, the control unit (not shown) actuates the solenoid 132 of the first coin detaining means 130, the result of which is that the coins A temporarily detained in the downstream portion of the fourth coin sorting passage 161 are guided to the downstream end of the fourth coin sorting passage 161. At the same time, the control unit (not shown) operates the first coin sorting lever 135 so as to block the first coin return passage 170 and open the eleventh coin sorting passage 169, the result of which is that the coin A guided to the downstream end of the fourth coin sorting passage 161 is guided into the eleventh coin sorting passage 169.

Figure 38:
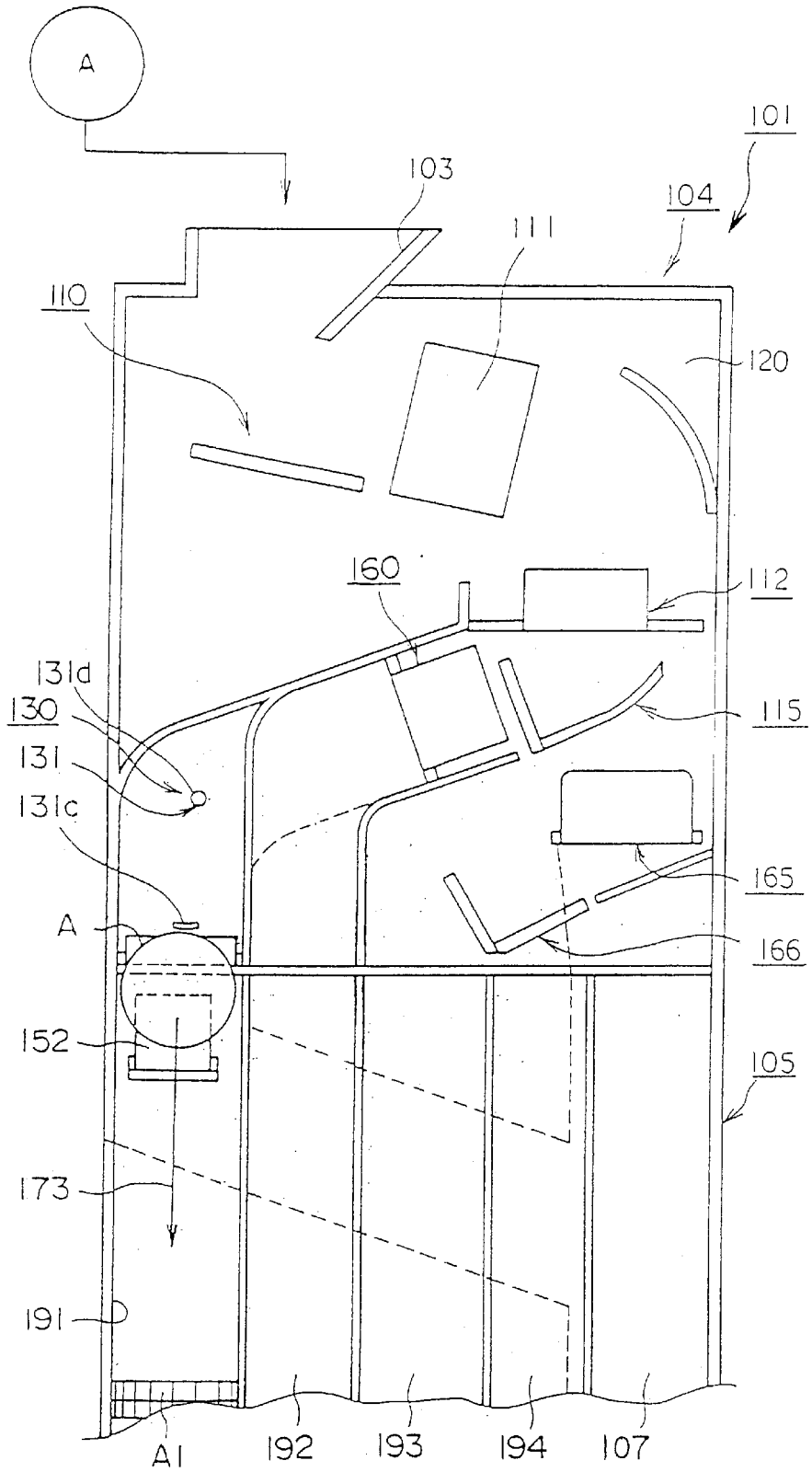
FIG. 38 is a schematic front view of the main components of the coin processing device in FIG. 25, illustrating the processing of a coin A.

After this, the coin A that has been guided to the downstream end of the eleventh coin sorting passage 169 is guided into the thirteenth coin sorting passage 173, after which it is stacked and stored in the coin tube 191 as shown in FIG. 38, and this processing is carried out for the number of coins A that have been detained.

Figure 39:
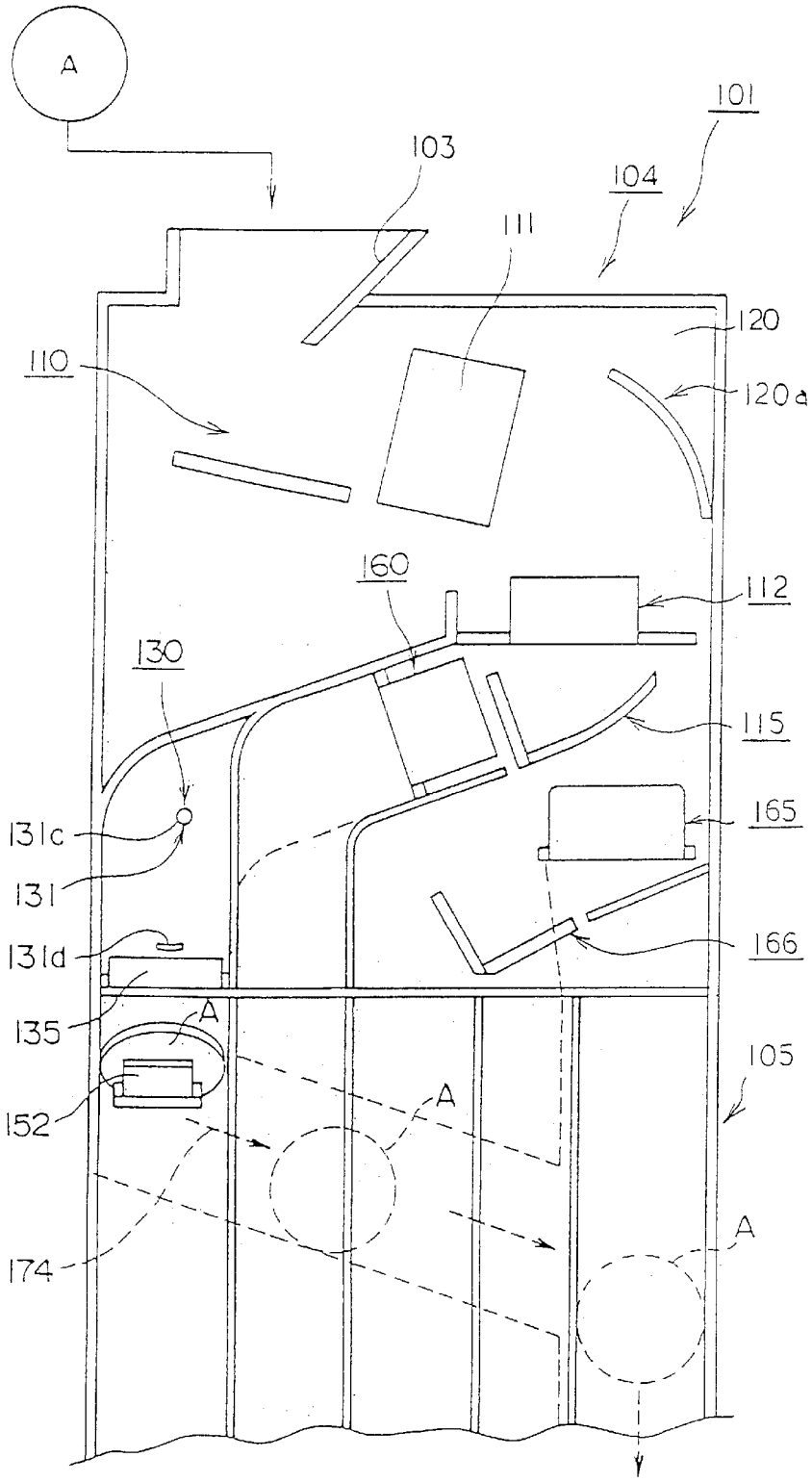
FIG. 39 is a schematic front view of the main components of the coin processing device in FIG. 25, illustrating the processing of a coin A.

If, in the course of storing the coins A in the coin tube 191, it is detected by the full-detecting sensor provided in the coin tube 191 that the predetermined number of coins A have been stored, then any coins A subsequently guided to the downstream end of the eleventh coin sorting passage 169 are guided by the second coin sorting lever 152 into the fourteenth coin sorting passage 174 as shown in FIG. 37, and from there are stored in the cashbox (not shown) as shown in FIG. 39, so coins A are not stored in the coin tube 191 in a number larger than necessary.

Next is the case (b); when there is a purchase of a product whose value is less than that corresponding to the number of detained coins A, and a coin A will be dispensed as change.

First, on the basis of product value information based on the product purchase signal, and value information corresponding to the number of detained coins A, the control unit (not shown) calculates the value of the change and at the same time determines the number of coins A to be stored from among the number of coins A being detained.

After this, as shown in FIG. 33, the control unit (not shown) actuates the solenoid 132 of the first coin detaining means 130, and guides the coin A at the front of those being temporarily detained in the downstream portion of the fourth coin sorting passage 161 to the downstream end of the fourth coin sorting passage 161. At the same time, the control unit (not shown) operates the first coin sorting lever 135 so as to open the first coin return passage 170 and block the eleventh coin sorting passage 169, the result of which is that the one coin A guided to the downstream end of the fourth coin sorting passage 161 is guided into the eleventh coin sorting passage 169, after which the coin A is stacked and stored in the coin tube 191 as shown in FIG. 38. This processing is intermittently performed according to the predetermined number of coins A to be stored. If, during this time, it is detected by the full-detecting sensor provided in the coin tube 191 that the predetermined number of coins A have been stored, then any coins A subsequently guided to the downstream end of the eleventh coin sorting passage 169 are guided by the second coin sorting lever 152 into the fourteenth coin sorting passage 174 as shown in FIG. 37, and from there are stored in the cashbox (not shown) as shown in FIG. 39, so coins A are not stored in the coin tube 191 in a number larger than necessary.

On the other hand, if a coin A is still being detained by the first coin detaining means 130 after the number of coins A to be stored have been processed for storage, then all of the coins A detained by the first coin detaining means 130 are returned to the return slot by the same processing as shown in FIG. 35.

Therefore, with the coin processing device 101, not only are the temporarily detained coins A that were actually inserted dispensed at the coin return slot when the coin return lever is operated without a product being purchased, but all the detained coins A are returned to the return slot if the coin return lever is operated when there are detained coins A after a product has been purchased.

This is accomplished by intermittently dropping the detained coins A one and at time using the first coin detaining means 130, allowing different control to be performed for the various coins A that drop. With a conventional structure in which a plurality of detained coins A are dropped all at once, it is clear that the processing of subsequent coins A cannot be controlled differently for each of the various coins.

With the coin processing device 101, as mentioned above, the fourth coin sorting passage 161 is able to temporarily detain a maximum of three coins A, and if a coin A is inserted through the coin insertion slot 103 after three coins A have already been temporarily detained, then the control unit (not shown) performs the same processing as when the above-mentioned counterfeit coin G is ejected. Specifically, the control unit (not shown) causes this inserted coin to be guided by the genuine/counterfeit coin sorting lever 112 into the counterfeit coin ejection passage 113, and returned from the coin return slot (not shown).

Figure 40:
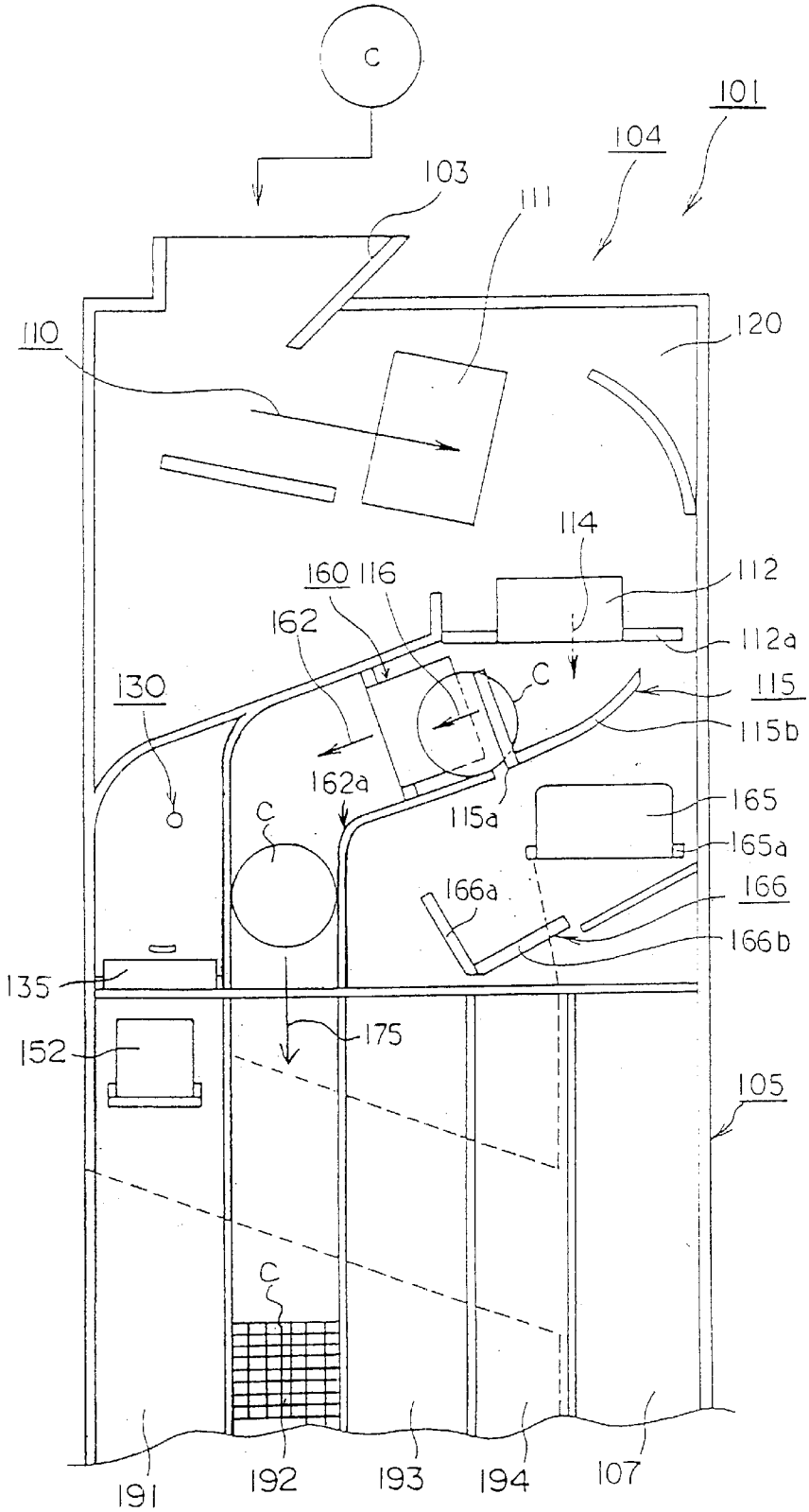
FIG. 40 is a schematic front view of the main components of the coin processing device in FIG. 25, illustrating the processing of a coin C.

Next, as shown in FIG. 40, if a coin is inserted through the coin insertion slot 103 and is determined to be a coin C on the basis of the detection signal from the coin identification sensor 111, the control unit (not shown) operates the genuine/counterfeit coin sorting lever 112 on the basis of this identification signal so as to block the upstream end of the counterfeit coin ejection passage 113 and open the upstream end of the first coin sorting passage 114. At the same time, the first denomination sorting lever 115 is operated so as to open the upstream end of the second coin sorting passage 116 and block the upstream end of the third coin sorting passage 117. Furthermore, the second denomination sorting lever 160 is operated so as to block the fourth coin sorting passage 161 and open the fifth coin sorting passage 162.

Therefore, a coin that has been inserted through the coin insertion slot 103 and determined to be a coin C is guided to the downstream end of the fifth coin sorting passage 162, after which it is guided into the fifteenth coin passage 175 and stacked and stored in the coin tube 192.

Figure 41:
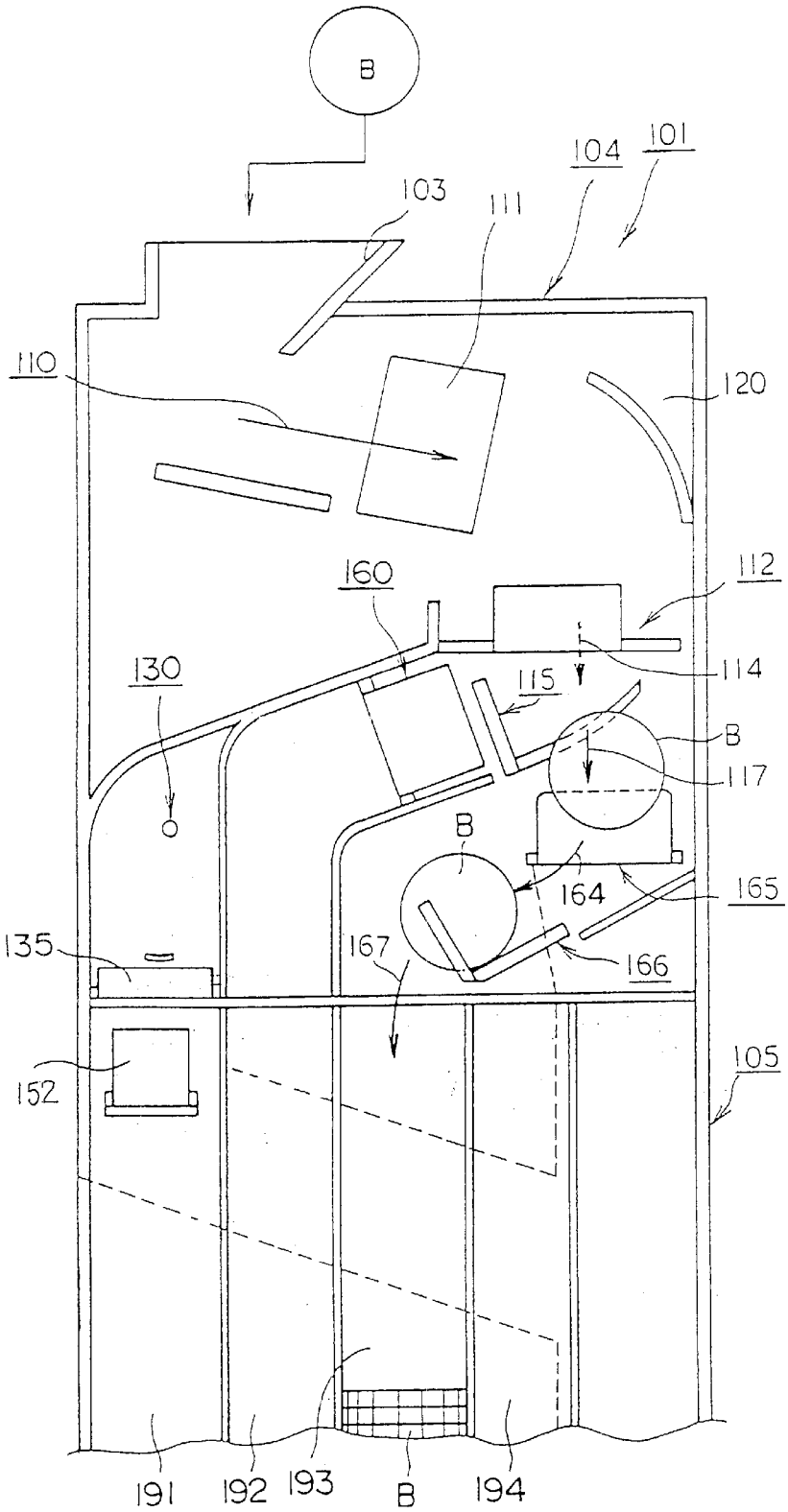
FIG. 41 is a schematic front view of the main components of the coin processing device in FIG. 25, illustrating the processing of a coin B.

Next, as shown in FIG. 41, if a coin is inserted through the coin insertion slot 103 and is determined to be a coin B on the basis of the detection signal from the coin identification sensor 111, the control unit (not shown) operates the genuine/counterfeit coin sorting lever 112 on the basis of this identification signal so as to block the upstream end of the counterfeit coin ejection passage 113 and open the upstream end of the first coin sorting passage 114. At the same time, the first denomination sorting lever 115 is operated so as to block the upstream end of the second coin sorting passage 116 and open the upstream end of the third coin sorting passage 117.

At the same time, the control unit (not shown) operates the third denomination sorting lever 165 so as to block the upstream end of the sixth coin sorting passage 163 and open the upstream end of the seventh coin sorting passage 164, and at the same time operates the fourth denomination sorting lever 166 so as to open the eighth coin sorting passage 167 and block the ninth coin sorting passage 168.

Accordingly, a coin B rolling through the coin identification passage 110 is guided by the genuine/counterfeit coin sorting lever 112 into the first coin sorting passage 114 as shown in FIG. 41, after which it is guided by the first denomination sorting lever 115 into the third coin sorting passage 117 situated below, and then guided by the third denomination sorting lever 165 into the seventh coin sorting passage 164, after which it is guided by the fourth denomination sorting lever 166 into the eighth coin sorting passage 167, then drops from the bottom of the eighth coin sorting passage 167 and is stacked and stored in the coin tube 193.

Figure 42:
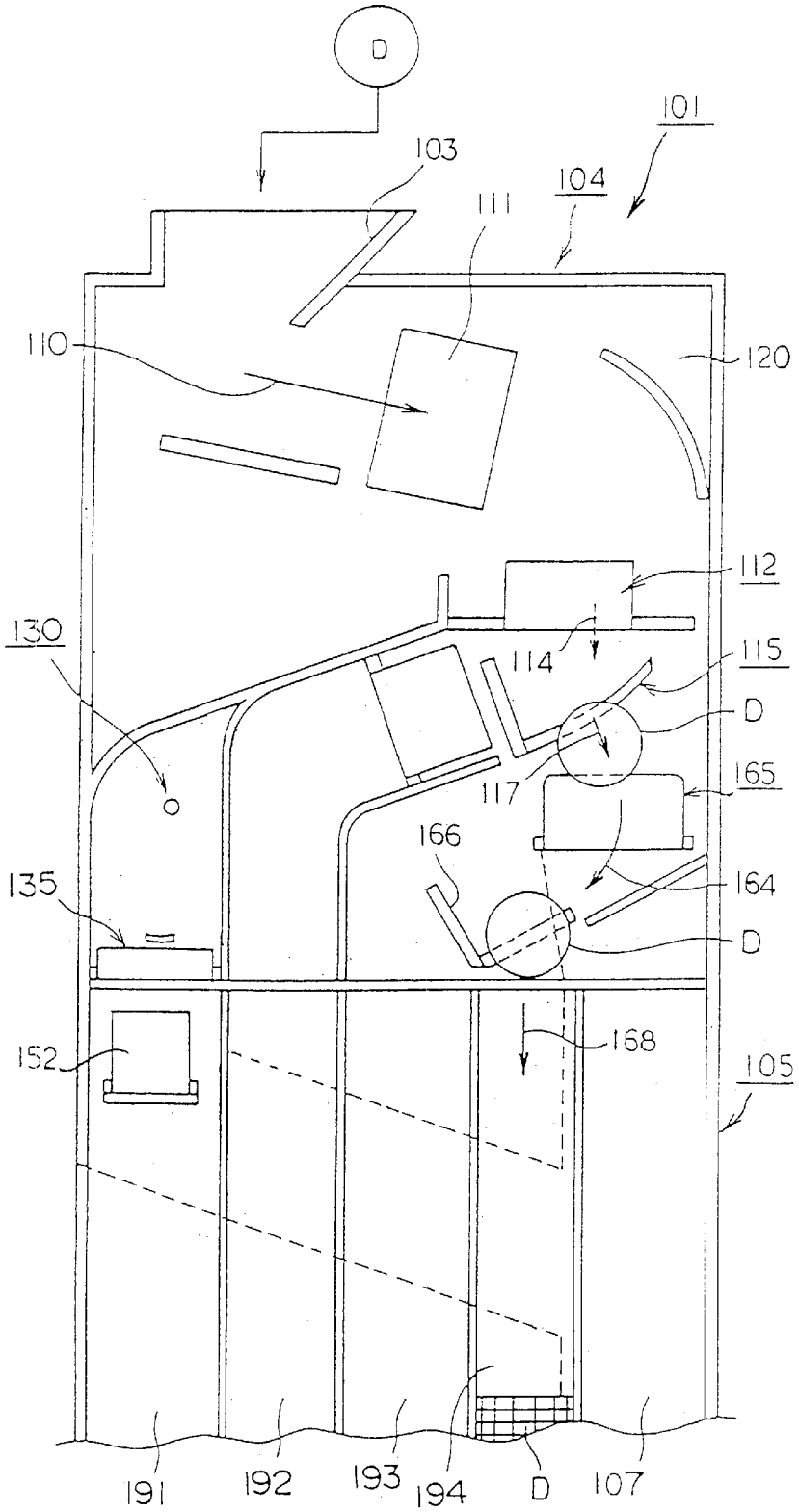
FIG. 42 is a schematic front view of the main components of the coin processing device in FIG. 25, illustrating the processing of a coin D.

Next, as shown in FIG. 42, if a coin is inserted through the coin insertion slot 103 and is determined to be a coin D on the basis of the detection signal from the coin identification sensor 111, the control unit (not shown) operates the genuine/counterfeit coin sorting lever 112 on the basis of this identification signal so as to block the upstream end of the counterfeit coin ejection passage 113 and open the upstream end of the first coin sorting passage 114. At the same time, the first denomination sorting lever 115 is operated so as to open the upstream end of the third coin sorting passage 117 and block the upstream end of the second coin sorting passage 116.

Furthermore, the control unit (not shown) operates the third denomination sorting lever 165 so as to open the upstream end of the seventh coin sorting passage 164 and block the upstream end of the sixth coin sorting passage 163. At the same time, the control unit (not shown) operates the fourth denomination sorting lever 166 so as to block the upstream end of the eighth coin sorting passage 167 and open the upstream end of the ninth coin sorting passage 168.

Accordingly, a coin D rolling through the coin identification passage 110 is guided by the genuine/counterfeit coin sorting lever 112 into the first coin sorting passage 114, after which it is guided by the first denomination sorting lever 115 into the third coin sorting passage 117 situated below, and then guided by the third denomination sorting lever 165 into the seventh coin sorting passage 164, after which it is guided by the fourth denomination sorting lever 166 into the ninth coin sorting passage 168, then drops from the bottom of the ninth coin sorting passage 168 and is stacked and stored in the coin tube 194.

Meanwhile, overflow occurs when the number of coins A, C, B, and D stacked in the coin tubes 191, 192, 193, and 194, respectively, exceeds the specified capacity, and in the case of coins A in particular, as in FIG. 37 discussed above, coins A that drop out after the predetermined number of stacked coins has been reached as determined by the full-detecting sensor provided to the coin tube 191 are stored in the cashbox, rather than in the coin tube 191, thus effecting overflow processing.

Meanwhile, the overflow processing is as follows when the numbers of stored coins C, B, and D (excluding coins A) exceed the predetermined capacities.

If a coin for which an overflow state exists is inserted after the full-detecting sensors provided to the coin tubes 191, 193, and 194 (excluding coin tube 191) have detected that the numbers of coins C, B, and D stored in these tubes have reached the predetermined numbers, then that coin is immediately stored in the cashbox.

If we assume that the full-detecting sensor (not shown) has detected that the number of coins stored in the coin tube 193 for storing coins B has reached the predetermined number, then the above-mentioned coin sorting component 104 will perform the following sorting operation.

Figure 43:
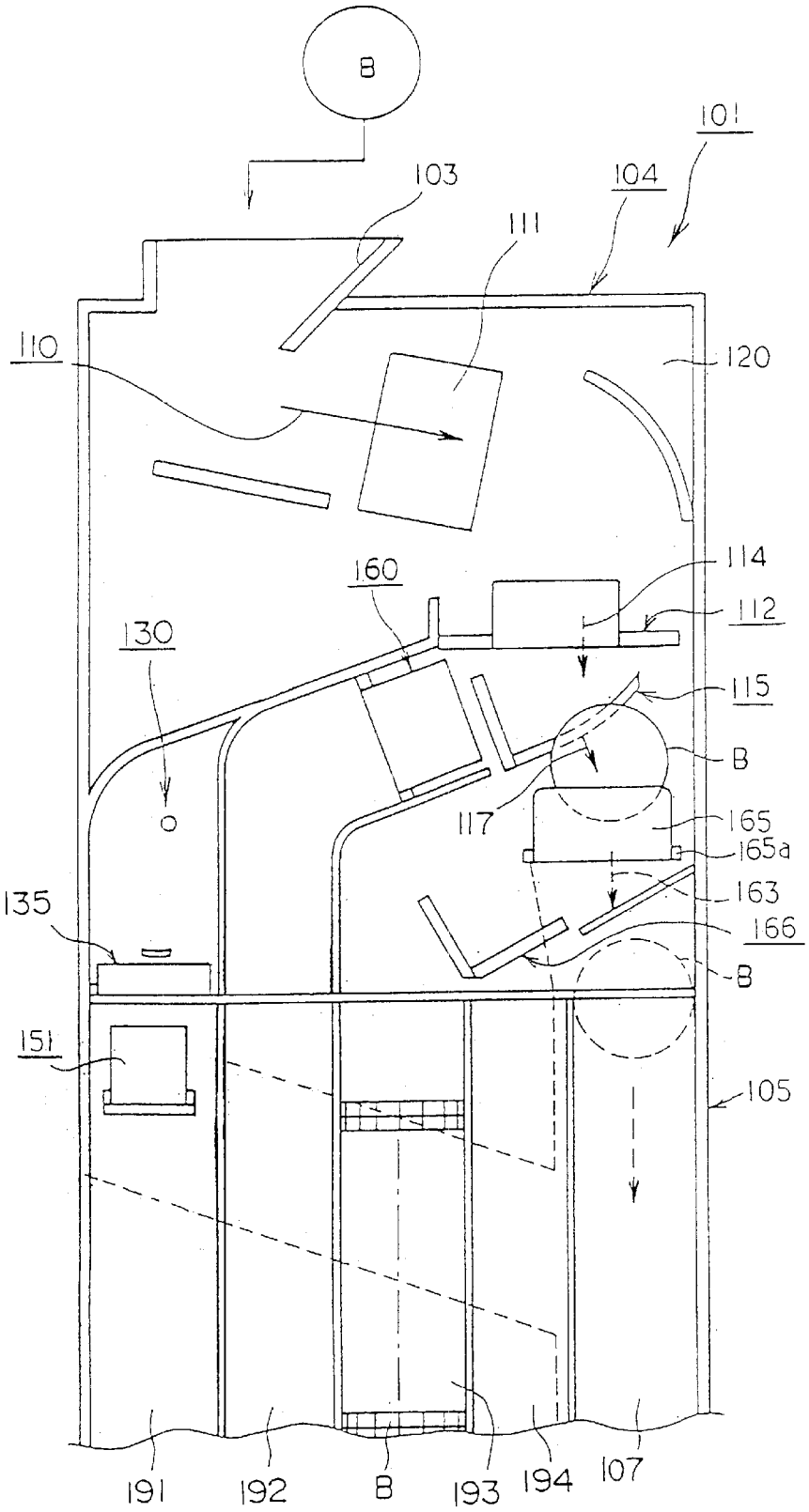
FIG. 43 is a schematic front view of the main components of the coin processing device in FIG. 25, illustrating the processing of a coin B.

As shown in FIG. 43, if a coin is inserted through the coin insertion slot 103 and determined to be a coin B on the basis of the detection signal from the coin identification sensor 111, and if the full-detecting sensor has detected that the number of coins B stored in the coin tube 193 has reached the predetermined number, then the control unit (not shown) operates the genuine/counterfeit coin sorting lever 112 on the basis of these identification results so as to block the upstream end of the counterfeit coin ejection passage 113 and open the upstream end of the first coin sorting passage 114, and at the same operates the first denomination sorting lever 115 so as to open the upstream end of the counterfeit coin ejection passage 113 and block the upstream end of the second coin sorting passage 116. At the same time, the control unit operates the third denomination sorting lever 165 so as to open the upstream end of the sixth coin sorting passage 163 and block the upstream end of the seventh coin sorting passage 164.

Consequently, as shown in FIG. 43, the coin B rolling through the coin identification passage 110 is guided by the genuine/counterfeit coin sorting lever 112 into the first coin sorting passage 114 as shown in FIG. 26, then guided by the first denomination sorting lever 115 into the third coin sorting passage 117 situated below. This coin B is then guided by the third denomination sorting lever 165 into the sixth coin sorting passage 163, drops from the bottom of the sixth coin sorting passage 163, and is immediately stored in the cashbox (not shown) communicating with the sixth coin sorting passage 163.

If we assume that the full-detecting sensor (not shown) has detected that the number of coins stored in the coin tube 194 for storing coins D has reached the predetermined number, then the above-mentioned coin sorting component 104 will perform the following sorting operation.

Figure 44:
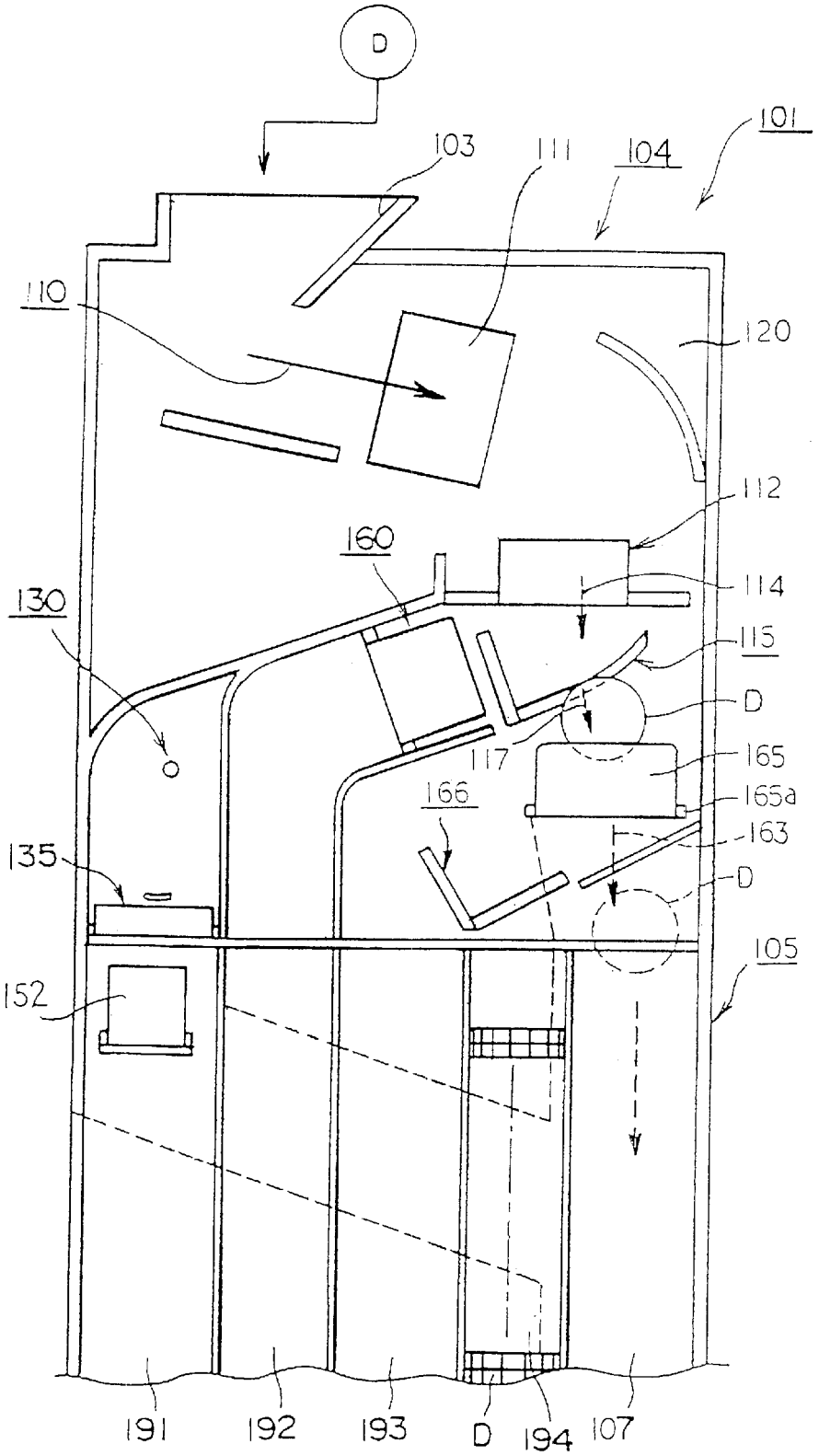
FIG. 44 is a schematic front view of the main components of the coin processing device in FIG. 25, illustrating the processing of a coin D.

As shown in FIG. 44, if a coin is inserted through the coin insertion slot 103 and determined to be a coin D on the basis of the detection signal from the coin identification sensor 111, and if the full-detecting sensor has detected that the number of coins D stored in the coin tube 194 has reached the predetermined number, then the control unit (not shown) operates the genuine/counterfeit coin sorting lever 112 on the basis of these identification results so as to block the upstream end of the counterfeit coin ejection passage 113 and open the upstream end of the first coin sorting passage 114, and at the same operates the first denomination sorting lever 115 so as to open the upstream end of the third coin sorting passage 117 and block the upstream end of the second coin sorting passage 116. At the same time, the control unit operates the third denomination sorting lever 165 so as to open the upstream end of the sixth coin sorting passage 163 and block the upstream end of the seventh coin sorting passage 164.

Consequently, as shown in FIG. 44, the coin D rolling through the coin identification passage 110 is guided by the genuine/counterfeit coin sorting lever 112 into the first coin sorting passage 114 as shown in FIG. 26, then guided by the first denomination sorting lever 115 into the third coin sorting passage 117 situated below. This coin D is then guided by the third denomination sorting lever 165 into the sixth coin sorting passage 163, drops from the bottom of the sixth coin sorting passage 163, and is immediately stored in the cashbox (not shown) communicating with the sixth coin sorting passage 163.

Similarly, when a coin C for which an overflow state exists is inserted, this coin C is immediately stored in the cashbox just as discussed above.

In the above description of overflow processing, the full-detecting sensors provided to the respective coin tubes 191, 192, 193, and 194 directly detected that the various predetermined numbers had been reached, but it is also possible for any subsequently inserted coins to be guided to the cashbox in the event that the numbers of coins stored in the various coin tubes reaches the number of change coins preset by main control on the vending machine side.

As described above, with the coin processing device of the third invention, the coin detaining means for temporarily detaining a plurality of coins is constituted by a coin detaining lever that intermittently drops the detained coins one at a time, downstream from this coin detaining means is provided a first coin sorting means for sorting the coins dropped one by one by the coin detaining lever into a return passage and the above-mentioned coin storage means, and downstream from this first coin sorting means is provided a second coin sorting means for sorting the coins sorted by the first coin sorting means into the coin storage means and a cashbox, so coin switching is prevented, and the number of high-denomination coins kept on hand in the coin tubes as change can be kept as low as possible, thereby minimizing the loss incurred in the event of vandalism.

The first to third inventions can be worked in various other embodiments without deviating from the essence or main features thereof, and therefore the embodiments given above are merely examples in all respects, should not be interpreted narrowly. The scope of the present invention is indicated in the claims, and is not restricted in any way to the text of this specification. Furthermore, all modifications and variations according to equivalent claims.

What is claimed is:

1. A coin processing device comprising:

coin identification means for identifying whether inserted coins are genuine or counterfeit and for identifying denominations of genuine coins;

a plurality of denomination sorting means for sorting inserted coins identified as genuine into different coin passages by denomination;

coin detaining means disposed downstream from the different coin passages, for temporarily detaining coins guided to the different coin passages;

coin storage means comprising a plurality of coin tubes disposed downstream from the coin detaining means, for stacking and storing coins that drop out of the coin detaining means;

first sorting means disposed downstream from the coin detaining means, for sorting the coins temporarily detained by the coin detaining means into a return passage and the coin storage means; and second sorting means disposed downstream from the first sorting means, for further sorting the coins sorted by the first sorting means into the coin storage means and a cashbox.

2. The coin processing device according to claim 1, wherein the coin identification means identifies whether the genuine coins are of new-type or old-type, and the second sorting means sorts coins of old-type into the cashbox based on the identification by the coin identification means as to whether the genuine coins are of new-type or old-type.

3. The coin processing device according to claim 1, wherein the second sorting means comprises a block-out lever for guiding coins that have been sorted into the coin storage means by the first sorting means into the cashbox if the coin storage means overflows with coins.

4. The coin processing device according to claim 1, wherein the second sorting means comprises a sorting lever operated by a solenoid.

5. The coin processing device according to claim 1, wherein the second sorting means sorts coins which have been sorted into the coin storage means by the first sorting means into the coin storage means and the cashbox according to the coins temporarily detained by the coin detaining means.

6. The coin processing device according to claim 1, wherein the second sorting means sorts coins which have been temporarily detained by the coin detaining means and then sorted into the coin storage means by the first sorting means into the coin storage means and the cashbox one at a time.

7. A coin processing device comprising:

coin identification means for identifying whether inserted coins are genuine or counterfeit and for identifying denominations of genuine coins;

a plurality of denomination sorting means for sorting inserted coins identified as genuine into different coin passages by denomination;

coin detaining means disposed downstream from the different coin passages, for temporarily detaining coins guided to the different coin passages;

coin storage means comprising a plurality of coin tubes disposed downstream from the coin detaining means, for stacking and storing coins that drop out of the coin detaining means;

first sorting means disposed downstream from the coin detaining means, for sorting the coins temporarily detained by the coin detaining means into a return passage and the coin storage means; and second sorting means disposed downstream from the first sorting means, for further sorting the coins sorted by the first sorting means into the coin storage means and a cashbox, wherein the second sorting means comprises a block-out lever for guiding coins that have been sorted into the coin storage means by the first sorting means are guided to the cashbox if the coin storage means overflows, and the block-out lever is operated by a solenoid.

8. A coin processing device comprising:

coin identification means for identifying whether inserted coins are genuine or counterfeit and for identifying denominations of genuine coins;

a plurality of denomination sorting means for sorting inserted coins identified as genuine into different coin passages by denomination;

coin detaining means disposed downstream from the different coin passages, for temporarily detaining a plurality of coins guided to the different coin passages; and coin storage means comprising a plurality of coin tubes disposed downstream from the coin detaining means, for stacking and storing coins that drop out of the coin detaining means, wherein the coin detaining means comprises a coin detaining lever that intermittently drops the plurality of coins detained therein one at a time, and there are further provided:

a first coin sorting lever provided downstream from the coin detaining means, for sorting the coins dropped one at a time by the coin detaining lever into a return passage and the coin storage means; and a second coin sorting lever provided downstream from the first coin sorting lever, for sorting the coins sorted into the coin storage means by the first coin sorting lever into the coin storage means and a cashbox.

9. The coin processing device according to claim 8, wherein the second coin sorting lever guides the detained coins dropped intermittently to the cashbox when a predetermined number of coins have accumulated in the coin storage means.

10. The coin processing device according to claim 8, wherein the second coin sorting lever is operated by a solenoid.

* * * * *